US006970567B1

(12) United States Patent
Gundry et al.

(10) Patent No.: US 6,970,567 B1
(45) Date of Patent: Nov. 29, 2005

(54) METHOD AND APPARATUS FOR DERIVING AT LEAST ONE AUDIO SIGNAL FROM TWO OR MORE INPUT AUDIO SIGNALS

(75) Inventors: Kenneth J. Gundry, San Francisco, CA (US); James W. Fosgate, Heber City, UT (US)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 1361 days.

(21) Appl. No.: 09/602,585

(22) Filed: Jun. 21, 2000

Related U.S. Application Data

(63) Continuation-in-part of application No. 09/532,711, filed on Mar. 22, 2000, and a continuation-in-part of application No. 09/454,810, filed on Dec. 3, 1999.

(51) Int. Cl.[7] ..... H04R 5/00
(52) U.S. Cl. ..... 381/22; 381/20
(58) Field of Search ..... 381/19–22, 17, 381/18; 700/94

(56) References Cited

U.S. PATENT DOCUMENTS

| | | | | |
|---|---|---|---|---|
| 4,589,129 | A | 5/1986 | Blackmer et al. | 381/21 |
| 4,799,260 | A | 1/1989 | Mandell et al. | 381/22 |
| 5,172,415 | A | 12/1992 | Fosgate | 381/22 |
| 5,295,189 | A | 3/1994 | Fosgate | 381/22 |
| 5,428,687 | A | 6/1995 | Willcocks et al. | 381/18 |

(Continued)

FOREIGN PATENT DOCUMENTS

EP 0949845 10/1999

(Continued)

OTHER PUBLICATIONS

Texas Instruments Incorporated, TL07_Series Low-Noise JFET-Input Operational Amplifiers data sheet, 1996, Dallas, Texas.

(Continued)

*Primary Examiner*—Ping Lee
(74) *Attorney, Agent, or Firm*—Gallagher & Lathrop; Thomas A. Gallagher

(57) ABSTRACT

A multidirectional audio decoder using an "adaptive" audio matrix derives at least one of a plurality of output audio signals from two or more directionally-encoded audio input signal streams (S1(α), S2(α), . . . SN(α), wherein α is the encoded angle of a source audio signal. Each output signal is associated with a principal direction β. In order to generate each output signal, a pair of intermediate signals ("antidominant" signals) are generated, constituting the antidominant signal for each of the two adjacent principal output directions of the decoder. The antidominant signal for any arbitrary principal (or "dominant") direction is the combination of input signals having coefficients such that the combination goes to zero for that dominant direction. Amplitude control is applied to the two antidominant signals to deliver a pair of signals having substantially equal magnitudes that are additively or subtractively combined to provide the output audio signal associated with a principal direction. The pair of signals that are combined include passive matrix components. In an alternative embodiment, passive matrix components for the output signal are derived instead by applying the input audio signals to a passive matrix and by combining the passive matrix components with pairs of amplitude controlled versions of the antidominant signals that do not include passive matrix components. For sources from one direction at a time, there is little or no unwanted crosstalk into outputs that should be silent (ie., there is substantially no signal in outputs other than the two representing directions adjacent to the desired direction, except when the desired direction happens to correspond to that of an output, in which case there is a signal in substantially only that output).

16 Claims, 25 Drawing Sheets

U.S. PATENT DOCUMENTS

| | | | | |
|---|---|---|---|---|
| 5,504,819 | A | 4/1996 | Fosgate | 381/18 |
| 5,625,696 | A | 4/1997 | Fosgate | 381/18 |
| 5,644,640 | A | 7/1997 | Fosgate | 381/18 |
| 5,862,228 | A | 1/1999 | Davis | 381/17 |

FOREIGN PATENT DOCUMENTS

| | | |
|---|---|---|
| JP | 1062460 | 3/1998 |

OTHER PUBLICATIONS

Analog Devices, Inc., Dynamic Range Processors/Dual VCA SSM2120/SSM2122 data sheet, 1995, Norwoord, Massachusetts.

Gundry, Kenneth, "A New Active Matrix Decoder for Surround Sound", AES 19th International Conference on Surround Sound, Jun. 21, 2001, Schloss Elmau, Germany.

METHOD AND APPARATUS FOR DERIVING AT LEAST ONE AUDIO SIGNAL FROM TWO OR MORE INPUT AUDIO SIGNALS

CROSS REFERENCE TO RELATED APPLICATIONS

This application is a continuation-in-part of copending U.S. patent application Ser. No. 09/454,810 of James W. Fosgate, filed Dec. 3, 1999 and copending U.S. patent application Ser. No. 09/532,711 of James W. Fosgate, filed Mar. 22, 2000.

FIELD OF THE INVENTION

The invention relates to audio signal processing. In particular, the invention relates to "multidirectional" (or "multichannel") audio decoding using an "adaptive" (or "active") audio matrix that derives at least one audio signal stream (or "signals" or "channels") from two or more directionally-encoded audio input signal streams (or "signals" or "channels).

BACKGROUND OF THE INVENTION

Audio matrix encoding and decoding is well known in the prior art. For example, in so-called "4-2-4" audio matrix encoding and decoding, four source signals, typically associated with the same four cardinal input and output directions (such as, for example, left, center, right and surround or left front, right front, left back and right back) are amplitude-phase matrix encoded into two signals in which their relative amplitude and polarity represents their directional encoding. The two signals are transmitted or stored and then decoded by an amplitude-phase matrix decoder in order to recover approximations of the original four source signals. The decoded signals are approximations because matrix decoders suffer the well-known disadvantage of crosstalk among the decoded audio signals. Ideally, the decoded signals should be identical to the source signals, with infinite separation among the signals. However, the inherent crosstalk in matrix decoders typically results in only 3 dB separation between signals associated with adjacent directions. An audio matrix in which the matrix characteristics do not vary is known in the art as a "passive" matrix. The quiescent or "unsteered" condition of an active or adaptive matrix is also referred to as its "passive" matrix condition.

In order to overcome the problem of crosstalk in matrix decoders, it is known in the prior art to vary adaptively the decoding matrix characteristics in order to improve separation among the decoded signals and more closely approximate the source signals. One well known example of such an active matrix decoder is the Dolby Pro Logic decoder, described in U.S. Pat. No. 4,799,260, which patent is incorporated by reference herein in its entirety. The '260 patent cites a number of patents that are prior art to it, many of them describing various other types of adaptive matrix decoders.

Improved types of adaptive matrix decoders are disclosed in U.S. patent application Ser. No. 09/454,810 of James W. Fosgate, filed Dec. 3, 1999 and U.S. patent application Ser. No. 09/532,711 of James W. Fosgate, filed Mar. 22, 2000 (the "Fosgate applications"). In said Fosgate applications, desirable relationships among intermediate signals in adaptive matrix decoders are used to simplify the decoder and improve the decoder's accuracy.

In the decoders of the Fosgate applications, Lt and Rt ("left total" and "right total") input signals are received and four output signals are provided, the four output signals representing principal directions, left, right, center and surround, in which pairs of the directions (left/right, center/surround) lie on directions that are ninety degrees to each other. The relative magnitude and polarity of the Lt and Rt input signals carry directional information. A first "servo" operates on Lt and Rt and a second "servo" operates on the sum and difference of Lt and Rt, each servo delivering a pair of intermediate signals. The pair of intermediate signals delivered by each servo are controlled in magnitude and the controlled intermediate signals are "urged towards equality" or "controlled for equal magnitude" (but their polarities need not be the same) by the respective servo (hence, the appellation "servo"). The four decoder output signals are generated by combining, both additively and subtractively, each pair of magnitude controlled "urged toward equality" intermediate signals.

The four-output decoders disclosed in said Fosgate applications are "perfect" in the sense that a single source signal having a particular direction encoded into the input Lt and Rt signals is reproduced (with appropriate relative magnitudes) only by the two outputs representing directions adjacent to the encoded direction (or, when the encoded direction happens to be exactly the direction represented by an output, only by that single output).

The second of said Fosgate applications also discloses a technique for providing decoder outputs for directions other than the directions of the four outputs derived from pairs of intermediate signals controlled for equal magnitude. However, such additional decoder output signals suffer from greater undesirable crosstalk than the basic four outputs of the decoders in said Fosgate applications. Thus, despite the improved performance provided by the decoders in said Fosgate applications, there remains a need for an adaptive matrix decoder capable of providing multiple outputs, each having an arbitrary direction, the outputs having the high degree of crosstalk suppression of the four-output decoders of said Fosgate applications.

SUMMARY OF THE INVENTION

The present invention lies in the realization that the principle of pairs of intermediate signals controlled for equal magnitudes is not limited to audio matrix decoders having four principal decoding directions in which pairs of the directions are ninety degrees to each other, but instead may be applied to a matrix decoder having multiple outputs corresponding to principal decoding directions, the directions having arbitrary angular locations, spaced arbitrarily, with no requirement that the pairs of output signals lie on axes that are ninety degrees to each other. In addition, the present invention can be applied to decoders that receive two and more than two directionally-encoded ("total") input signals. This realization leads to new decoders employing combinations of pairs of controlled intermediate signals urged toward magnitude equality (but not necessarily the same polarity) that have the same "perfection" as the four-output decoders of said Fosgate applications. For sources from one direction at a time, there is little or no unwanted crosstalk into outputs that should be silent (i.e., there is substantially no signal in outputs other than the two representing directions adjacent to the desired direction, except when the desired direction happens to correspond to that of an output, in which case there is a signal in substantially only that output).

In the decoders of said Fosgate applications, the input signals received by a "servo" have inherent properties that are not recognized in said Fosgate applications. Namely, one of the two input signals to the servo goes substantially to zero when the direction encoded in the input signals is one of the principal (or "cardinal") decoder output directions adjacent to one of the two principal directions of the decoder output signal derived from that servo and the other of the two inputs goes substantially to zero when the direction encoded in the input signals is the other of the principal decoder output directions adjacent to the principal direction of the output signal derived from that servo.

Thus, for example, in the decoder shown in FIG. 1 herein, the principal output directions are left (Lout), right (Rout), center (Cout), and surround (Sout). FIG. 1 is a combination of two figures in said Fosgate applications: FIG. 6 (FIG. 18 of the present document) with the feedback control circuit of FIG. 3 (FIG. 15 of the present document) incorporated in it. Details of FIG. 1 are set forth in the descriptions of FIGS. 15 and 18 below. With respect to the Cout principal direction output, for example, the Lt input goes to zero when the Lt and Rt inputs are direction encoded by a "right" source signal (one of the principal output directions adjacent to center) and the Rt input goes to zero when the Lt and Rt inputs are direction encoded by a "left" source signal (the other of the principal output directions adjacent to center). The servos 3 and 5 are controlled so that their respective outputs are urged toward amplitude equality. The center output Cout is obtained by additively combining the outputs of one of the servos (the L/R servo 3). Because of the ninety-degree relationship of the pairs of outputs (L/R with respect to C/S), the "kept equal" signals required to generate the center output are the same as the "kept equal" signals required to generate the surround output. Thus, for the special four-output case in which the output directions are pairs of directions on axes that are ninety degrees to each other, outputs such as the center and surround (or the left and right) output signals of the FIG. 1 decoder do not need to be derived separately (as do each of the output signals for the arbitrary principal direction outputs of the present invention), but may be derived from the same "kept equal" signals that are urged toward equality by combining them both additively and subtractively.

A signal representing any arbitrary source direction may be directionally encoded into two (or more) signals or "channels" in linear, time-invariant combinations according to a rule. For example, a single source audio signal having a unity amplitude and representing an arbitrary direction $\alpha$ degrees may be encoded into two channels designated Lt and Rt (signals such as Lt and Rt are often referred to as "total" signals, namely, "left total" and "right total") in which the two input signals bear directional information for the single audio signal source in their relative magnitude and polarity. The directional encoding may be in accordance with the following expressions in which $\alpha$ is the intended directional angle of the source signal (with respect to a horizontal circular frame of reference, starting with zero degrees at the back and going clockwise):

$$Lt(\alpha)=\cos((\alpha-90)/2), \text{ and} \quad \text{Eqn. 1}$$

$$Rt(\alpha)=\sin((\alpha-90)/2). \quad \text{Eqn. 2}$$

It will be appreciated that the cosine and sine definitions of Equations 1 and 2 are only one of an infinite number of possible functions satisfying the directional encoding requirements stated above. Because they are easily understood, simple to work with and are inherently normalized (the square root of cosine squared plus sine squared is one), encoded total signals such as Lt and Rt will be expressed in accordance with the cosine and sine functions, such as those of Equations 1 and 2, in examples throughout this document. Although the outputs of a 4:2 "real" encoding matrix conform to Equations 1 and 2 (i.e., one with no imaginary terms or phase shifting in which there are four principal source directions left, center, right and surround such that Lt=L+0.707C+0.707S and Rt=R+0.707C−0.707S), there is no requirement in either the decoders of said Fosgate applications or the decoders of the present invention that 4:2 encoding be employed to produce Lt and Rt, nor is there any requirement in any of such decoders, if the encoder is a 4:2 matrix, that four principal directions be employed in the decoder nor that any of the same principal directions employed in the encoder be employed in the decoder. The encoded "total" signals may be generated in any way, including, for example, an encoding matrix (whether a 4:2 or a 5:2 matrix, for example, having equal-spaced or any arbitrary principal encoding direction spacings), an array of directional microphones, a series of panpots receiving a plurality of signals, a number of discrete channels, etc. So long as the directional coding in the input signals to the decoder is continuous, as is the case in a practical system, the present invention allows any number of decoded output directions.

In decoders according to the present invention, subject to certain qualifications expressed below, one may choose a set of arbitrary principal output directions having arbitrary angular spacings. Let $\beta$2 be one of the principal output directions with $\beta$1 and $\beta$3 being the principal output directions on either side of and adjacent to $\beta$2. For the case of two input signals such as Lt and Rt, it is possible to generate a pair of linear combinations of Lt and Rt having coefficients such that a first combination is zero when the direction $\alpha$ of a source signal encoded into Lt and Rt is the same direction as $\beta$1 and a second combination is zero when the direction encoded into Lt and Rt is $\beta$3. The signals represented by these combinations may be called the "antidominant" signals for directions $\beta$1 and $\beta$3. In other words, the antidominant signal for any arbitrary principal (or "dominant") direction is the combination of input signals having coefficients such that the combination goes to zero for that dominant direction.

The antidominant signal for any principal output direction $\beta$, one of the output directions of the decoder, for a source direction a can be determined from the expression $$anti\beta(\alpha)=Al\beta\cdot Lt(\alpha)+Ar\beta\cdot Rt(\alpha). \quad \text{Eqn. 3}$$

Equation 3 is a function of the variable $\alpha$, the variable direction in which a source signal is intended to be reproduced. In other words, anti$\beta(\alpha)$ is the antidominant combination for output direction $\beta$, but it has a different value for every source signal direction $\alpha$. The fixed coefficients Al$\beta$ and Ar$\beta$ are chosen so that the anti$\beta(\alpha)$ is substantially zero when $\alpha$ is the same angle as $\beta$ (i.e., when the direction of the encoded source signal is the same as direction $\beta$). When the source is at angle $\beta$, Equation 3 becomes:

$$anti\beta(\beta)=Al\beta\cdot Lt(\beta)+Ar\beta\cdot Rt(\beta). \quad \text{Eqn. 3a}$$

Neglecting a possible common multiplier, the only values of Al$\beta$ and Ar$\beta$ that inherently meet this requirement are $$Al\beta=-Rt(\beta) \text{ and}$$

$$Ar\beta=Lt(\beta),$$

or $$Al\beta=Rt(\beta) \text{ and}$$

$$Ar\beta=-Lt(\beta)$$

since clearly $Rt(\beta)\cdot Lt(\beta)-Lt(\beta)\cdot Rt(\beta)=0$. Thus, for the practical case expressed in Equations 1 and 2:

$$Al\beta=-\sin((\beta=90)/2) \text{ and}$$

$$Ar\beta=\cos((\beta-90)/2),$$

or $$Al\beta=\sin((\beta-90)/2) \text{ and}$$

$$Ar\beta=-\cos((\beta-90)/2).$$

In examples herein some antidominant signals are written in the forms $$anti\beta(\beta)=Al\beta\cdot Lt(\beta)=Ar\beta\cdot Rt(\beta) \text{ and} \quad \text{Eqn. 3b}$$

$$anti\beta(\beta)=Rt\beta\cdot Lt(\beta)-Lt\beta\cdot Rt(\beta). \quad \text{Eqn. 3c}$$

It will be understood, in view of the above discussion, that the forms of Equations 3b and 3c conform to the general form of an antidominant signal expressed in Equations 3 (above) and 22–25 (below).

Equation 3 may be rewritten by substituting the coding of Lt and Rt expressed in Equations 1 and 2:

$$anti\beta(\alpha)=Al\beta\cdot\cos((\alpha-90)/2)+Ar\beta\cdot\sin((\alpha-90)/2). \quad \text{Eqn. 4}$$

In order to generate an output for an arbitrary direction $\beta\mathbf{2}$, one uses the antidominant signals for the direction $\beta\mathbf{1}$ and $\beta\mathbf{3}$ outputs, the two adjacent direction outputs. Thus, for the principal output direction $\beta\mathbf{2}$, the required coefficients for the two necessary antidominant signals are provided when Equations 3 and 4 equal zero for $\alpha$ equal to $\beta\mathbf{1}$ and to $\beta\mathbf{3}$:

$$anti\mathbf{1}(\alpha)=Al\beta\mathbf{1}\cdot\cos((\alpha-90)/2)+Ar\beta\mathbf{1}\cdot\sin((\alpha-90)/2)=0 \text{ when } \alpha=\beta\mathbf{1}, \quad \text{Eqn. 5}$$

and $$anti\mathbf{3}(\alpha)=Al\beta\mathbf{3}\cdot\cos((\alpha-90)/2)+Ar\beta\mathbf{3}\cdot\sin((\alpha-90)/2)=0 \text{ when } \alpha=\beta\mathbf{3}. \quad \text{Eqn. 6}$$

It will be appreciated that "anti$\mathbf{1}(\alpha)$," anti$\mathbf{3}(\alpha)$, and similar expressions (such as "anti$\beta\mathbf{1}(\alpha)$") used throughout this document are shorthand expression for "antidominant$\beta\mathbf{1}(\alpha)$," "antidominant$\beta\mathbf{3}(\alpha)$," etc.

Since the important property is that the antidominant expressions go to zero when the source direction a is equal to $\beta\mathbf{1}$ and to $\beta\mathbf{3}$, the absolute values of Al and Ar are not significant and a scaling factor (the same scaling factor) may be applied to both coefficients. As is explained hereinafter, application of a fixed scaling factor is useful to assure that the output peak occurs at the desired output angle when the angles between output directions are not uniform and also to alter the matrix characteristics when the active matrix decoder is in its quiescent or passive matrix condition (i.e., when there is no clear steering; when the servos "relax" such that the decoder functions essentially as a passive matrix). Another type of scaling, an adaptive scaling that varies the antidominant coefficients in amplitude as a function of the encoded source signal angle $\alpha$, may be applied equally to all the coefficients of both antidominant signals. Adaptive scaling, explained further below, is useful for maintaining constant power among the output signals.

Absent a scaling factor, the "go to zero" condition is satisfied for the anti$\mathbf{1}(\alpha)$ combination when $\alpha=\beta\mathbf{1}$ by the following values for coefficients Al$\beta\mathbf{1}$ and Ar$\beta\mathbf{1}$:

$$Al\beta\mathbf{1}=\sin((\beta1-90)/2, \text{ and} \quad \text{Eqn. 7}$$

$$Ar\beta\mathbf{1}=\cos((\beta1-90)/2, \text{ and} \quad \text{Eqn. 8}$$

for the anti$\mathbf{3}(\alpha)$ combination when $\alpha=\beta\mathbf{3}$ by the following values for Al$\beta\mathbf{1}$ and Ar$\beta\mathbf{3}$:

$$Al\beta\mathbf{3}=\sin((\beta3-90)/2, \text{ and} \quad \text{Eqn. 9}$$

$$Ar\beta\mathbf{3}=\cos((\beta3-90)/2. \quad \text{Eqn. 10}$$

Consider, for example, a two-input decoder in which the desired principal output directions are 31.5° (left back, LB), 90° (left front, LF), 180° (center, C), 270° (right front, RF) and 328.5° (right back, RB). To derive the left back (31.5 degree) principal direction output in accordance with the present invention, two antidominant signals are required, one for the adjacent left front (90 degree) principal direction and the other for the adjacent right back (328.5°) principal direction. The antidominant signal for left front may be expressed:

$$antiLF(\alpha)=\sin((90-90)/2)Lt(\alpha)+\cos((90-90)/2)Rt(\alpha). \quad \text{Eqn. 11}$$

Thus, the first antidominant signal is:

$$antiLF(\beta)=0\cdot Lt(\alpha)+1\cdot Rt(\alpha)=Rt(\alpha), \quad \text{Eqn. 12}$$

and the second antidominant signal is:

$$antiRB(\alpha)=\sin((328.5-90)/2)\cdot Lt(\alpha)+\cos((328.5-90)/2)\cdot Rt(\alpha)=0.872\cdot Lt(\alpha)-0.489\cdot Rt(\alpha). \quad \text{Eqn. 13}$$

Coefficients controlling the relative magnitudes and relative polarities of the input signal combinations that form antidominant signals may be positive real numbers and negative real numbers and all but one coefficient may be zero.

The pair of antidominant signals are then subject to gain modification by a closed-loop or open-loop function or arrangement in order to deliver a pair of signals with substantially equal magnitude. That is, it is desired that an amplitude modified version of anti$\mathbf{1}(\alpha)$ equals an amplitude modified version of anti$\mathbf{3}(\alpha)$ or, at least, that the amplitude modified versions of the antidominant signals are controlled so as to reduce any difference in their respective magnitudes.

The desired antidominant signals for use in producing any particular output signal direction may be generated by applying the input signals, such as Lt and Rt, to a matrix that produces the antidominant signal for each of the two adjacent principal directions. Note that no antidominant signal generating matrix overtly appears in the four-output decoders of said Fosgate applications. Said applications do not appreciate that the signals entering the servos of the decoders disclosed in those applications are in fact the antidominant signals for adjacent principal directions because they happen to be the same as Lt, Rt, and the sum and difference of Lt and Rt.

A function or arrangement that applies amplitude control to the two antidominant signals to deliver a pair of signals with substantially equal magnitude is referred to herein as a "servo" whether or not it is a closed-loop or feedback-type control function or arrangement. The servo may be implemented in analog or digital hardware or in software. In practical analog embodiments of the present invention, the servo includes a pair of voltage-controlled-amplifiers (VCAs). Control in analog or digital embodiments of the present invention may be effected by a feedback system in which the ratio of the magnitudes of the servo outputs is compared to 1 and used to generate an error signal for controlling VCAs within the servo, so forcing the servo to deliver approximately equal magnitudes. Alternatively, in analog or digital embodiments of the present invention, the urging toward equality may be accomplished by an open-loop feed-forward process that measures the servo input signals. In this case, the smaller input may be left substantially unchanged, while the larger one is attenuated by the ratio of the smaller to the larger in order to urge its magnitude toward or equal to that of the smaller. Although feedback control arrangements may give desirable dynamic properties, they may be less convenient in some digital realizations. A technique for accomplishing feedback control in the digital domain at a lowered sampling rate is disclosed herein and constitutes an alternative aspect of the present invention.

The two "urged toward equality" versions of the antidominant signals are then combined, either additively or subtractively. When the principal directions adjacent to the desired principal output direction are less than 180 degrees apart, the signals are combined in the polarity sense that places the output signal direction within the smaller of the two arcs between the adjacent directions. In the special ninety-degree axes—four-output case (e.g., the four-output decoders described in said Fosgate applications), the signals may be combined in both polarity so as to obtain two output signals.

Consider another example having a single source audio signal having a unity amplitude encoded into two signals applied to the decoder. Assume that for a desired principal direction output of 90° the adjacent principal directions are 30° and 150°. Thus $\beta 2=90°$, $\beta 1=30°$ and $\beta 3=150°$. Plots of anti1(α) and anti3(α) versus α are shown in FIG. 2. Note that anti1(α) goes to zero at 30° and anti3(α) goes to zero at 150°. Both antidominant signals change polarity when they pass through zero.

The antidominant signals are subjected to gain modification and the resultant modified signals are controlled to urge them toward equal magnitude by a closed-loop or open-loop servo. Employing the non-feedback open-loop approach described above, the required gains to urge the antidominant signals toward equality, hβ1(α) for anti1(α) and hβ3(α) for anti3(α), both functions of the direction angle α, can be written $$h\beta 1(\alpha) := \text{if}\left(\left|\frac{anti\beta 1(\alpha)}{anti\beta 3(\alpha)}\right| \geq 1, \left|\frac{anti\beta 3(\alpha)}{anti\beta 1(\alpha)}\right|, 1\right) \quad \text{Eqn. 14}$$

$$h\beta 3(\alpha) := \text{if}\left(\left|\frac{anti\beta 3(\alpha)}{anti\beta 1(\alpha)}\right| \geq 1, \left|\frac{anti\beta 1(\alpha)}{anti\beta 3(\alpha)}\right|, 1\right) \quad \text{Eqn. 15}$$

The above "if" function (and other such "if" functions in this document) follow the structure $$\text{if(condition, value1, value2)}, \quad \text{Eqn. 16}$$

which means, if the condition is met, the first value applies, if not, the second.

As noted above, equations 14 and 15 are for a feedforward control. Those equations and other equations below reflect a feedforward control system rather than a feedback system because the equations are simpler and more easily understood. It should be appreciated that a feedback system provides essentially the same results.

The gains hβ1(α) and hβ3(α) of Equations 14 and 15 as functions of the direction angle a are shown in FIG. 3.

The outputs of the respective controlled gain or attenuation functions or elements, magβ1(α) and magβ3(α) may be expressed $$mag\beta 1(\alpha)=h\beta 1(\alpha)\cdot anti1(\alpha) \quad \text{Eqn. 17}$$

$$mag\beta 3(\alpha)=h\beta 3(\alpha)\cdot anti3(\alpha) \quad \text{Eqn. 18}$$

FIG. 4 shows magβ1(α) of Equation 17 and magβ3(α) of Equation 18 as functions of the direction angle α. Controlled gain or attenuation outputs magβ1(α) and magβ3(α) are identical in magnitude and polarity except in the range β1 to β3 where they have identical magnitude but opposite polarity. Hence, by subtracting them (as stated above, signals are combined in the polarity sense that places the output signal direction within the smaller of the two arcs between adjacent directions), one obtains the desired output for the principal direction β2. The output for principal direction β2, $$output\beta 2(\alpha)=mag\beta 1(\alpha)-mag\beta 3(\alpha), \quad \text{Eqn. 19}$$

is zero except in the limited direction angle range between the adjacent principal directions β1 and β3. A plot of outputβ2(α) versus the direction angle a is shown in FIG. 5. Thus, for a single source signal whose directional encoding is panned clockwise around the whole circle from α=0° at the rear through α=180° at the front and back to α=360° at the rear, the output for principal direction β2 rises from zero at β1 to a maximum at or near β2 and falls again to zero at β3, the desired result. Thus, there is inherently no crosstalk into β2 from source directions outside β1 and β3.

For an N-output decoder, there are N triplets of β1, β2 and β3, and hence the process and arrangement just described is carried out N times to yield N outputs substantially without unwanted crosstalk between them.

In a practical embodiment of the present invention using a feedback servo to control the controlled gain or attenuation functions or elements, it may be more convenient not to generate the gains hβ1(α) and hβ3(α) directly, but instead to generate gains gβ1(α) and gβ3(α), where $$g\beta 1(\alpha)=1-h\beta 1(\beta), \text{ and} \quad \text{Eqn. 20}$$

$$g\beta 3(\alpha)=1-h\beta 3(\alpha), \quad \text{Eqn. 21}$$

and then to subtract the outputs of the controlled gain or attenuation functions or elements from their inputs; the results are equivalent. Plots of gβ1(α) and gβ3(α) versus the direction angle α are shown in FIG. 6.

As noted above, the principles of the present invention may also be applied to decoders receiving more than two inputs. Thus, for example, three input signals to the decoder may be provided, Lt, Rt and Bt, the three signals carrying directional information by way of their relative amplitudes and polarity in a manner analogous to that in which the described pair of input signals carry directional information for the source signals they represent. However, in the case of three or more input signals, it is not sufficient to select antidominant signal coefficients that cause adjacent antidominant signals to go to zero at the appropriate times. There is more than one set of coefficients that satisfy that criterion; however, only one set provides the desired results (i.e., for a single source signal whose directional encoding is panned clockwise around the whole circle from α=0° to 360°, the output for principal direction β2 rises from zero at β1 to a maximum at or near β2 and falls again to zero at β3, where β1, β2 and β3 are consecutive principal output directions). Instead, the coefficients must be selected so that the antidominant signals have one polarity when the source signal direction a lies between β1 and β3 and the other relative polarity for all other values of α. These conditions are inherently met for the case of two input signals by the selection of coefficients that result in the aforementioned "go to zero" result. Use of the "go to zero" conditions for the two input signal case is, in fact, a special condition of the just-stated one-polarity, other-polarity conditions for multiple input signals. This situation is explained further in the following paragraphs.

For a system employing two total signals Lt and Rt, whose relative magnitudes and polarities define the intended reproduced direction, a rational and continuous choice of direction coding parameters, such as the cosine/sine relationship presented above, means that as a source is panned through the whole 360 degree circle, the sign of Lt will change no more than once and the sign of Rt will change no more than once. Hence, any linear combination of Lt and Rt such as an antidominant signal will also have this property. Since a change of sign must occur as a (continuous) function passes through zero, it follows that for an antidominant signal, the one sign change occurs at the point where the antidominant signal has the value zero, that is, at the corresponding principal direction. Thus, considering a pair of antidominant signals, there can inherently be one segment and one only where the antidominant signals have one relative polarity, and they will have the opposite polarity for the rest of the circle. After being urged towards equal magnitudes and combined additively or subtractively, there will therefore be only one non-zero segment.

For a system employing more than two total signals, the signs of the signals themselves, and more particularly of linear combinations forming antidominant signals, may change more than once. Thus, there is the potential for multiple segments of one polarity, alternating with the other, and multiple non-zero segments at the output. FIG. 7 shows a pair of antidominant signals derived from three input total signals, with a set of coefficients chosen for zero output at 60° and 180° (note that at least one other set of coefficients brings about that result). The intention is to deliver an output between these angles but not elsewhere. FIG. 8 shows amplitude controlled versions of the antidominant signals urged towards equality. The relative polarities of the two change several times during a pan of the source signal around the circle, and thus as shown in FIG. 9, addition (in this case) yields two non-zero segments, the desired one with a maximum magnitude at about 120° and an unwanted one with a maximum magnitude at about 300°.

It will be noted that the antidominant signal antiLB(α) of FIG. 7 goes through zero at 60° and 240°, while the antidominant signal antiC(α) goes through zero at 0° and 180°. Thus, the "urged toward equality" versions of those antidominant signals, L1(α) and L2(α), shown in FIG. 8 go to zero at all four angles (L1 and L2 are the same magnitude, but may be of the same or opposite polarity). L1 or L2 go to zero either because the antidominant signal from which it is derived goes to zero (L1 is derived from anti1LB and L2 is derived from antiC) or the other antidominant signal goes to zero and the servo introduces a large attenuation).

A different choice of coefficients derived from the same three total signals avoids the unwanted output in the region of 300°. For this second set of coefficients, as shown in FIGS. 10, 11 and 12 (compare FIGS. 10, 11 and 12 to FIGS. 7, 8 and 9) the antidominant signals still pass through zero and change sign more than once, but except for the changes occurring at the desired angles either side of the principal output being generated (60° and 180°), those changes occur at the same angle (300°). Expressing this differently, for all except the two desired points (60° and 180°), the signals urged towards equality cross at zero (in this case at 300°). The result is that after addition, there is only one, the desired, non-zero segment between 60° and 180°, and no unwanted crosstalk from other directions.

It follows that when there are more than two total signals, there is an additional constraint in choosing coefficients to derive the antidominant signals. They must ensure that except at the two adjacent principal directions, the relative polarity changes of the two antidominant signals must occur at the same angles, so that for each signal, only one zero crossing coincides with a finite value for the other signal. All other zero crossings must coincide with a zero value for the other signal. This will ensure that after urging towards equal magnitudes and combining, there will be only one non-zero segment.

Thus, for the case of two input audio signals, the present invention contemplates a method of deriving one of a plurality of output audio signals from two input audio signals S1(α) and S2(α), the output audio signal associated with a principal direction β2, the input audio signals encoded with an audio source signal having a direction α. Two antidominant audio signals of the following form are generated:

$$antidominant\beta\mathbf{1}(\alpha)=AS\mathbf{1}\beta\mathbf{1}\cdot S\mathbf{1}(\alpha)+AS\mathbf{2}\beta\mathbf{1}\cdot S\mathbf{2}(\alpha) \qquad \text{Eqn. 22}$$

and $$antidominant\beta\mathbf{3}(\alpha)=AS\mathbf{1}\beta\mathbf{3}\cdot S\mathbf{1}(\alpha)+AS\mathbf{2}\beta\mathbf{3}\cdot S\mathbf{2}(\alpha), \qquad \text{Eqn. 23}$$

wherein in one antidominant signal the angle β1 is the angle of one of the two principal directions adjacent to the principal direction β2 of the output audio signal and in the other antidominant signal the angle β3 is the angle of the other of the two principal directions adjacent to the principal direction β2 of the output audio signal. The coefficients AS1β1 and AS2β1 in one antidominant audio signal are selected so that the one antidominant signal is substantially zero when α is β1 and the coefficients AS1β3 and AS2β3 in the other antidominant audio signal are selected so that the other antidominant signal is substantially zero when α is β3. α. Amplitude control is applied to the two antidominant signals to deliver a pair of signals having substantially equal magnitudes that are additively or subtractively combined to provide the output audio signal.

For the case of two or more input audio signals, the present invention contemplates a method of deriving one of a plurality of output audio signals from two or more input audio signals (S1(α), S2(α), . . . SN(α)), the output audio signal associated with a principal directionβ2, the input audio signals encoded with an audio source signal having a direction α. Two antidominant audio signals of the following form are generated:

$$\text{anti}\beta\mathbf{1}(\alpha)=\sum_{n=1}^{N} ASn\beta\mathbf{1}\cdot Sn(\alpha) \qquad \text{Eqn. 24}$$

$$\text{anti}\beta\mathbf{3}(\alpha)=\sum_{n=1}^{N} ASn\beta\mathbf{3}\cdot Sn(\alpha) \qquad \text{Eqn. 25}$$

wherein N is the number of input audio signals, β1 is the angle of one of the two principal directions adjacent to the principal direction β2 of the output audio signal, β3 is the angle of the other of the two principal directions adjacent to the principal direction β2 of the output audio signal, and the coefficients AS1β1, AS2β1, . . . ASNβ1 and AS1β3, AS2β3, . . . ASNβ3 are selected so that the antidominant signals have one relative polarity when α lies between β1 and β3 and the other relative polarity for all other values of α. Amplitude control is applied to the two antidominant signals to deliver a pair of signals having substantially equal magnitudes that are additively or subtractively combined to provide the output audio signal.

For the case of two input signals, the present invention also contemplates an alternative method of deriving one of a plurality of output audio signals from two input audio signals S1(α) and S2(α), the output audio signal associated with a principal direction β2, the input audio signals encoded with an audio source signal having a direction α. Two antidominant audio signals of the following form are generated:

$$antidominant\beta 1(\alpha)=AS1\beta 1\cdot S1(\alpha)+AS2\beta 1\cdot S2(\alpha)$$

and $$antidominant\beta 3(\alpha)=AS1\beta 3\cdot S1(\alpha)+AS2\beta 3\cdot S2(\alpha),$$

wherein in one antidominant signal the angle β1 is the angle of one of the two principal directions adjacent to the principal direction β2 of the output audio signal and in the other antidominant signal the angle β3 is the angle of the other of the two principal directions adjacent to the principal direction β2 of the output audio signal. The coefficients AS1β1 and AS2β1 are selected so that the one antidominant signal is substantially zero when α is β1 and the coefficients AS1β3 and AS2β3 are selected so that the other antidominant signal is substantially zero when α is β3. Amplitude control is applied to the two antidominant signals to deliver a first pair of signals having substantially equal magnitudes, the pair of signals having the form $$\text{antidominant}\beta(\alpha)\cdot(1-g),$$

where g is the gain or attenuation of an amplitude control element or function, and a second pair of signals having the form $$\text{antidominant}\beta(\alpha)\cdot g.$$

The second pair of signals are additively or subtractively combined with the passive matrix component for the principal output direction β2 to provide the output audio signal.

For the case of two or more input signals, the present invention also contemplates an alternative method of deriving one of a plurality of output audio signals from two or more input audio signals (S1(α), . . . . Sn(α)), the output audio signal associated with a principal direction β2, the input audio signals encoded with an audio source signal having a direction α. Two antidominant audio signals of the following form are generated:

$$anti\beta 1(\alpha)=\sum_{n=1}^{N} ASn\beta 1\cdot Sn(\alpha)$$

and $$anti\beta 3(\alpha)=\sum_{n=1}^{N} ASn\beta 3\cdot Sn(\alpha)$$

wherein N is the number of input audio signals, β1 is the angle of one of the two principal directions adjacent to the principal direction β2 of the output audio signal, β3 is the angle of the other of the two principal directions adjacent to the principal direction β2 of the output audio signal. The coefficients ASnβ1 and ASnβ3 are selected so that the antidominant signals have one relative polarity when a lies between β1 and β3 and the other relative polarity for all other values of α. Amplitude control is applied to the two antidominant signals to deliver a first pair of signals having substantially equal magnitudes, the pair of signals having the form $$\text{antidominant}\beta(\alpha)\cdot(1-g),$$

where g is the gain or attenuation of an amplitude control element or function, and a second pair of signals having the form $$\text{antidominant}\beta(\alpha)\cdot g.$$

The second pair of signals are additively or subtractively combined with the passive matrix component for the principal output direction β2 to provide the output audio signal.

The invention also contemplates apparatus that implements the methods and various embodiments disclosed herein.

Although aspects of the invention are described herein in the context of a circular planar environment in which the reference point is at the center of the circle and the plane of the circle is horizontal, it will be appreciated that the invention is applicable to other environments such as one in which angles are with reference to a sphere provided that directions have a hierarchy so that adjacent directions are defined.

Although the invention is described in terms of decoding input signals in which their relative amplitude and polarity represents directional encoding, it should be understood that decoders according to the invention are also useful for generating pleasing directional effects from material originally recorded for discrete two-channel or multi-channel reproduction.

Those of ordinary skill in the art will recognize the general equivalence of hardware and software implementations and of analog and digital implementations. Thus, the present invention may be implemented using analog hardware, digital hardware, hybrid analog/digital hardware and/or digital signal processing. Hardware elements may be performed as functions in software and/or firmware.

BRIEF DESCRIPTION OF THE DRAWINGS

FIG. 2 is an idealized graph, plotting two antidominant signals (anti1(α) and anti3(α)) versus α, the intended directional angle of the source signal encoded into the input signals received by a decoder according to the invention.

FIG. 3 is an idealized graph, plotting, versus α, the gains hβ1(α) and hβ3(α) of the pair of controlled gain or attenuation functions or elements used in generating a principal direction output signal.

FIG. 4 is an idealized graph, plotting the controlled gain or attenuation outputs magβ1(α) and magβ3(α) (i.e., the magnitude controlled antidominant signals urged toward equality) versus α.

FIG. 5 is an idealized graph, plotting the output$\beta$2($\alpha$) versus the direction angle $\alpha$.

FIGS. 7–9 are idealized graphs for the case when a first (incorrect) set of coefficients are chosen for the antidominant signals.

FIG. 7 is an idealized graph, plotting, versus the direction angle $\alpha$, a pair of antidominant signals, antiLB($\alpha$) and antiC($\alpha$), derived from three input total signals.

FIG. 8 is an idealized graph, plotting the controlled gain or attenuation outputs L1($\alpha$) and L2($\alpha$) versus the direction angle $\alpha$.

FIG. 9 is an idealized graph, plotting the output Lout($\alpha$) versus the direction angle $\alpha$.

FIGS. 10–12 are idealized graphs for the case when a second (correct) set of coefficients are chosen for the antidominant signals.

FIG. 10 is an idealized graph, plotting, versus the direction angle $\alpha$, a pair of antidominant signals, antiLB($\alpha$) and antiC($\alpha$), derived from three input total signals.

FIG. 11 is an idealized graph, plotting the controlled gain or attenuation outputs L1($\alpha$) and L2($\alpha$) versus the direction angle $\alpha$.

FIG. 12 is an idealized graph, plotting the output Lout($\alpha$) versus the direction angle $\alpha$.

FIGS. 24 and 25 illustrate an additional aspect of the invention related to variably scaling the amplitude of an output signal as a function of the encoded source signal angle, in order to obtain, for example, constant power among a plurality of output signals.

FIG. 24 is an idealized graph, plotting the output$\beta$2($\alpha$) and the output$\beta$3($\alpha$) versus the direction angle $\alpha$ without the constant power aspect of the present invention employed.

FIG. 25 is an idealized graph, plotting the output$\beta$2($\alpha$) and the output$\beta$3($\alpha$) versus the direction angle $\alpha$ with the constant power aspect of the present invention employed.

FIGS. 26–29 are useful in understanding one of the scaling aspects of the present invention.

FIG. 26 is an idealized graph, plotting the antidominant signals anti1($\alpha$) and anti3($\alpha$) versus $\alpha$.

FIG. 27 is an idealized graph, plotting the controlled magnitudes mag13($\alpha$) and mag31($\alpha$) versus the angle of the encoded source signal $\alpha$.

FIG. 28 is an idealized plot of mag31($\alpha$)–mag13($\alpha$) versus encoded source signal angle $\alpha$ useful in understanding the effect of the scaling factor on the position of the signal peak.

FIG. 29 is an idealized plot of the decoder outputs in dB versus encoded source signal angle $\alpha$ showing the effect of scaling factors on modified outputs $\beta$1 and $\beta$2 versus unmodified outputs $\beta$4 and $\beta$5.

FIG. 30 is an idealized graph, plotting the magnitude of three input signals versus the angle of the encoded source signal $\alpha$.

FIG. 31 is an idealized graph the absolute values of two antidominant signals for the left back output, antiLB1($\alpha$) and antiLB2($\alpha$), plotted versus the angle of the encoded source signal $\alpha$.

FIG. 32 is an idealized graph of the modified antidominant signals controlled for equal magnitude for the left back output, LB1($\alpha$) and LB2($\alpha$), plotted versus the angle of the encoded source signal.

FIG. 33 is an idealized graph of the left back output LBout(α) plotted versus the angle of the encoded source signal α.

FIG. 34 is an idealized graph, plotting the two antidominant signals used in deriving the left output, antiL1(α) and antiL2(α), versus the angle of the encoded source signal α.

FIG. 35 is an idealized graph, plotting the modified antidominant signals controlled for equal magnitude for the left output, L1 (α) and L2(α), versus the angle of the encoded source signal α.

FIG. 36 is an idealized graph of the left output Lout(α) plotted versus the angle of the encoded source signal α.

FIG. 37 is an idealized graph, plotting the modified antidominant signals controlled for equal magnitude for the back output, B1(α) and B2(α), versus the angle of the encoded source signal α.

FIG. 38 is an idealized graph of the back output Bout(α) plotted versus the angle of the encoded source signal α.

FIG. 39 is an idealized graph, plotting the modified antidominant signals controlled for equal magnitude for the center front output, C1(α) and C2(α), versus the angle of the encoded source signal α.

FIG. 40 is an idealized graph of the center front output Cout(α) plotted versus the angle of the encoded source signal α.

FIG. 41 is an idealized graph, plotting, after conversion to dB, four outputs versus the angle of the encoded source signal α.

DETAILED DESCRIPTION OF THE PREFERRED EMBODIMENTS

FIGS. 13 through 18 and their related descriptions are based on FIGS. 1 through 6 and their related descriptions in said Fosgate patent applications. The following descriptions of FIGS. 13 through 18 provide further details of the four-output, two-input decoder described in said Fosgate applications. Certain aspects of those decoders are relevant to the present invention and form a part of the disclosure of the present invention.

Figure 13:
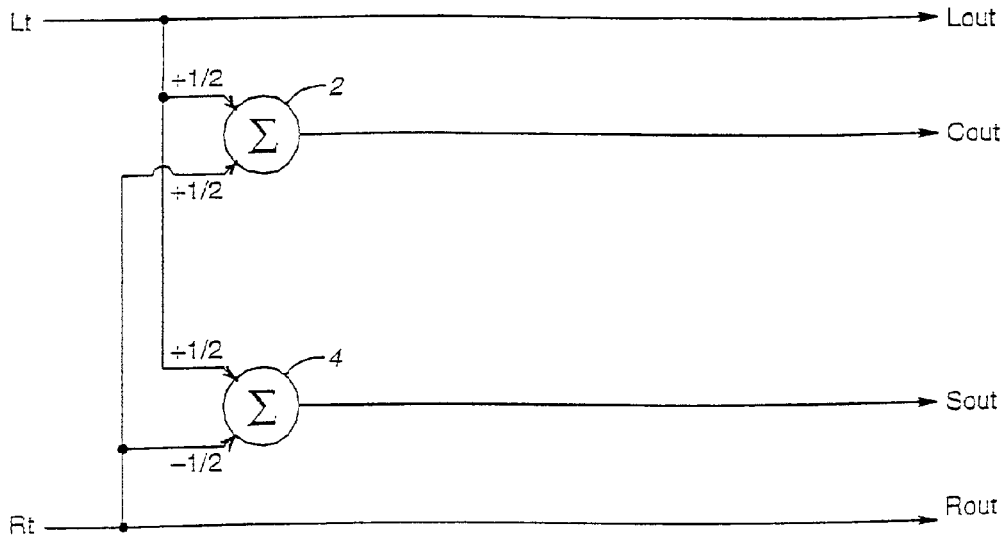
FIG. 13 PRIOR ART
FIG. 13 is a functional and schematic diagram of a prior art passive decoding matrix useful in understanding the present invention.

A passive decoding matrix is shown functionally and schematically in FIG. 13. The following equations relate the outputs to the inputs, Lt and Rt ("left total" and "right total"):

$$\text{Lout}=\text{Lt} \quad \text{(Eqn. 26)}$$

$$\text{Rout}=\text{Rt} \quad \text{(Eqn. 27)}$$

$$Cout=\tfrac{1}{2}\cdot(Lt+Rt) \quad \text{(Eqn. 28)}$$

$$Sout=\tfrac{1}{2}\cdot(Lt-Rt) \quad \text{(Eqn. 29)}$$

The center output is the sum of the inputs, and the surround output is the difference between the inputs. Both have, in addition, a scaling; this scaling is arbitrary, and is chosen to be ½ for the purpose of ease in explanation. Other scaling values are possible. The Cout output is obtained by applying Lt and Rt with a scale factor of +½ to a linear combiner 2. The Sout output is obtained by applying Lt and Rt with scale factors of +½ and −½, respectively, to a linear combiner 4.

The passive matrix of FIG. 13 thus produces two pairs of audio signals; the first pair is Lout and Rout; the second pair is Cout and Sout. In this example, the cardinal output directions of the passive matrix are designated "left," "center," "right," and "surround." Adjacent cardinal output directions lie on mutually axes ninety degrees to each other, such that, for these direction labels, left is adjacent to center and surround; surround is adjacent to left and right, etc.

A passive matrix decoder derives n audio signals from m audio signals, where n is greater than m, in accordance with an invariable relationship (for example, in FIG. 13, Cout is always ½·(Rout+Lout)). In contrast, an active matrix decoder derives n audio signals in accordance with a variable relationship. One way to configure an active matrix decoder is to combine signal-dependent signal components with the output signals of a passive matrix. For example, as shown functionally and schematically in FIG. 14, four VCAs (voltage-controlled amplifiers) 6, 8, 10 and 12, delivering variably scaled versions of the passive matrix outputs, are summed with the unaltered passive matrix outputs (namely, the two inputs themselves along with the two outputs of combiners 2 and 4) in linear combiners 14, 16, 18, and 20. Because the VCAs have their inputs derived from the left, right, center and surround outputs of the passive matrix, respectively, their gains may be designated gl, gr, gc, and gs (all positive). The VCA output signals constitute cancellation signals and are combined with passively derived outputs having crosstalk from the directions from which the cancellation signals are derived in order to enhance the matrix decoder's directional performance by suppressing crosstalk.

Figure 14:
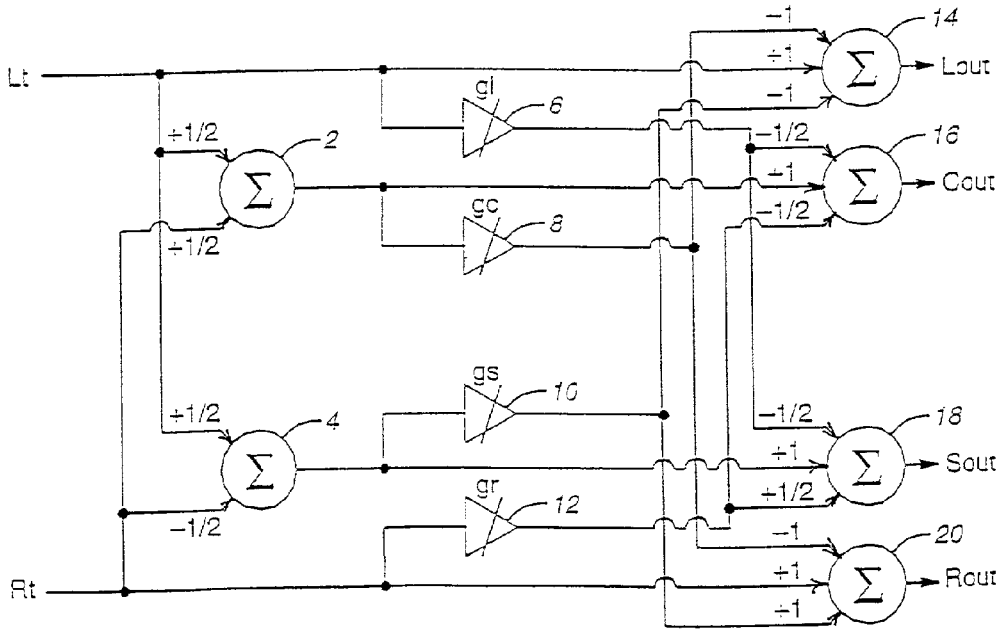
FIG. 14 PRIOR ART
FIG. 14 is a functional and schematic diagram of a prior art active matrix decoder useful in understanding the present invention in which variably scaled versions of a passive matrix outputs are summed with the unaltered passive matrix outputs in linear combiners.

Note that, in the arrangement of FIG. 14, the paths of the passive matrix are still present. Each output is the combination of the respective passive matrix output plus the output of two VCAs. The VCA outputs are selected and scaled to provide the desired crosstalk cancellation for the respective passive matrix output, taking into consideration that crosstalk components occur in outputs representing adjacent cardinal output directions. For example, a center signal has crosstalk in the passively decoded left and right signals and a surround signal has crosstalk in the passively decoded left and right signals. Accordingly, the left signal output should be combined with cancellation signal components derived from the passively decoded center and surround signals, and similarly for the other four outputs. The manner in which the signals are scaled, polarized, and combined in FIG. 14 provides the desired crosstalk suppression. By varying the respective VCA gain in the range of zero to one (for the scaling example of FIG. 14), undesired crosstalk components in the passively decoded outputs may be suppressed.

The arrangement of FIG. 14 has the following equations:

$$Lout=Lt-gc\cdot\tfrac{1}{2}\cdot(Lt+Rt)-gs\cdot\tfrac{1}{2}\cdot(Lt-Rt) \quad \text{(Eqn. 30)}$$

$$Rout=Rt-gc\cdot\tfrac{1}{2}\cdot(Lt+Rt)+gs\cdot\tfrac{1}{2}\cdot(Lt-Rt) \quad \text{(Eqn. 31)}$$

$$Cout=\tfrac{1}{2}\cdot(Lt+Rt)-gl\cdot\tfrac{1}{2}\cdot Lt-gr\cdot\tfrac{1}{2}\cdot Rt \quad \text{(Eqn. 32)}$$

$$Sout=\tfrac{1}{2}\cdot(Lt-Rt)-gl\tfrac{1}{2}\cdot Lt+gr\cdot\tfrac{1}{2}\cdot Rt \quad \text{(Eqn. 33)}$$

If all the VCAs had gains of zero, the arrangement would be the same as the passive matrix. For any equal values of all VCA gains, the arrangement of FIG. 14 is the same as the passive matrix apart from a constant scaling. For example, if all VCAs had gains of 0.1:

$$Lout=Lt-0.05\cdot(Lt+Rt)-0.05\cdot(Lt-Rt)=0.9\cdot Lt$$

$$Rout=Rt-0.05\cdot(Lt+Rt)+0.05(Lt-Rt)=0.9\cdot Rt$$

$$Cout=\tfrac{1}{2}\cdot(Lt+Rt)-0.05\cdot Lt-0.05\cdot Rt=0.9\cdot\tfrac{1}{2}\cdot(Lt+Rt)$$

$$Sout=\tfrac{1}{2}\cdot(Lt-Rt)-0.05\cdot Lt+0.05\cdot Rt=0.9\cdot\tfrac{1}{2}\cdot(Lt-Rt)$$

The result is the passive matrix scaled by a factor 0.9. Thus, it will be apparent that the precise value of the quiescent VCA gain, described below, is not critical.

Consider an example. For the cardinal output directions (left, right, center and surround) only, the respective inputs are Lt only, Rt only, Lt=Rt (the same polarity), and Lt=−Rt (opposite polarity), and the corresponding desired outputs are Lout only, Rout only, Cout only and Sout only. In each case, ideally, one output only should deliver one signal, and the remaining ones should deliver nothing.

By inspection, it is apparent that if the VCAs can be controlled so that the one corresponding to the desired cardinal output direction has a gain of 1 and the remaining ones are much less than 1, then at all outputs except the desired one, the VCA signals will cancel the unwanted outputs. As explained above, in the FIG. 14 configuration, the VCA outputs act to cancel crosstalk components in the adjacent cardinal output directions (into which the passive matrix has crosstalk).

Thus, for example, if both inputs are fed with equal in-phase signals, so Rt=Lt=(say) 1, and if as a result gc=1 and gl, gr and gs are all zero or near zero, one gets:

$$Lout=1-1\cdot\tfrac{1}{2}\cdot(1+1)-0\cdot\tfrac{1}{2}\cdot(1-1)=0$$

$$Rout=1-1\cdot\tfrac{1}{2}\cdot(1+1)+0\cdot\tfrac{1}{2}\cdot(1-1)=0$$

$$Cout=\tfrac{1}{2}\cdot(1+1)-0\cdot\tfrac{1}{2}\cdot 1-0\cdot\tfrac{1}{2}\cdot 1=1$$

$$Sout=\tfrac{1}{2}\cdot(1-1)-0\cdot\tfrac{1}{2}\cdot 1+0\cdot\tfrac{1}{2}\cdot 1=0$$

The only output is from the desired Cout. A similar calculation will show that the same applies to the case of a signal only from one of the other three cardinal output directions.

Equations 30, 31, 32 and 33 can be written equivalently as follows:

$$Lout=\tfrac{1}{2}\cdot(Lt+Rt)\cdot(1-gc)+\tfrac{1}{2}\cdot(Lt-Rt)\cdot(1-gs) \quad \text{(Eqn. 34)}$$

$$Cout=\tfrac{1}{2}\cdot Lt\cdot(1-gl)+\tfrac{1}{2}\cdot Rt\cdot(1-gr) \quad \text{(Eqn. 35)}$$

$$Rout=\tfrac{1}{2}\cdot(Lt+Rt)\cdot(1-gc)-\tfrac{1}{2}\cdot(Lt-Rt)\cdot(1-gs) \quad \text{(Eqn. 36)}$$

$$Sout=\tfrac{1}{2}\cdot Lt\cdot(1-gl)-\tfrac{1}{2}\cdot Rt\cdot(1-gr) \quad \text{(Eqn. 37)}$$

In this arrangement, each output is the combination of two signals. Lout and Rout both involve the sum and difference of the input signals and the gains of the sum and difference VCAs (the VCAs whose inputs are derived from the center and surround directions, the pair of directions at ninety degrees to the left and right directions). Cout and Sout both involve the actual input signals and the gains of the left and right VCAs (the VCAs whose respective inputs are derived from the left and right directions, the pair of directions at ninety degrees to the center and surround directions).

Consider a source signal direction not corresponding to a cardinal output direction, where Rt is fed with the same signal as Lt, with the same polarity but attenuated. This condition represents a signal placed somewhere between the left and center cardinal output directions, and should therefore deliver outputs from Lout and Cout, with little or nothing from Rout and Sout.

For Rout and Sout, this zero output can be achieved if the two terms are equal in magnitude but opposite in polarity.

For Rout, the relationship for this cancellation is $$\text{magnitude of } [\tfrac{1}{2}\cdot(Lt+Rt)\cdot(1\cdot gc)] = \text{magnitude of } [\tfrac{1}{2}\cdot(Lt-Rt)\cdot(1-gs)] \quad \text{(Eqn. 38)}$$

For Sout, the corresponding relationship is $$\text{magnitude of } [\tfrac{1}{2}\cdot Lt\cdot(1-gl)] = \text{magnitude of } [\tfrac{1}{2}\cdot Rt\cdot(1-gr)] \quad \text{(Eqn. 39)}$$

A consideration of a source signal panned (or, simply, positioned) between any two adjacent cardinal output directions will reveal the same two relationships. In other words, when the input signals represent a source sound panned between any two adjacent outputs, these magnitude relationships will ensure that the sound emerges from the outputs corresponding to those two adjacent cardinal directions and that the other two outputs deliver nothing. In order substantially to achieve that result, the magnitudes of the two terms in each of the Equations 34–37 should be urged toward equality. This may be achieved by seeking to keep equal the relative magnitudes of two pairs of signals within the active matrix:

$$\text{magnitude of } [(Lt+Rt)\cdot(1-gc)] = \text{magnitude of } [(Lt-Rt)\cdot(1-gs)], \quad \text{(Eqn. 40)}$$

and $$\text{magnitude of } [Lt\cdot(1-gl)] = \text{magnitude of } [Rt\cdot(1-gr)]. \quad \text{(Eqn. 41)}$$

The desired relationships, shown in Equations 40 and 41 are the same as those of Equations 38 and 39 but with the scaling omitted. The polarity with which the signals are combined and their scaling may be taken care of when the respective outputs are obtained as with the combiners 14, 16, 18 and 20 of FIG. 14.

From the discussion above concerning cancellation of undesired crosstalk signal components and from the requirements for the cardinal output directions, it can be deduced that for the scaling used in this explanation, the maximum gain for a VCA should be unity. Under quiescent, undefined, or "unsteered" conditions, the VCAs should adopt a small gain, providing effectively the passive matrix. When the gain of one VCA of a pair needs to rise from its quiescent value towards unity, the other of the pair may remain at the quiescent gain or may move in the opposite direction. One convenient and practical relationship is to keep the product of the gains of the pair constant. Using analog VCAs, whose gain in dB is a linear function of their control voltage, this happens automatically if a control voltage is applied equally (but with effective opposite polarity) to the two of a pair. Another alternative is to keep the sum of the gains of the pair constant. Implementations may be digital or in software rather than by using analog components.

Thus, for example, if the quiescent gain is 1/a, a practical relationship between the two gains of the pairs might be their product such that $$gl\cdot gr=1/a^2, \text{ and}$$

$$gc\cdot gs=1/a^2.$$

A typical value for "a" might lie in the range 10 to 20.

Figure 15:
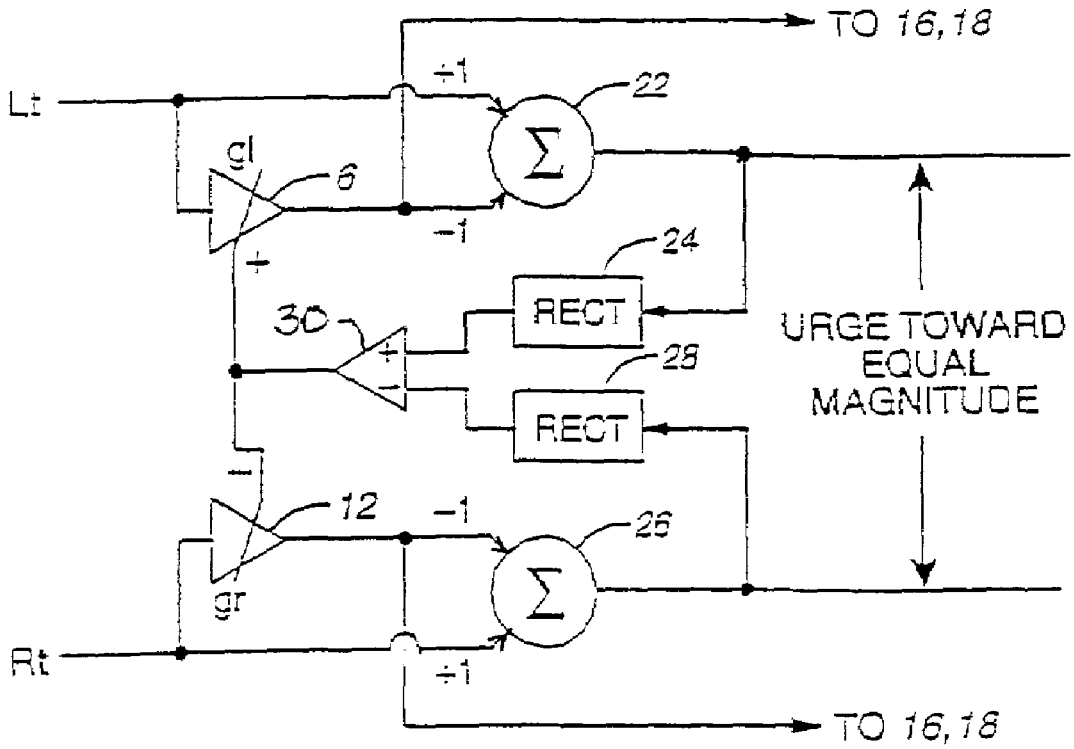
FIG. 15 is a functional and schematic diagram of a feedback-derived control system for the left and right VCAs and the sum and difference VCAs of FIG. 14 and for VCAs in the embodiments of FIGS. 16, 17 and 18.

FIG. 15 shows, functionally and schematically, a feed-back-derived control system for the left and right VCAs (6 and 12, respectively) of FIG. 14. The feed-back derived control system along with the two VCAs constitute a type of "servo" (as defined above). It receives the Lt and Rt input signals, processes them to derive intermediate Lt·(1−gl) and Rt·(1−gr) signals, compares the magnitude of the intermediate signals, and generates an error signal in response to any difference in magnitude, the error signal causing the VCAs to reduce the difference in magnitude. One way to achieve such a result is to rectify the intermediate signals to derive their magnitudes and apply the two magnitude signals to a comparator whose output controls the gains of the VCAs with such a polarity that, for example, an increase in the Lt signal increases gl and decreases gr. Circuit values (or their equivalents in digital or software implementations) are chosen so that when the comparator output is zero, the quiescent amplifier gain is less than unity (e.g., 1/a).

In the analog domain, a practical way to implement the comparison function is to convert the two magnitudes to the logarithm domain so that the comparator subtracts them rather than determining their ratio. Many analog VCAs have gains proportional to an exponent of the control signal, so that they inherently and conveniently take the antilog of the control outputs of logarithmically-based comparator. In contrast, however, if implemented digitally, it may be more convenient to divide the two magnitudes and use the resultants as direct multipliers or divisors for the VCA functions.

More specifically, as shown in FIG. 15, the Lt input is applied to the "left" VCA 6 and to one input of a linear combiner 22 where it is applied with a scaling of +1. The left VCA 6 output is applied to the combiner 22 with a scaling of −1 (thus forming a subtractor) and the output of combiner 22 is applied to a full-wave rectifier 24. The Rt input is applied to the right VCA 12 and to one input of a linear combiner 26 where it is applied with a scaling of +1. The right VCA 12 output is applied to the combiner 26 with a scaling of −1 (thus forming a subtractor) and the output of combiner 26 is applied to a full-wave rectifier 28. The rectifier 24 and 28 outputs are applied, respectively, to non-inverting and inverting inputs of an operational amplifier 30, operating as a differential amplifier. The amplifier 30 output provides a control signal in the nature of an error signal that is applied without inversion to the gain controlling input of VCA 6 and with polarity inversion to the gain controlling input of VCA 12. The error signal indicates that the two signals, whose magnitudes are to be equalized, differ in magnitude. This error signal is used to "steer" the VCAs in the correct direction to reduce the difference in magnitude of the intermediate signals. The outputs to the combiners 16 and 18 are taken from the VCA 6 and VCA 12 outputs. Thus, only a component of each intermediate signal is applied to the output combiners, namely, −Lt·gl and −Rt·gr.

For steady-state signal conditions, the difference in magnitude may be reduced to a negligible amount by providing enough loop gain. However, it is not necessary to reduce the differences in magnitude to zero or a negligible amount in order to achieve substantial crosstalk cancellation. For example, a loop gain sufficient to reduce the dB difference by a factor of 10 results, theoretically, in worst-case crosstalk better than 30 dB down. For dynamic conditions, time constants in the feedback control arrangement should be chosen to urge the magnitudes toward equality in a way that is essentially inaudible at least for most signal conditions. Details of the choice of time constants are beyond the scope of the invention.

Preferably, circuit parameters are chosen to provide about 20 dB of negative feedback and so that the VCA gains cannot rise above unity. The VCA gains may vary from some small value (for example, $1/a^2$, much less than unity) up to, but not exceeding, unity for the scaling examples described herein in connection with the arrangements of FIGS. 14, 16 and 17. Due to the negative feedback, the arrangement of FIG. 15 will act to hold the signals entering the rectifiers approximately equal.

Since the exact gains are not critical when they are small, any other relationship that forces the gain of one of the pair to a small value whenever the other rises towards unity will cause similar acceptable results.

The feedback-derived control system for the center and surround VCAs (8 and 10, respectively) of FIG. 14 is substantially identical to the arrangement of FIG. 15, as described, but receiving not Lt and Rt but their sum and difference and applying its outputs from VCA 6 and VCA 12 (constituting a component of the respective intermediate signal) to combiners 14 and 20.

Thus, a high degree of crosstalk cancellation may be achieved under a wide variety of input signal conditions using circuitry with no special requirements for precision while employing a simple control path that is integrated into the signal path. The feedback-derived control system operates to process pairs of audio signals from the passive matrix such that the magnitudes of the relative amplitudes of the intermediate audio signals in each pair of intermediate audio signals are urged toward equality.

The feedback-derived control system shown in FIG. 15 controls the gains of the two VCAs 6 and 12 inversely to urge the inputs to the rectifiers 24 and 28 towards equality. The degree to which these two terms are urged towards equality depends on the characteristics of the rectifiers, the comparator 30 following them and of the gain/control relationships of the VCAs. The greater the loop-gain, the closer the equality, but an urging towards equality will occur irrespective of the characteristics of these elements (provided of course the polarities of the signals are such as to reduce the level differences). In practice the comparator may not have infinite gain but may be realized as a subtractor with finite gain.

If the rectifiers are linear, that is, if their outputs are directly proportional to the input magnitudes, the comparator or subtractor output is a function of the signal voltage or current difference. If instead the rectifiers respond to the logarithm of their input magnitudes, that is to the level expressed in dB, a subtraction performed at the comparator input is equivalent to taking the ratio of the input levels. This is beneficial in that the result is then independent of the absolute signal level but depends only on the difference in signal expressed in dB. Considering the source signal levels expressed in dB to reflect more nearly human perception, this means that other things being equal the loop-gain is independent of loudness, and hence that the degree of urging towards equality is also independent of absolute loudness. At some very low level, of course, the logarithmic rectifiers will cease to operate accurately, and therefore there will be an input threshold below which the urging towards equality will cease. However, the result is that control can be maintained over a 70 or more dB range without the need for extraordinarily high loop-gains for high input signal levels, with resultant potential problems with stability of the loop.

Similarly, the VCAs 6 and 12 may have gains that are directly or inversely proportional to their control voltages (that is, multipliers or dividers). This would have the effect that when the gains were small, small absolute changes in control voltage would cause large changes in gain expressed in dB. For example, consider a VCA with a maximum gain of unity, as required in this feedback-derived control system configuration, and a control voltage Vc that varies from say 0 to 10 volts, so that the gain can be expressed as $A=0.1\cdot Vc$. When Vc is near its maximum, a 100 mV (millivolt) change from say 9900 to 10000 mV delivers a gain change of $20\cdot\log(10000/9900)$ or about 0.09 dB. When Vc is much smaller, a 100 mV change from say 100 to 200 mV delivers a gain change of $20\cdot\log(200/100)$ or 6 dB. As a result, the effective loop-gain, and, hence, rate of response, would vary hugely depending whether the control signal was large or small. Again, there can be problems with the stability of the loop.

This problem can be eliminated by employing VCAs whose gain in dB is proportional to the control voltage, or expressed differently, whose voltage or current gain is dependent upon the exponent or antilog of the control voltage. A small change in control voltage such as 100 mV will then give the same dB change in gain wherever the control voltage is within its range. Such devices are readily available as analog ICs, and the characteristic, or an approximation to it, is easily achieved in digital implementations.

The preferred embodiment therefore employs logarithmic rectifiers and exponentially controlled variable gain amplification, delivering more nearly uniform urging towards equality (considered in dB) over a wide range of input levels and of ratios of the two input signals.

Since in human hearing the perception of direction is not constant with frequency, it is desirable to apply some frequency weighting to the signals entering the rectifiers, so as to emphasize those frequencies that contribute most to the human sense of direction and to de-emphasize those that might lead to inappropriate steering. Hence, in practical embodiments, the rectifiers 24 and 28 in FIG. 15 are preceded by filters derived empirically, providing a response that attenuates low frequencies and very high frequencies and provides a gently rising response over the middle of the audible range. Note that these filters do not alter the frequency response of the output signals, they merely alter the control signals and VCA gains in the feedback-derived control systems.

Figure 16:
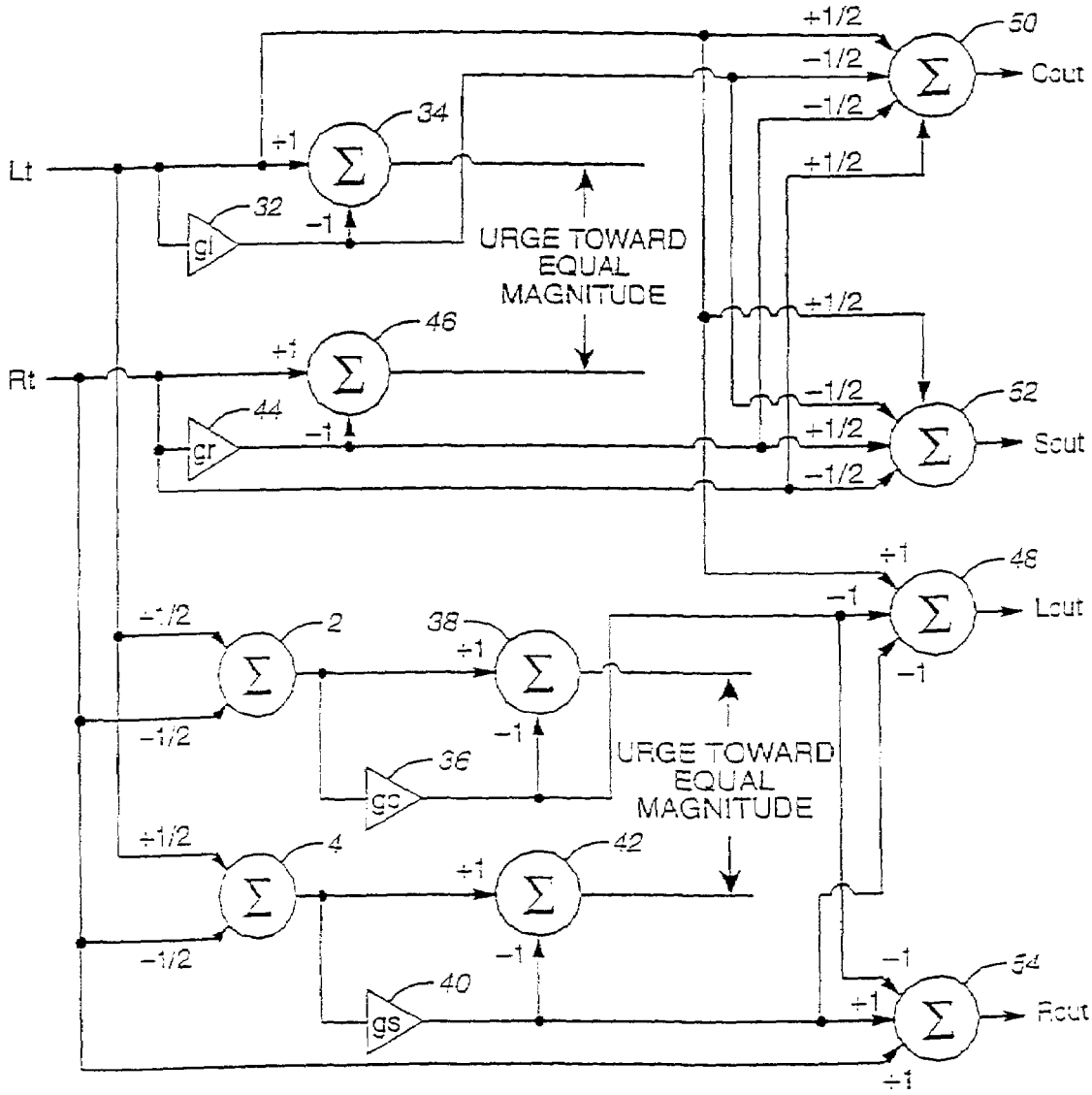
FIG. 16 is a functional and schematic diagram showing an arrangement equivalent to the combination of FIGS. 14 and 15 in which the output combiners generate the passive matrix output signal components in response to the Lt and Rt input signals instead of receiving them from the passive matrix from which the cancellation components are derived.

An arrangement equivalent to the combination of FIGS. 14 and 15 is shown functionally and schematically in FIG. 16. It differs from the combination of FIGS. 14 and 15 in that the output combiners generate passive matrix output signal components in response to the Lt and Rt input signals instead of receiving them from the passive matrix from which the cancellation components are derived. The arrangement provides the same results as does the combination of FIGS. 14 and 15 provided that the summing coefficients are essentially the same in the passive matrices. FIG. 16 incorporates the feedback arrangements described in connection with FIG. 15.

More specifically, in FIG. 16, the Lt and Rt inputs are applied first to a passive matrix that includes combiners 2 and 4 as in the FIG. 13 passive matrix configuration. The Lt input, which is also the passive matrix "left" output, is applied to the "left" VCA 32 and to one input of a linear combiner 34 with a scaling of +1. The left VCA 32 output is applied to a combiner 34 with a scaling of −1 (thus forming a subtractor). The Rt input, which is also the passive matrix "right" output, is applied to the "right" VCA 44 and to one input of a linear combiner 46 with a scaling of +1. The right VCA 44 output is applied to the combiner 46 with a scaling of −1 (thus forming a subtractor). The outputs of combiners 34 and 46 are the signals Lt·(1−gl) and Rt·(1−gr), respectively, and it is desired to keep the magnitude of those signals equal or to urge them toward equality. To achieve that result, those signals preferably are applied to a feedback circuit such as shown in FIG. 15 and described in connection therewith. The feedback circuit then controls the gain of VCAs 32 and 44.

In addition, still referring to FIG. 16, the "center" output of the passive matrix from combiner 2 is applied to the "center" VCA 36 and to one input of a linear combiner 38 with a scaling of +1. The center VCA 36 output is applied to the combiner 38 with a scaling of −1 (thus forming a subtractor). The "surround" output of the passive matrix from combiner 4 is applied to the "surround" VCA 40 and to one input of a linear combiner 42 with a scaling of +1. The surround VCA 40 output is applied to the combiner 42 with a scaling of −1 (thus forming a subtractor). The outputs of combiners 38 and 42 are the signals ½·(Lt+Rt)·(1−gc) and ½·(Lt−Rt)·(1−gs), respectively, and it is desired to keep the magnitude of those signals equal or to urge them toward equality. To achieve that result, those signals preferably are applied to a feedback circuit such as shown in FIG. 15 and described in connection therewith. The feedback circuit then controls the gain of VCAs 38 and 42.

The output signals Lout, Cout, Sout, and Rout are produced by combiners 48, 50, 52 and 54. Each combiner receives the output of two VCAs (the VCA outputs constituting a component of the intermediate signals whose magnitudes are sought to be kept equal) to provide cancellation signal components and either or both input signals so as to provide passive matrix signal components. More specifically, the input signal Lt is applied with a scaling of +1 to the Lout combiner 48, with a scaling of +½ to the Cout combiner 50, and with a scaling of +½ to the Sout combiner 52. The input signal Rt is applied with a scaling of +1 to the Rout combiner 54, with a scaling of +½ to Cout combiner 50, and with a scaling of −½ to Sout combiner 52. The left VCA 32 output is applied with a scaling of −½ to Cout combiner 50 and also with a scaling of −½ to Sout combiner 52. The right VCA 44 output is applied with a scaling of −½ to Cout combiner 50 and with a scaling of +½ to Sout combiner 52. The center VCA 36 output is applied with a scaling of −1 to Lout combiner 48 and with a scaling of −1 to Rout combiner 54. The surround VCA 40 output is applied with a scaling of −1 to Lout VCA 48 and with a scaling of +1 to Rout VCA 54.

It will be noted that in various ones of the figures, for example in FIGS. 14 and 16, it may initially appear that cancellation signals do not oppose the passive matrix signals (for example, some of the cancellation signals are applied to combiners with the same polarity as the passive matrix signal is applied). However, in operation, when a cancellation signal becomes significant it will have a polarity that does oppose the passive matrix signal.

Figure 17:
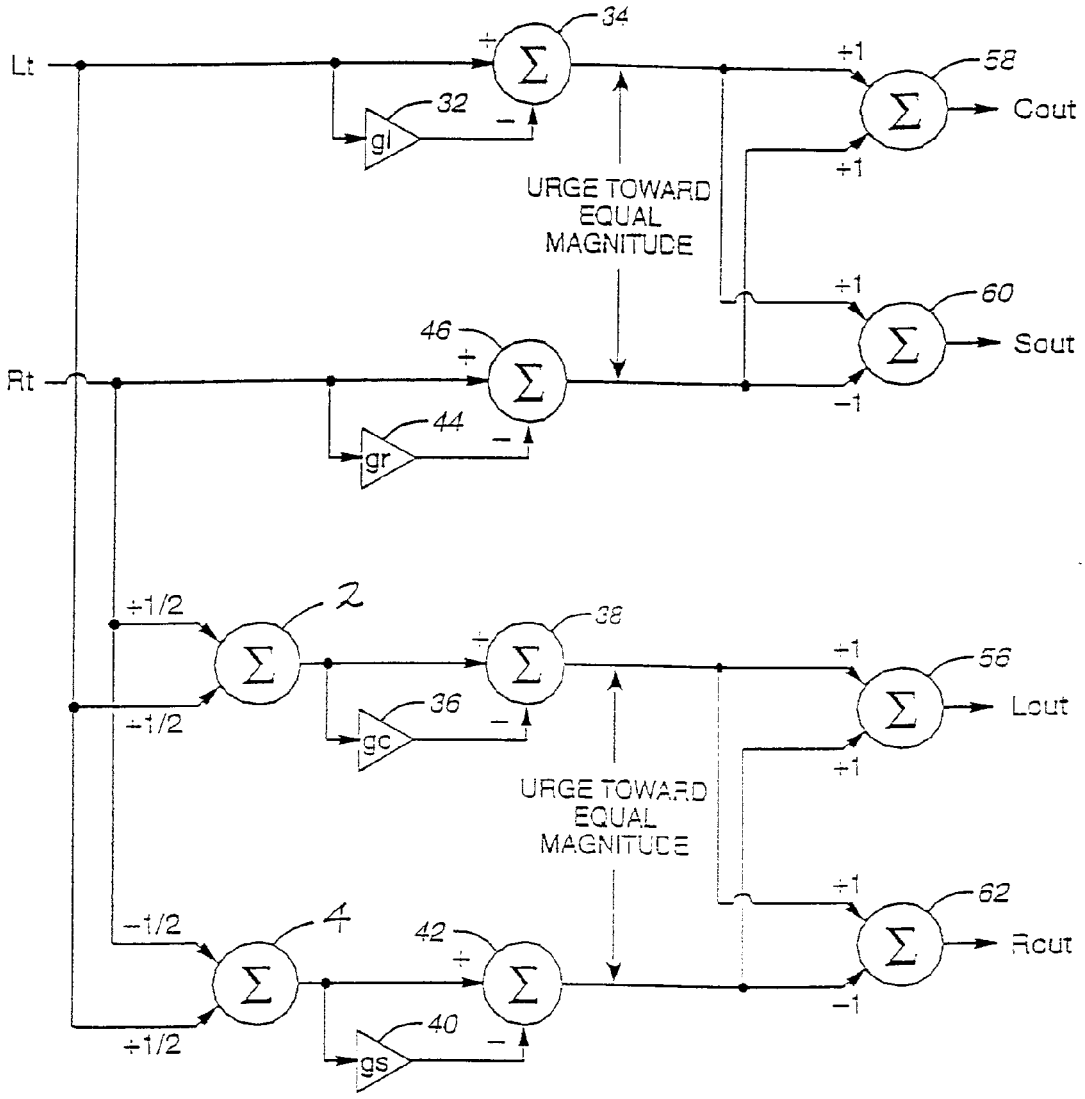
FIG. 17 is a functional and schematic diagram showing an arrangement equivalent to the combination of FIGS. 14 and 15 and FIG. 16. In the FIG. 17 configuration, the signals that are to be maintained equal are the signals applied to the output deriving combiners and to the feedback circuits for control of the VCAs; the outputs of the feedback circuits include the passive matrix components.

Another arrangement equivalent to the combination of FIGS. 14 and 15 and to FIG. 16 is shown functionally and schematically in FIG. 17. In the FIG. 17 configuration, the signals that are to be maintained equal are the signals applied to the output deriving combiners and to the feedback circuits for control of the VCAs. These signals include passive matrix output signal components. In contrast, in the arrangement of FIG. 16 the signals applied to the output combiners from the feedback circuits are the VCA output signals and exclude the passive matrix components. Thus, in FIG. 16 (and in the combination of FIGS. 14 and 15), passive matrix components must be explicitly combined with the outputs of the feedback circuits, whereas in FIG. 17 the outputs of the feedback circuits include the passive matrix components and are sufficient in themselves. It will also be noted that in the FIG. 17 arrangement the intermediate signal outputs rather than the VCA outputs (each of which constitutes only a component of the intermediate signal) are applied to the output combiners. Nevertheless, the FIG. 16 and FIG. 17 (along with the combination of FIGS. 14 and 15) configurations are equivalent, and, if the summing coefficients are accurate, the outputs from FIG. 17 are the same as those from FIG. 16 (and the combination of FIGS. 14 and 15).

In FIG. 17, the four intermediate signals, [½·(Lt+Rt)·(1−gc)], [½·(Lt−Rt)·(1−gs), [½·Lt·(1−gl)], and [½·Rt·(1−gr)], in the Equations 34, 35, 36 and 37 are obtained by processing the passive matrix outputs and are then added or subtracted to derive the desired outputs. The signals also are fed to the rectifiers and comparators of two feedback circuits, as described above in connection with FIG. 15, the feedback circuits desirably acting to hold the magnitudes of the pairs of signals equal. The feedback circuits of FIG. 15, as applied to the FIG. 17 configuration, have their outputs to the output combiners taken from the outputs of the combiners 22 and 26 rather than from the VCAs 6 and 12.

Still referring to FIG. 17, the connections among combiners 2 and 4, VCAs 32, 36, 40, and 44, and combiners 34, 38, 42 and 46 are the same as in the arrangement of FIG. 16. Also, in both the FIG. 16 and FIG. 17 arrangements, the outputs of the combiners 34, 38, 42 and 46 preferably are applied to two feedback control circuits (the outputs of combiners 34 and 46 to a first such circuit in order to generate control signals for VCAs 32 and 44 and the outputs of combiners 38 and 42 to a second such circuit in order to generate control signals for VCAs 36 and 40). In FIG. 17 the output of combiner 34, the Lt−(1−gl) signal, is applied with a scaling of +1 to the Cout combiner 58 and with a scaling of +1 to the Sout combiner 60. The output of combiner 46, the Rt·(1−gr) signal is applied with a scaling of +1 to the Cout combiner 58 and with a scaling of −1 to the Sout combiner 60. The output of combiner 38, the ½·(Lt+Rt)·(1−gc) signal, is applied to the Lout combiner 56 with a scaling of +1 and to the Rout combiner 62 with a scaling of +1. The output of the combiner 42, the ½·(Lt−Rt)·(1−gs) signal, is applied to the Lout combiner 56 with a +1 scaling and to the Rout combiner 62 with a −1 scaling.

Ideally, aside from practical circuit shortcomings, "keep magnitudes equal" configurations of the decoder are "perfect" in the sense that any source fed into the Lt and Rt inputs with known relative amplitudes and polarity will yield signals from the desired outputs and negligible signals from the others. "Known relative amplitudes and polarity" means that the Lt and Rt inputs represent a source signal at a cardinal output direction or at a position between adjacent cardinal output directions.

Considering the Equations 34, 35, 36 and 37 again, it will be seen that the overall gain of each variable gain circuit incorporating a VCA is a subtractive arrangement in the form (1−g). Each VCA gain can vary from a small value up to but not exceeding unity. Correspondingly, the variable-gain-circuit gain (1−g) can vary from very nearly unity down to zero. Thus, FIG. 17 can be redrawn as FIG. 18, where every VCA and associated subtractor has been replaced by a VCA alone, whose gain varies in the opposite direction to that of the VCAs in FIG. 17. Thus every variable-gain-circuit gain (1−g) (implemented, for example by a VCA having a gain "g" whose output is subtracted from a passive matrix output as in FIGS. 14/15, 16 and 17) is replaced by a corresponding variable-gain-circuit gain "h" (implemented, for example by a stand-alone VCA having a gain "h" acting on a passive matrix output). If the characteristics of gain "(1−g)" is the same as gain "h" and if the feedback circuits act to maintain equality between the magnitude of the requisite pairs of signals, the FIG. 18 configuration is equivalent to the FIG. 17 configuration and will deliver the same outputs. Indeed, all of the disclosed configurations, the configurations of FIGS. 14/15, 16, 17, and 18, are equivalent to each other.

Figure 18:
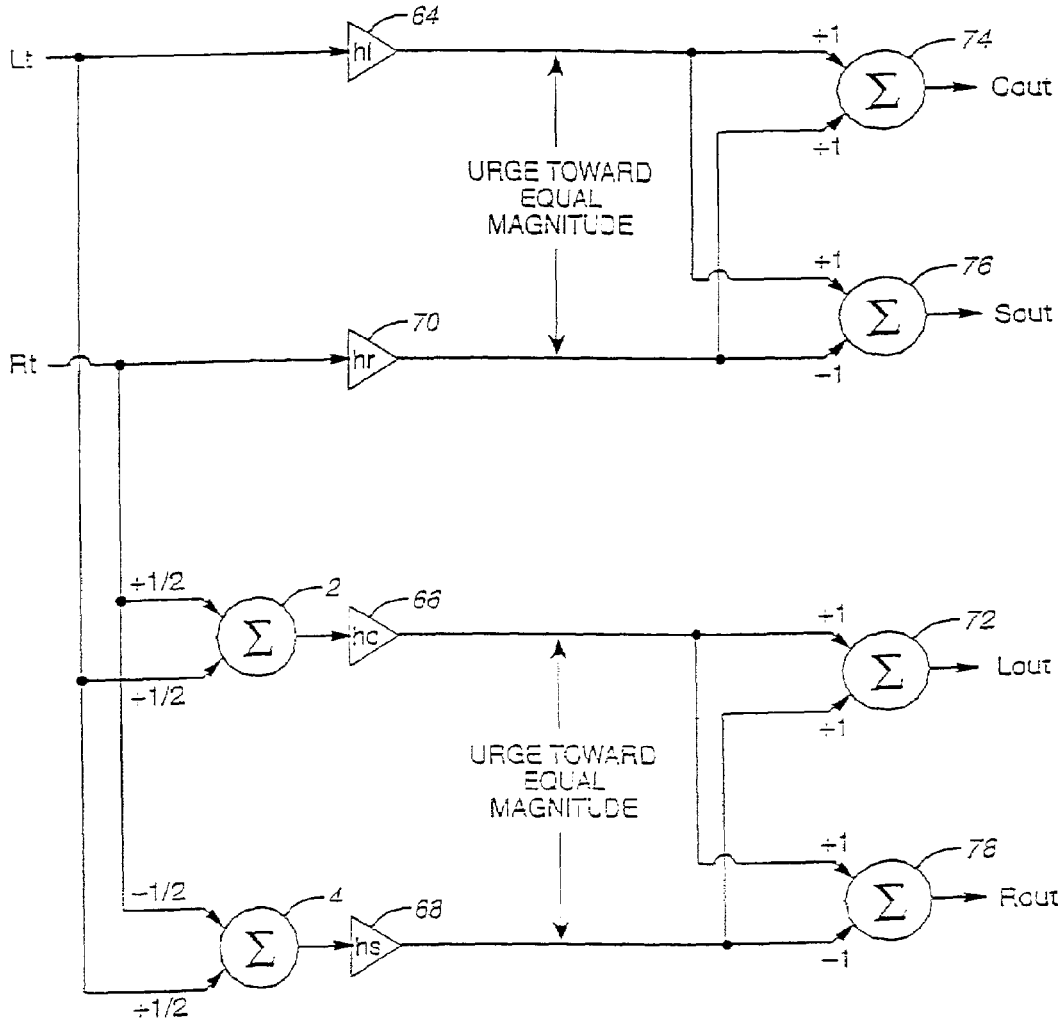
FIG. 18 is a functional and schematic diagram showing an arrangement equivalent to the arrangements of the combination of FIGS. 14 and 15, FIG. 16 and FIG. 17, in which the variable-gain-circuit gain (1−g) provided by a VCA and subtractor is replaced by a VCA whose gain varies in the opposite direction of the VCAs in the VCA and subtractor configurations. In this embodiment, the passive matrix components in the outputs are implicit. In the other embodiments, the passive matrix components in the outputs are explicit.

Although the FIG. 18 configuration is equivalent and functions exactly the same as all the prior configurations, note that the passive matrix components do not appear explicitly in the outputs but are implicit. In the quiescent or unsteered condition of the prior configurations, the VCA gains g fall to small values. In the FIG. 18 configuration, the corresponding unsteered condition occurs when all the VCA gains h rise to their maximum, unity or close to it.

Referring to FIG. 18 more specifically, the "left" output of the passive matrix, which is also the same as the input signal Lt, is applied to a "left" VCA 64 having a gain hl to produce the intermediate signal Lt·hl. The "right" output of the passive matrix, which is also the same as the input signal Rt, is applied to a "right" VCA 70 having a gain hr to produce the intermediate signal Rt·hr. The "center" output of the passive matrix from combiner 2 is applied to a "center" VCA 66 having a gain hc to produce an intermediate signal ½·(Lt+Rt)·hc. The "surround" output of the passive matrix from combiner 4 is applied to a "surround" VCA 68 having a gain hs to produce an intermediate signal ½·(Lt−Rt)·hs. As explained above, the VCA gains h operate inversely to the VCA gains g, so that the h gain characteristics are the same as the (1−g) gain characteristics.

Having described the basic four-output, two-input, ninety-degree output-direction axes decoders of said Fosgate applications, further details of decoders according to the present invention are now set forth.

Figure 19:
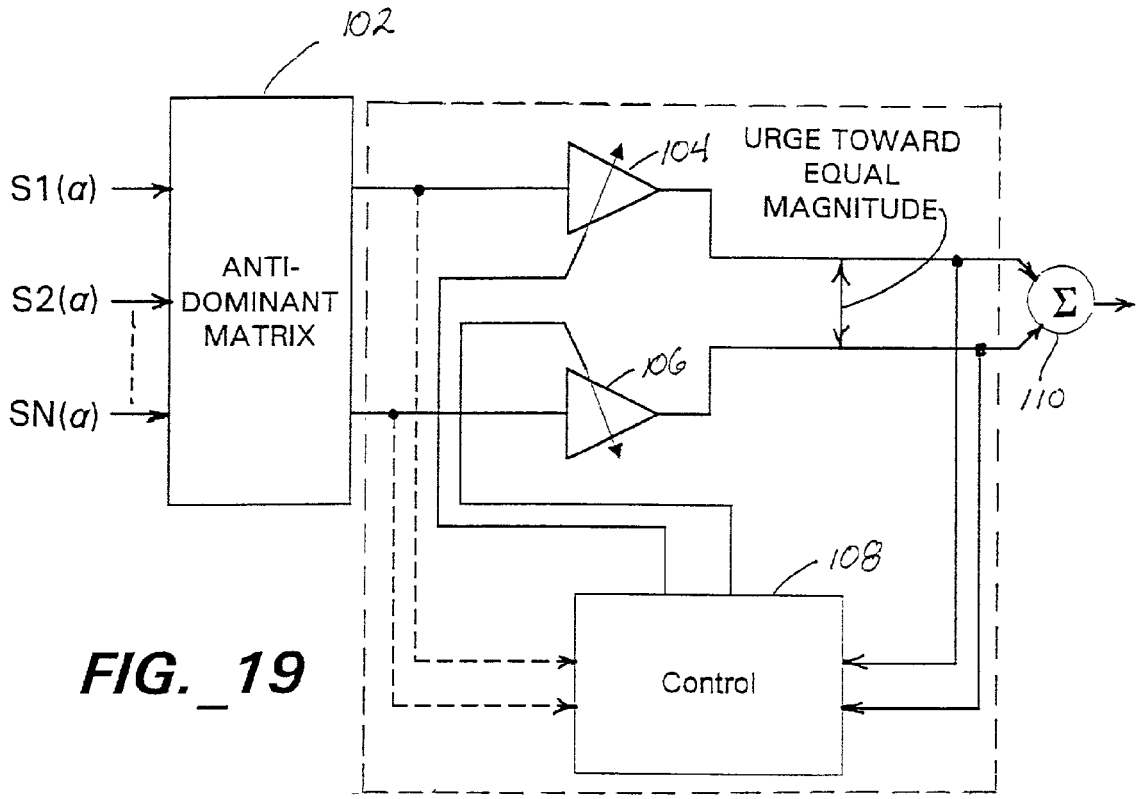
FIG. 19 is a functional and schematic diagram of a decoder according to the present invention for deriving an output signal representing a principal direction $\beta$2 from two or more input signals S1($\alpha$), S2($\alpha$), . . . SN($\alpha$) in which the input signals bear directional information in their relative magnitude and polarity for one or more audio signals.

FIG. 19 shows a block diagram of a decoder according to the present invention for deriving an output signal representing a principal direction β2 from two or more input signals S1(α), S2(α), . . . Sn(α) in which the input signals bear directional information in their relative magnitude and polarity for one or more audio signal sources. The output for direction β2 is one of a plurality of decoder outputs, each output having a principal (or cardinal) direction. The input signals are applied to a matrix 102 that derives a pair of antidominant signals for directions β1 and β3, the two principal output directions adjacent to direction β2. The pair of antidominant signals produced by matrix 102 are applied to a servo 112. Servo 112 operates on the magnitude controlled versions of the pair of antidominant signals in order to urge their magnitudes toward equality. The decoder output β2 is generated by combining, either additively or subtractively, the pair of "urged toward equality" magnitude controlled versions of the antidominant signals. As explained above, when the principal directions adjacent to the desired principal output direction are less than 180 degrees, the signals are combined in the polarity sense that places the output signal direction within the smaller of the two arcs between the adjacent directions.

Servo 112 may operate either in a closed-loop or feedback-type manner or in an open-loop feedforward-type manner. Thus, in servo 112 a control 108 may receive either the servo 112 output signals (shown in solid lines) as its input or the servo 112 input signals (shown in dashed lines) as its input. Servo 112 may be configured to include first and second controlled gain or attenuation functions or elements 104 and 106. For simplicity, functions or elements 104 and 106 (as well as other such controlled gain or attenuation functions or elements throughout the drawings) are shown schematically as voltage-controlled-amplifiers (VCAs). The controlled gain or attenuation functions or elements may each be a voltage-controlled-amplifier (VCA) or a digital equivalent thereof (in hardware, firmware or software). The gain of function or element 104 is controlled by one of the control 108 outputs. The gain of function 106 is controlled by the other of the control 108 outputs. The controlled gain or attenuation functions or elements 104 and 106 receive the pair of antidominant signals.

It should be understood that all of the various elements and functions (e.g., matrices, rectifiers, comparators, combiner, variable amplifiers or attenuators, etc.) of the disclosed embodiments may be implemented in hardware or software in either the analog or digital domains.

Control in analog or digital embodiments of the servo 112 may be effected by a feedback system in which the ratio of the magnitudes of the servo outputs is compared to 1 and used to generate an error signal for controlling the pair of controlled gain or attenuation functions or elements within the servo 112, so forcing the servo to deliver approximately equal magnitudes.

Alternatively, in analog or digital embodiments of servo 112, the urging toward equality may be accomplished by an open-loop feed-forward process that measures the servo input signals. In this case, the smaller input is substantially unchanged, while the larger one is attenuated by the ratio of the smaller to the larger in order to urge its magnitude toward or equal to that of the smaller.

The two "urged toward equality" versions of the antidominant signals are then combined, either additively or subtractively in a linear combiner 110. When the principal directions adjacent to the desired principal output direction are less than 180 degrees, the signals are combined in the polarity sense that places the output signal direction within the smaller of the two arcs between the adjacent directions.

Figure 3:
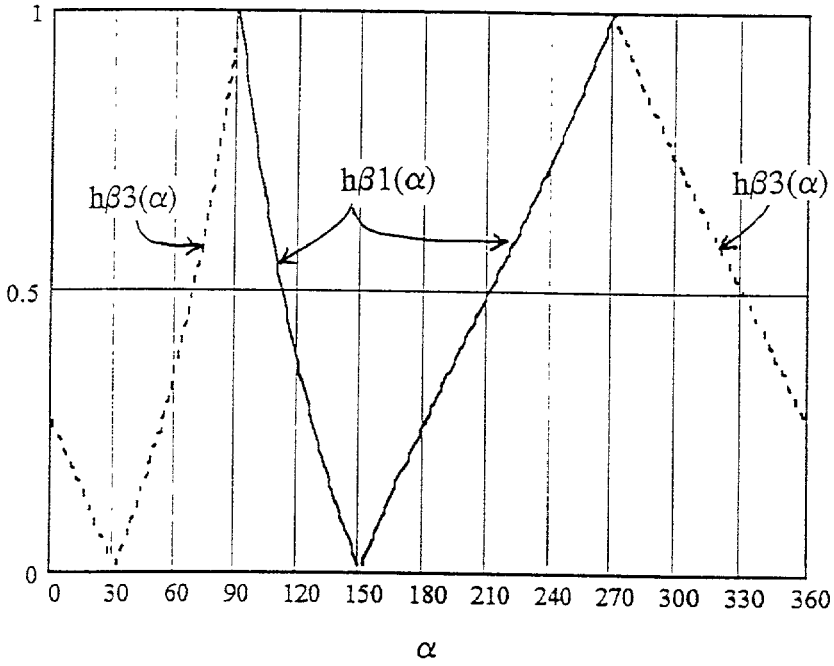
Figure 4:
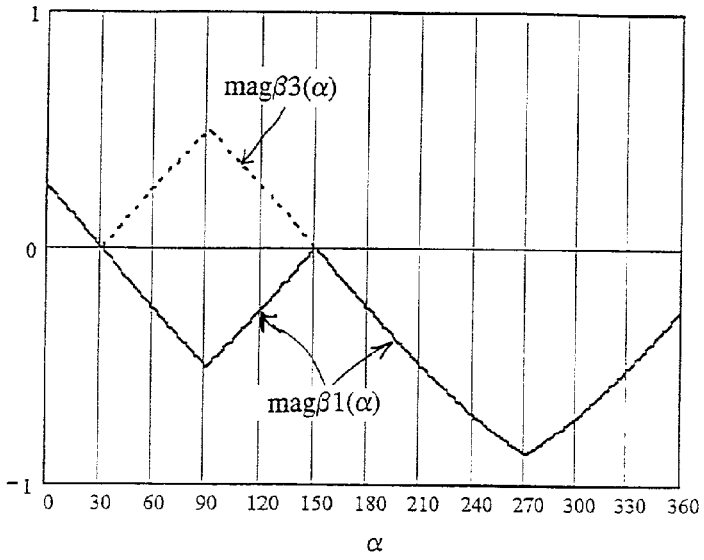
Figure 5:
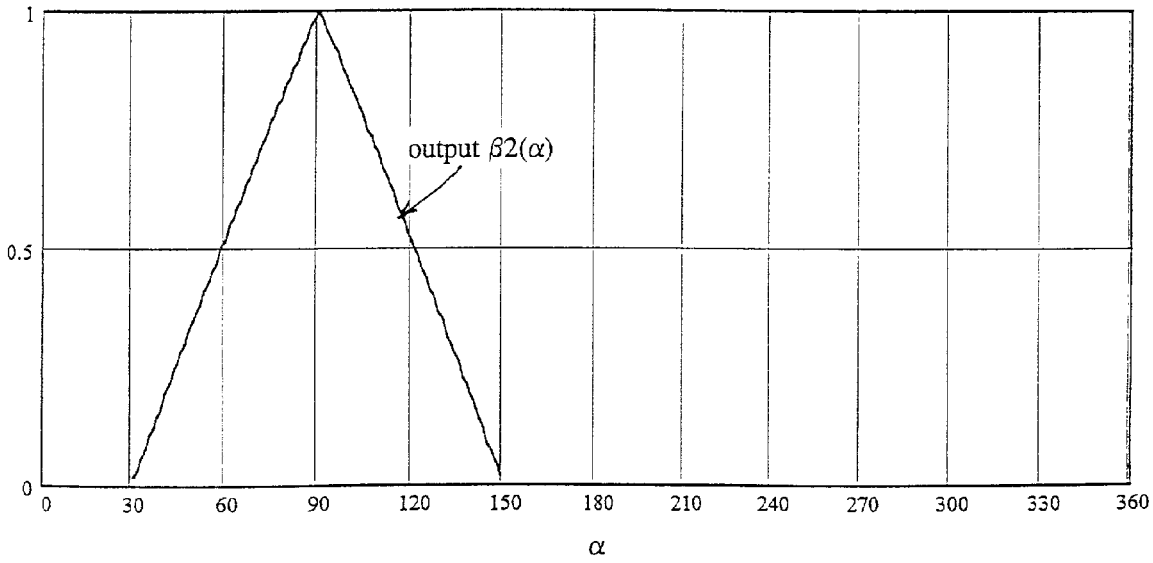

The discussion above encompassing Equations 14 through 19 and FIGS. 3–5 is relevant to the arrangement of FIG. 19.

The same reference numerals for like elements or functions are used throughout FIGS. 19–23.

Figure 6:
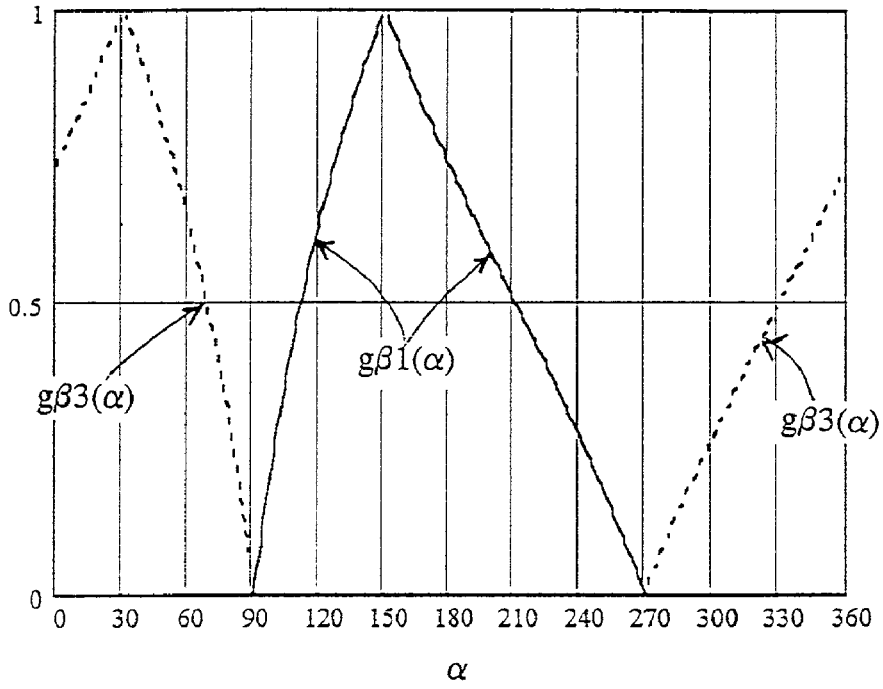
FIG. 6 is an idealized graph, plotting alternatives (g$\beta$1($\alpha$) and g$\beta$3($\alpha$)) to the gain functions plotted in FIG. 3.
Figure 20:
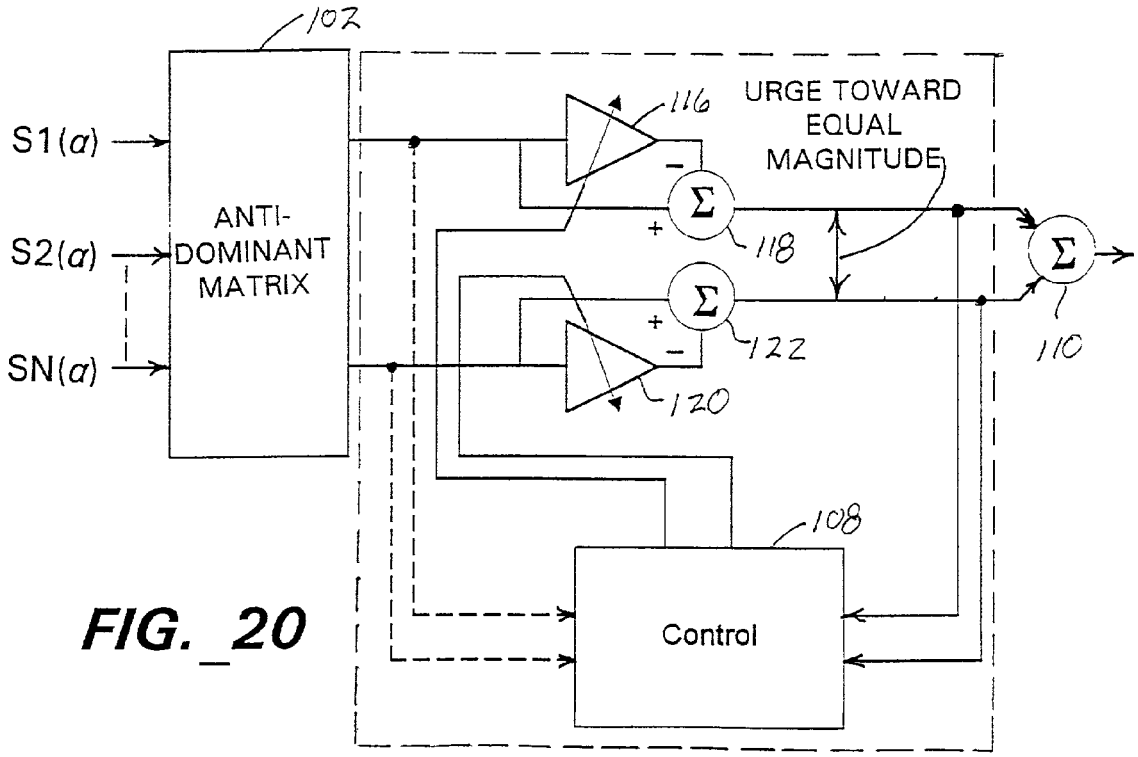
FIG. 20 is a functional and schematic diagram of a modified version of the decoder of FIG. 19 employing an alternative servo arrangement.

An alternative to the FIG. 19 servo arrangement is shown in FIG. 20. Such an alternative is mentioned above in the discussion encompassing Equations 20 and 21. That discussion and its related FIG. 6 are relevant to the arrangement of FIG. 20. The controlled gain or attenuation functions or elements 104 and 106 (each providing a gain h) of FIG. 19 are replaced by controlled gain or attenuation functions or elements 116 and 120 (each providing a gain of 1−h) each in combination with a subtractor (118 and 122) such that each of the combined function and subtractor gain remains h as in the FIG. 19 arrangement. A subtractor 118 subtracts the controlled gain or attenuation function or element 116 output from one of the antidominant signals and a subtractor 122 subtracts the function 112 output from the other antidominant signal. Compare the arrangement of FIG. 20 to FIGS. 14/15 and 16 hereof. Compare the arrangement of FIG. 19 to the arrangement of FIGS. 17 and 18 hereof.

Figure 21:
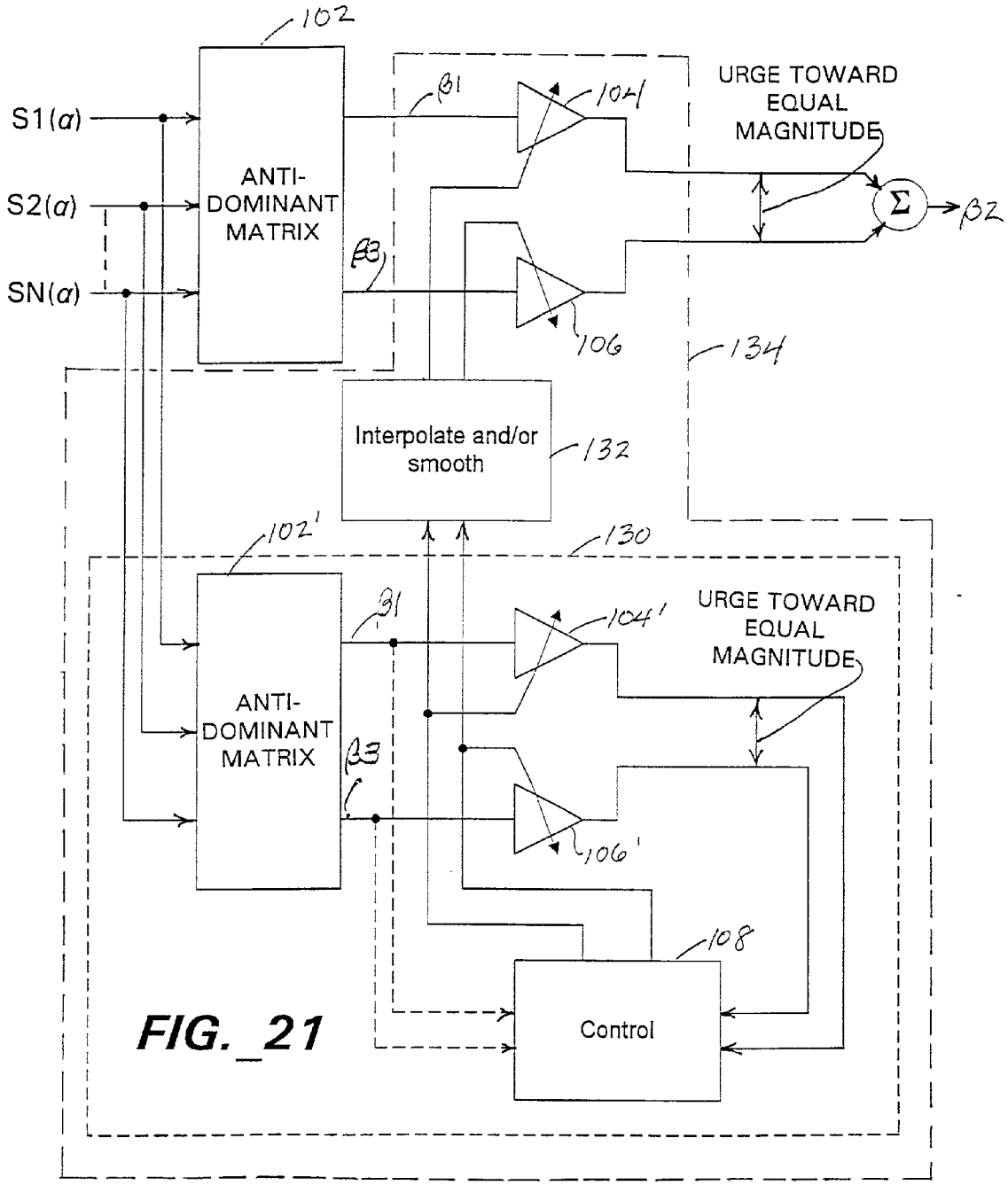
FIG. 21 is a functional and schematic diagram of a decoder according to the present invention employing a technique for accomplishing feedback control in the digital domain at a lowered sampling rate.

A technique for accomplishing feedback control in the digital domain at a lowered sampling rate is shown in FIG. 21. Although the arrangement is shown with elements or functions 104 and 106 configured without a subtractor in the manner of the FIG. 19 arrangement, it will be understood that the subtractive arrangement of FIG. 20 may be employed.

Referring to FIG. 21, the inputs are applied to a first matrix 102 and to a second matrix 102', which may have identical characteristics to matrix 102. As in the FIG. 19 arrangement, the antidominant signals produced by matrix 102 are applied to controlled gain or attenuation functions or elements 104 and 106, the outputs of which are additively or subtractively combined in a linear combiner 110 to provide the output β2. The outputs of matrix 102' are part of an arrangement that includes controlled gain or attenuation functions 104' and 106' and control 108 that are interconnected as in the arrangement of FIG. 19. However, some or all of the operations within the dashed lines 130 may be performed at a lower sampling rate than in matrix 102 and functions 104 and 106. The control signals for functions 104' and 106' are applied not only to those functions but also to an interpolator and/or smoother 132 that interpolates and/or smooths the lower bit rate control signals before using them to control the controlled gain or attenuation functions or elements 104 and 106. All of the elements within dashed line 134 constitute a servo in this embodiment. Optionally, in order to provide some degree of "look ahead" and to compensate for delays in the functions or elements within dashed lines 130, delays may be placed before the inputs to matrix 102 (but no delays in the path to matrix 102').

Figure 22:
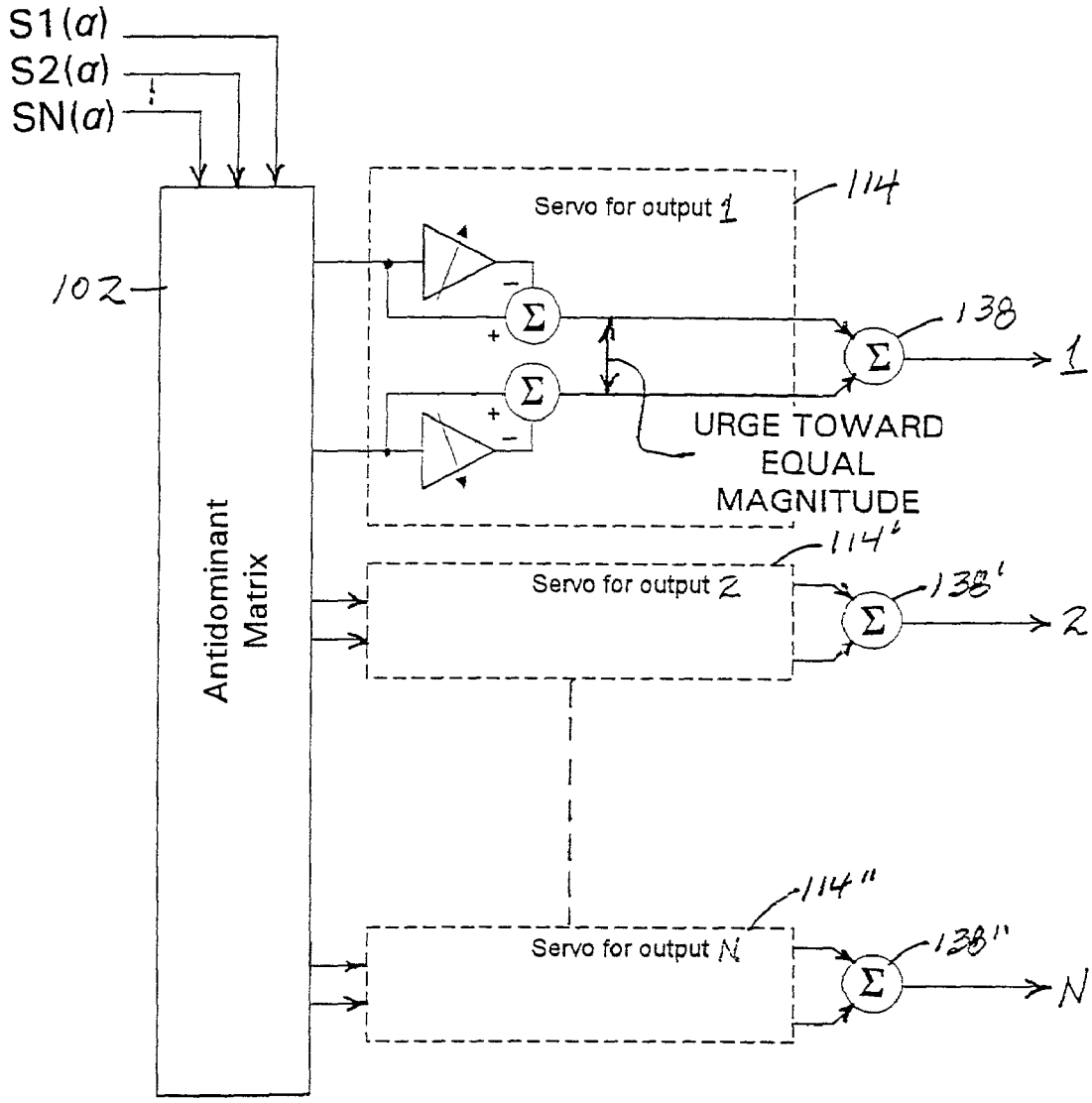
FIG. 22 is a functional and schematic diagram of a decoder according to the present invention for deriving a plurality of output signals representing principal directions 1, 2, . . . N from two or more input signals S1($\alpha$), S2($\alpha$), . . . SN($\alpha$) in which the input signals bear directional information in their relative magnitude and polarity for one or more audio signals.

FIG. 22 shows a general arrangement for producing a multiplicity of outputs. Two or more input signals (S1(α), S2(α), . . . SN(α)) in which the input signals bear directional information in their relative magnitude and polarity for one or more audio signal sources are applied to a matrix 136 that derives a pair of antidominant signals for the principal output directions adjacent to each principal output direction (output 1, output 2, . . . output N). Each pair of antidominant signals produced by matrix 136 are applied to a servo 114, 114', 114", etc. As in the manner of the FIG. 19, 20 and/or 21 arrangements, each servo operates on a pair of antidominant signals in order to deliver a pair of signals with substantially equal magnitudes. Each decoder output is then generated by combining, either additively or subtractively, the pair of "urged toward equality" versions of the antidominant signals in the manner described above. For simplicity, control for the controllable gain or attenuation functions or elements is not shown.

Figure 23:
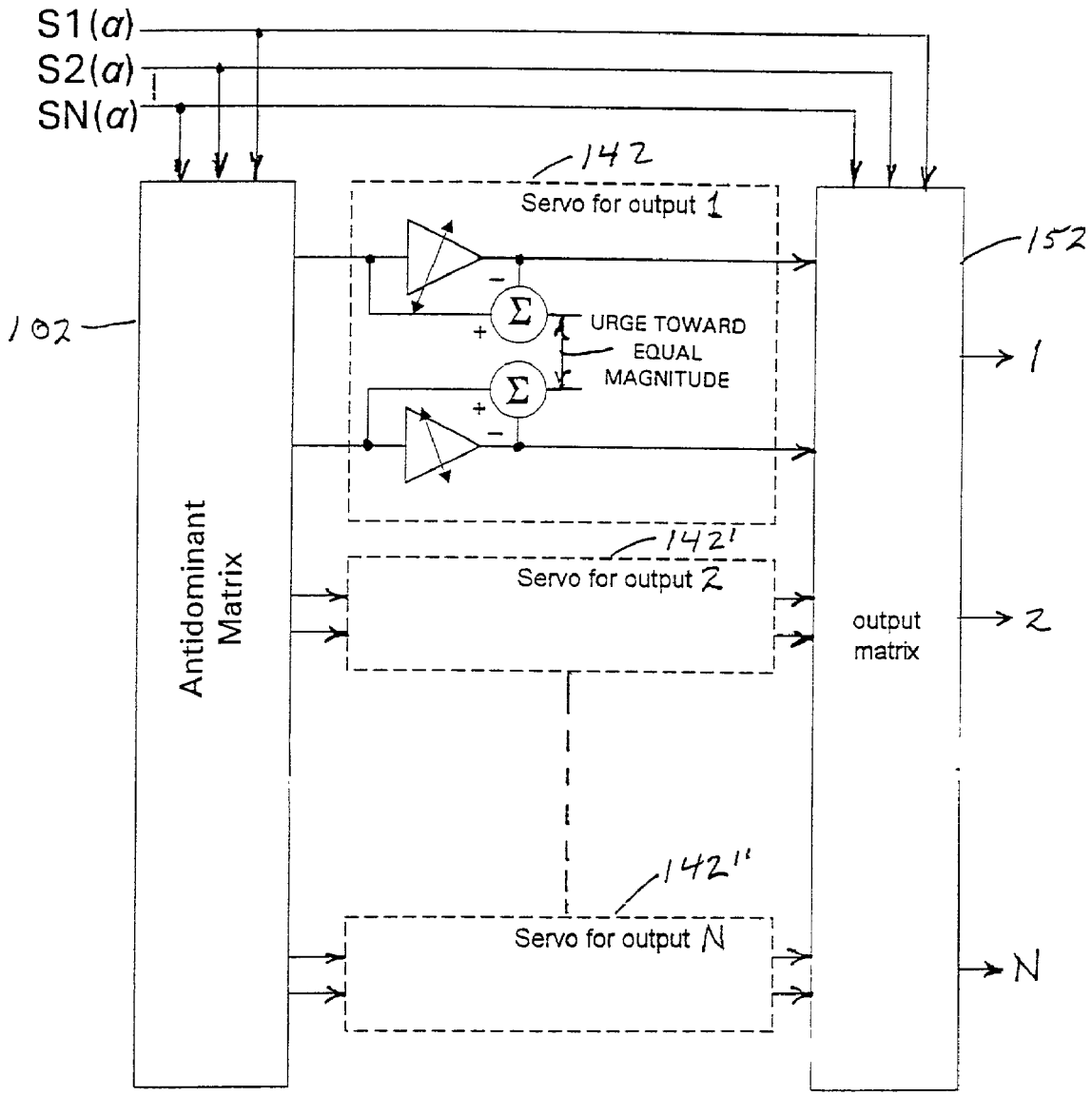
FIG. 23 is a functional and schematic diagram of a modified version of the decoder of FIG. 22 employing an alternative topology having an output matrix.

An alternative to the topology of FIG. 22 is shown in FIG. 23, wherein an output matrix 152 is provided and the outputs of the servos are taken from the outputs of the controlled gain or attenuation functions or elements (in a configuration employing the subtractive alternative of FIG. 20) instead of from the outputs of the subtractors (when FIG. 22 employs the FIG. 20 arrangement) or from the outputs of the controlled gain or attenuation functions or elements (when FIG. 22 employs the FIG. 19 arrangement). Instead of providing a unity gain path explicitly as when the FIG. 22 arrangement employs the FIG. 20 servo configuration and implicitly as when it employs the FIG. 19 servo configuration, the alternative of FIG. 23 provides a unity gain path by separate feeds of the input signals to the output matrix 152.

Another way of viewing the difference between the topology of FIG. 22 and that of FIG. 23 is that a passive matrix is implicit in the FIG. 22 arrangement, whereas a passive matrix is explicit (i.e., the output matrix 152) in the FIG. 23 arrangement. For example, consider first FIG. 22. For simplicity assume that this is a two-input four-output "ninety-degree" system as in said Fosgate application. Assume further that output 1 is the Lout output. The required adjacent antidominant signals, neglecting any additional common scaling, are those for center front and center rear, that is, (Lt−Rt)/2 and (Lt+Rt)/2. They are multiplied by expressions 1−gs and 1−gc respectively to obtain a pair of signals with equal magnitudes, and then added together, yielding (1−gs)·(Lt−Rt)/2+(1−gc)·(Lt+Rt)/2. This can be partially multiplied to give Lt−gs·(Lt−Rt)/2−gc·(Lt+Rt)/2 (here, the unmultiplied Rt terms cancel, but in a more complex system there would be more terms). The gs·( . . . ) and gc·( . . . ) terms could be considered as cancellation terms augmenting (actually, diminishing) the passive matrix Lt.

Now consider FIG. 23 using the same assumptions. The antidominant signals urged towards equality are the same. The output matrix receives the original Lt and Rt plus VCA outputs gs·(Lt−Rt)/2 and gc·(Lt−Rt)/2, and adds/subtracts to give the same Lout signal as in FIG. 22. The output matrix applies the necessary coefficients for the passive matrix (in this example, just unity for Lt and zero for Rt), and combines the result with the cancellation terms, which are therefore applied within the output matrix instead of within the servo, but the result is identical.

The same input matrix 102 is employed in the FIGS. 22 and 23 embodiments to generate pairs of antidominant signals. In FIG. 23 the antidominant signals are applied to servos 142, 142', 142", etc. In the manner of FIGS. 14/15 and 16, the controlled gain or attenuation functions or elements are controlled so that the outputs of the subtractors are urged toward equality, while the servo outputs are taken from the controlled gain or attenuation functions or elements outputs. For simplicity, control for the controllable gain or attenuation functions or elements is not shown. Matrix 152 develops passive matrix components from the input signals and combines them appropriately with the cancellation components from the servos in the manner of FIGS. 14/15 and 16.

Constant Power Adaptive Scaling

In an example above, a desired principal direction output is 90° and the adjacent principal directions are 30° and 150° (i.e., β2=90°, β1=30° and β3=150°). FIGS. 2 through 6 relate to that example. To aid in the understanding of another aspect of the present invention, consider an extension of that example in which a second desired principal direction output β3 has adjacent directions β2 and β4, where β4 is 210 degrees. Thus, for β4=210:

$$anti2(\alpha)=Rt(\beta 2)\cdot Lt(\alpha)-Lt(\beta 2)\cdot Rt(\alpha), \quad \text{Eqn. 42}$$

and $$anti4(\alpha)=Rt(\beta 4)\cdot Lt(\alpha)-Lt(\beta 4)\cdot Rt(\alpha). \quad \text{Eqn. 43}$$

The required gains for urging the gain modified antidominant signals toward equal magnitude may be expressed $$h\beta 2(\alpha):=\text{if}\left(\left|\frac{anti\beta 2(\alpha)}{anti\beta 4(\alpha)}\right|\geq 1,\left|\frac{anti\beta 4(\alpha)}{anti\beta 2(\alpha)}\right|,1\right) \quad \text{Eqn. 44}$$

$$h\beta 4(\alpha):=\text{if}\left(\left|\frac{anti\beta 4(\alpha)}{anti\beta 2(\alpha)}\right|\geq 1,\left|\frac{anti\beta 2(\alpha)}{anti\beta 4(\alpha)}\right|,1\right) \quad \text{Eqn. 45}$$

The outputs of the respective controlled gain or attenuation functions or elements (i.e., the servos), mag$\beta 2(\alpha)$ and mag$\beta 4(\alpha)$ may be expressed $$mag\beta 2(\alpha)=h\beta 2(\alpha)\cdot anti2(\alpha), \text{ and} \quad \text{Eqn. 46}$$

$$mag\beta 4(\alpha)=h\beta 4(\alpha)-anti4(\alpha). \quad \text{Eqn. 47}$$

Thus, the output for the principal direction β3 may be expressed $$output\beta 3=mag\beta 4(\alpha)-mag\beta 2(\alpha). \quad \text{Eqn. 48}$$

Figure 24:
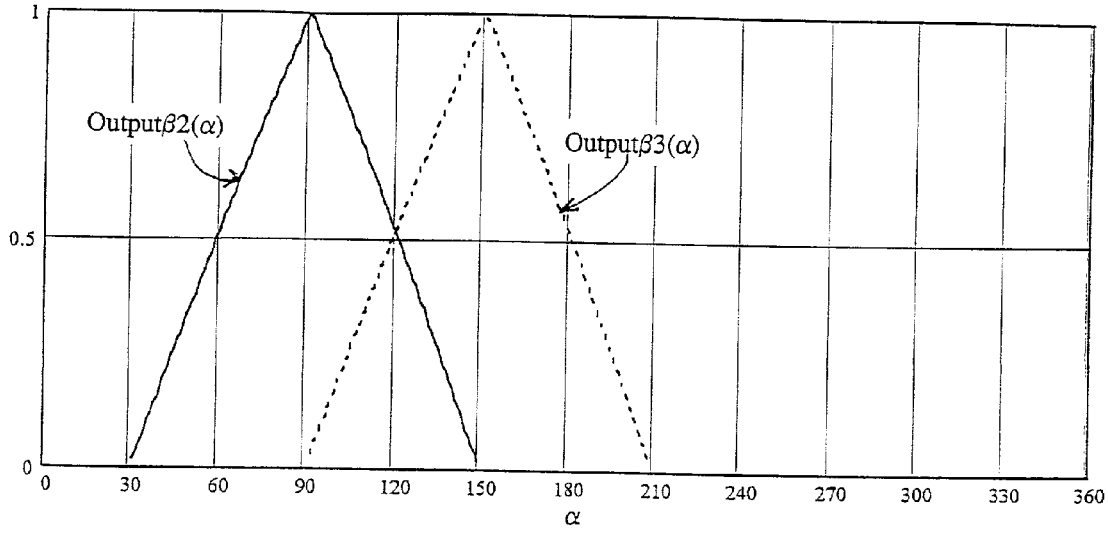
FIGS. 24 and 25 are additional idealized graphs for the case when a single source audio signal having a unity amplitude encoded into two signals is applied to a decoder according to the present invention.

A plot of output $\beta 2(\alpha)$ (see FIG. 5) and output $\beta 3(\alpha)$ versus the direction angle a is shown in FIG. 24. Inspection of FIG. 24 shows that a single source signal whose directional encoding is 90 degrees or 150 degrees will deliver unit power from the appropriate output. However output β2 and output β4 cross at about 0.5, 6 dB down. Thus, a single source signal whose directional encoding angle α is 120 degrees (i.e., panned half-way between the two principal directions), whose Lt and Rt powers also add to unity (by the normalized definition above), will emerge about 6 dB down from both outputs. Constant loudness generally requires that the levels from the two outputs be only 3 dB down, since two equal powers sum to give a 3 dB boost. In other words, as a constant level source was panned, the apparent level would drop when the source was between the two principal directions.

This level changing effect can be reduced, or in fact other variations introduced, by modifying the controllable function or element gains while retaining their relative variation with direction, that is, by adding a variable scaling to both functions or elements of a pair. In this particular example, one needs a scaling that varies from 0 dB at a principal direction to +3 dB half-way between. One method is to generate an additional multiplier that varies as a function of the encoded angle α as follows:

$$mult\beta 2(\alpha):=\sqrt{\frac{2}{h\beta 1(\alpha)^2+h\beta 3(\alpha)^2}} \quad \text{Eqn. 49}$$

Since hβ1 and hβ3 are constrained to lie between 0 and 1, and since one or other of them is always 1, this functions varies between the square root of 2 and 1, that is, between +3 dB half-way between principal directions and 0 dB at the principal directions. Thus, it increases the levels at the half-way point by the desired 3 dB. For output β2, the revised equal magnitude terms are $$mag\beta 1(\alpha)=mult\beta 2(\alpha)\cdot h\beta 1(\alpha)\cdot anti1(\alpha), \text{ and} \quad \text{Eqn. 50}$$

$$mag\beta 3(\alpha)=mult\beta 2(\alpha)\cdot h\beta 3(\beta)\cdot anti3(\alpha). \quad \text{Eqn. 51}$$

The new output β2 is $$output\beta 2(\alpha)=mag\beta 3(\alpha)-mag\beta 1(\alpha). \quad \text{Eqn. 52}$$

Similarly for output β3:

$$mult\beta 3(\alpha):=\sqrt{\frac{2}{h\beta 2(\alpha)^2+h\beta 4(\alpha)^2}} \quad \text{Eqn. 53}$$

$$mag\beta 2(\alpha)=mult\beta 3(\alpha)\cdot h\beta 2(\alpha)\cdot anti2(\alpha), \text{ and} \quad \text{Eqn. 54}$$

$$mag\beta 4(\alpha)=mult\beta 3(\alpha)\cdot h\beta 4(\alpha)\cdot anti4(\alpha). \quad \text{Eqn. 55}$$

The new output β3 is $$output\beta 3(\alpha)=mag\beta 4(\alpha)-mag\beta 2(\alpha). \quad \text{Eqn. 56}$$

Figure 25:
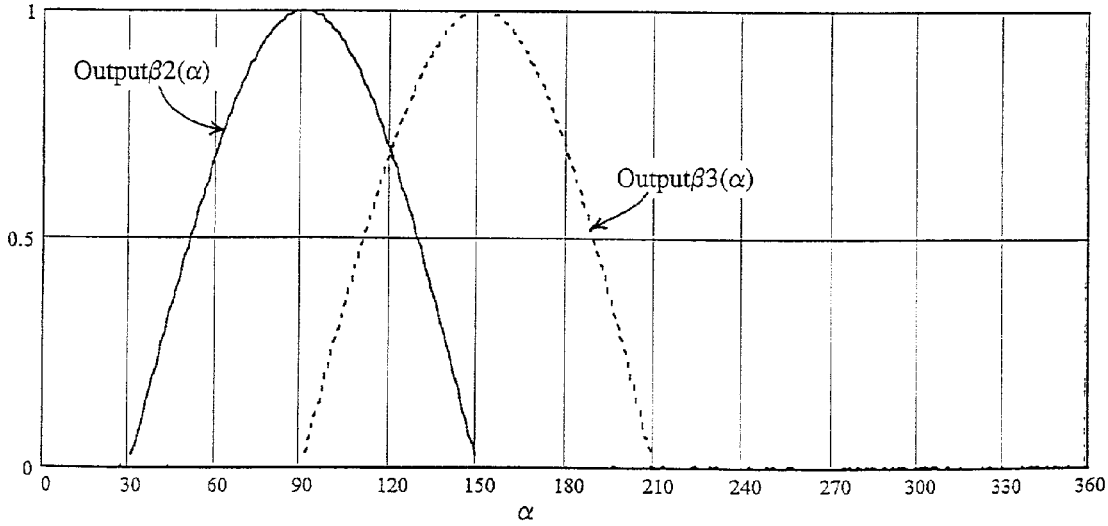

A plot of modified output $\beta 2(\alpha)$ and modified output $\beta 4(\alpha)$ versus the direction angle α is shown in FIG. 25. Inspection of FIG. 25 shows that the multiplier makes this particular pair of outputs cross at about −3 dB, yielding apparent constant loudness. For other principal directions, different multiplying functions may be required. The multiplier may be applied as above to the equal magnitude terms by further control of the variable gain or attenuation functions or elements (i.e., applying the same multiplier to both functions or elements). Alternatively, it may be applied to the output signals (i.e., subsequent to combining of the urged to equal gain modified antidominant signals) by a further controlled gain or attenuation function or element. The variable scaling may also be applied to other elements or functions provided that both antidominant signals or their magnitude controlled versions are affected substantially equally so as to affect one or more selected output signals. Typically, it would not be appropriate to apply the variable scaling to the input signals because all of the output signals would be affected.

Six Outputs with Principal Directions at Non-Uniform Increments Fixed Scaling to Control the Position of Maximum Signal Output In the examples above the desired principal directions are spaced at uniform increments. In order to better understand the invention and to aid in the understanding of another aspect of the present invention (i.e., the positioning of the maximum signal output at the desired output angle when spacings among principal output directions are non-uniform), consider another example in which six principal output directions are obtained at non-uniform angular spacings. Assume there are two input signals Lt and Rt as defined in Equations 1 and 2 and that there are six outputs or principal directions at angles β1, β2, . . . β6. As is explained further below, these six outputs correspond to left back (β1), left front (β2) (90°), center front (β3) (180°), right front (β4) (270°), right back (β5) and rear back (β6) (360°).

In this example, the calculations are modified for two of the outputs (only), those for β1 and β2, using constants k1 and k2 as explained below. This has the effect of ensuring that the maximum outputs for β1 and β2 occur precisely at the principal directions rather than a few degrees away. Principal directions β4 and β5 are unmodified to illustrate the effect of the modification on the β1 and β2 outputs.

Consider three adjacent principal output directions β1, β2, and β3. Define left back as a magnitude difference between Lt and Rt of 5 dB. Thus, $$\beta 1b := 90 + \frac{2}{deg} \cdot \mathrm{atan}\left(-10^{\frac{-5}{20}}\right) \qquad \text{Eqn. 57}$$

β1*b*=31.298°

Hence, for the left front output, the adjacent principal directions are at β=β1*b* and β= 180°. Namely, β1=β1*b*, β2=90°, and

β3=180°.

There is a first antidominant signal, a combination anti1 of Lt and Rt with appropriate coefficients that passes through zero when α=β1:

$$anti\mathbf{1}(\alpha)=Rt(\beta\mathbf{1})\cdot Lt(\alpha)-Lt(\alpha)\cdot Rt(\alpha). \qquad \text{Eqn. 57}$$

Similarly, there is second antidominant signal, a combination anti3*a* of Lt and Rt with appropriate coefficients that passes through zero when α=β3:

$$anti\mathbf{3}a(\alpha)=Rt(\beta\mathbf{3})\cdot Lt(\alpha)-Lt(\beta\mathbf{3})\cdot Rt(\alpha), \qquad \text{Eqn. 58}$$

Next, scale antidominant signal anti3*a* by a factor k1 to produce antidominant signal anti3:

$$anti\mathbf{3}(\alpha)=k\mathbf{1}\cdot anti\mathbf{3}a(\alpha). \qquad \text{Eqn. 59}$$

Choose factor k1 to make anti1 and anti3 substantially equal in magnitude (ratio of 1) when α is the same as the principal output angle β2:

$$k1 := \left|\frac{anti1(\beta 2)}{anti3a(\beta 2)}\right| \qquad \text{Eqn. 60}$$

k1=0.693

Figure 26:
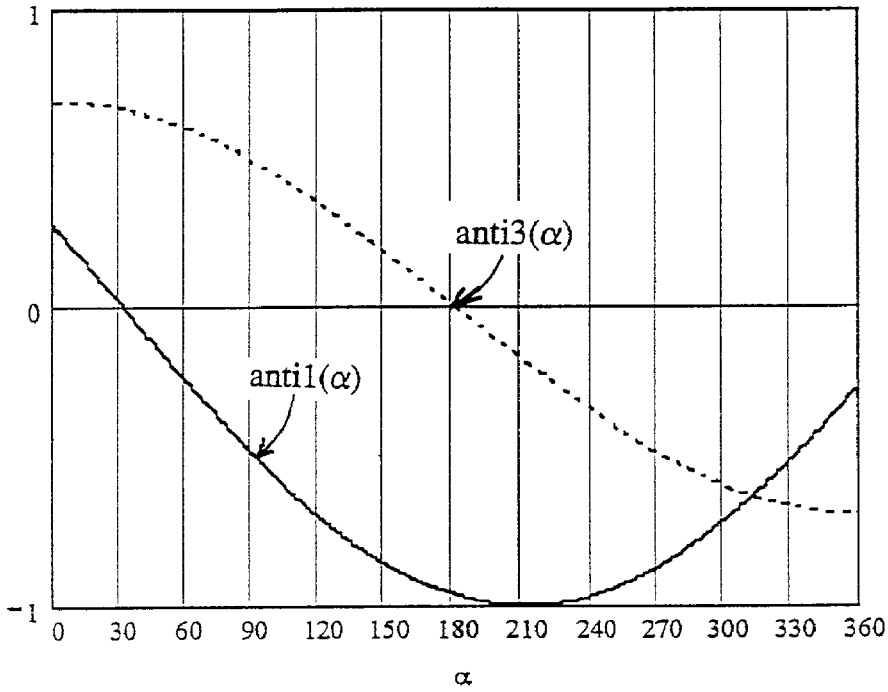
FIGS. 26–29 are idealized graphs for a decoder according to the present invention having six outputs with the principal directions of the six outputs spaced apart in non-uniform increments.

Plots of anti1(α) and anti3(α) versus α are shown in FIG. 26. Note that anti1(α) goes to zero at 30° and anti3(α) goes to zero at 180°. The effect of scaling anti3(α) is apparent (its peak magnitude is 0.693 instead of 1). Both antidominant signals change polarity when they pass through zero.

Antidominant signals anti1 and anti3 are then controlled to force equal magnitude, by a closed-loop servo or otherwise, as described above. For example, the smaller may be substantially unchanged (a gain of 1), and the larger attenuated to force its magnitude to be equal to that of the smaller. The attenuation required is the ratio of the smaller to the larger input magnitudes. The required gains, h13 for anti1 and h31 for anti3 (e.g., h13 is the gain to be applied to anti1 to make it equal in magnitude to anti3), both functions of the direction angle α, can be written:

$$h13(\alpha) := \mathrm{if}\left(\left|\frac{anti1(\alpha)}{anti3(\alpha)+\delta}\right| \geq 1, \left|\frac{anti3(\alpha)}{anti1(\alpha)}\right|, 1\right) \qquad \text{Eqn. 61}$$

where δ is a very small number, such as $10^{-10}$, to prevent division by or log of zero.

Thus the outputs mag13 and mag31 of the controlled gain or attenuation functions or elements are:

$$mag\mathbf{13}(\alpha)=h\mathbf{13}(\alpha)\cdot anti\mathbf{1}(\alpha), \text{ and} \qquad \text{Eqn. 63}$$

$$mag\mathbf{31}(\alpha)=h\mathbf{31}(\alpha)\cdot anti\mathbf{3}(\alpha). \qquad \text{Eqn. 64}$$

Figure 27:
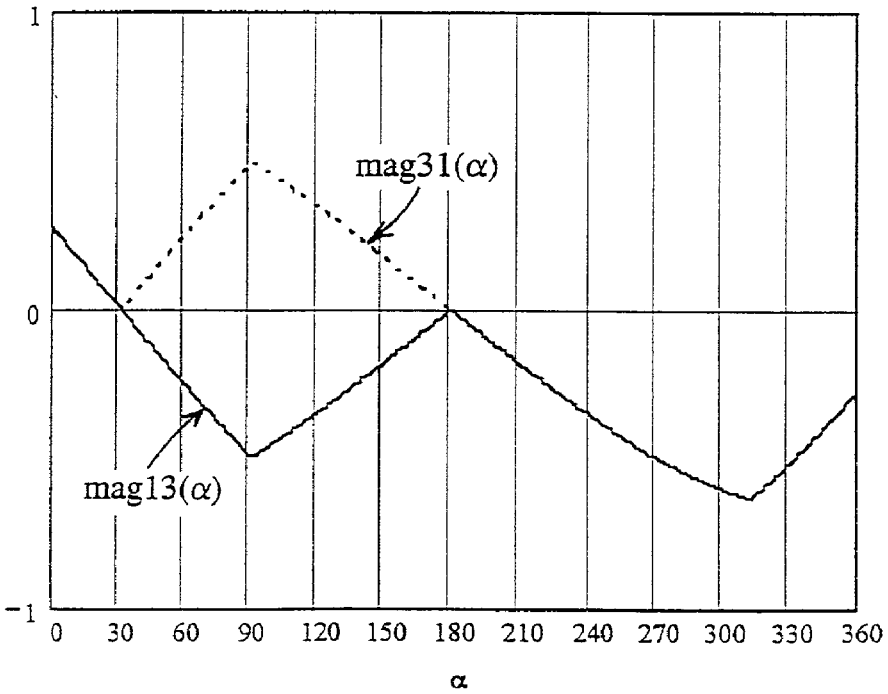
Figure 28:
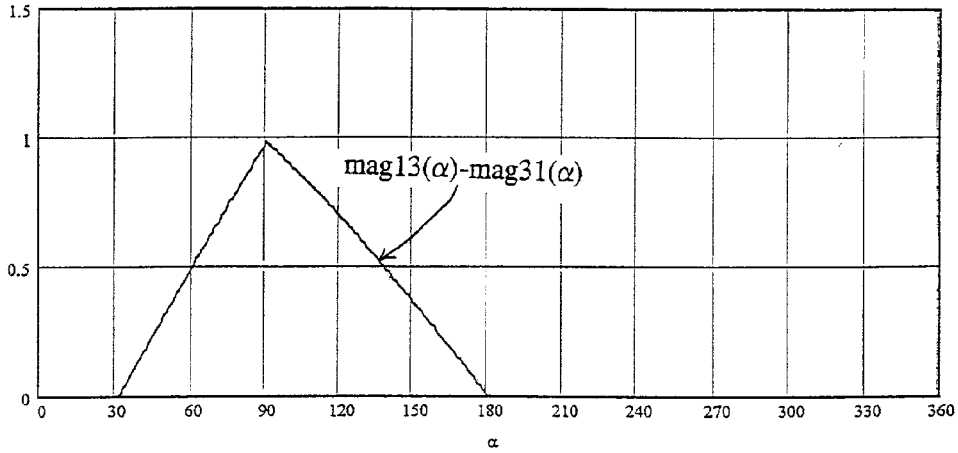

A plot of mag13(α) and mag31(α) versus the angle of the encoded source signal α is shown in FIG. 27. The outputs mag13(α) and mag31(α) are identical in magnitude and polarity except in the range α=β1 to α=β3, where they have identical magnitude but opposite polarity. By subtracting them, one obtains zero except in that limited range. This difference, shown in the plot of mag31(α)−mag13(α) versus encoded source signal angle α of FIG. 28, is the output corresponding to direction β2, the principal direction between β1 and β3. For a pan around the whole circle, from α=0° at the rear through α=180° at the front and back to α=360° at the rear, this output will rise from zero when α=β1 to a maximum at β2 and then will fall again to zero at β3. Without the factor k1, the maximum would not occur precisely at β2.

In a similar manner, one may derive the five other principal output directions. In doing so, it will be noted that each antidominant signal is used for two principal output directions, for example, anti2 is used for outputs at both β1 and β3.

Derivation of Principal Direction Output β3=180°

β2:=90

β3:=180

β4:=270

$$anti\mathbf{2}(\alpha):=Rt(\beta\mathbf{2})\cdot Lt(\alpha)-Lt(\beta\mathbf{2})\cdot Rt(\alpha) \qquad \text{Eqn. 65}$$

$$anti\mathbf{4}(\alpha):=Rt(\beta\mathbf{4})\cdot Lt(\alpha)-Lt(\beta\mathbf{4})\cdot Rt(\alpha) \qquad \text{Eqn. 66}$$

$$h24(\alpha) := \mathrm{if}\left(\left|\frac{anti2(\alpha)}{anti4(\alpha)+\delta}\right| \geq 1, \left|\frac{anti4(\alpha)}{anti2(\alpha)}\right|, 1\right) \qquad \text{Eqn. 67}$$

-continued $$h42(\alpha) := \text{if}\left(\left|\frac{anti4(\alpha)}{anti2(\alpha)+\delta}\right| \geq 1, \left|\frac{anti2(\alpha)}{anti4(\alpha)}\right|, 1\right) \quad \text{Eqn. 68}$$

$$mag\mathbf{24}(\alpha):=h\mathbf{24}(\alpha)\cdot anti\mathbf{2}(\alpha) \quad \text{Eqn. 69}$$

$$mag\mathbf{42}(\alpha):=h\mathbf{42}(\alpha)\cdot anti\mathbf{4}(\alpha) \quad \text{Eqn. 70}$$

Derivation of Principal Direction Output β4=270°

$$\beta\mathbf{3}:=180$$

$$\beta\mathbf{4}:=270$$

$$\beta\mathbf{5}:=360-\beta\mathbf{1}b$$

$$anti\mathbf{3}(\alpha):=Rt(\beta\mathbf{3})\cdot Lt(\alpha)-Lt(\beta\mathbf{3})\cdot Rt(\alpha) \quad \text{Eqn. 71}$$

$$anti\mathbf{5}(\alpha):=Rt(\beta\mathbf{5})\cdot Lt(\alpha)-Lt(\beta\mathbf{5})\cdot Rt(\alpha) \quad \text{Eqn. 72}$$

$$h35(\alpha) := \text{if}\left(\left|\frac{anti3(\alpha)}{anti5(\alpha)+\delta}\right| \geq 1, \left|\frac{anti5(\alpha)}{anti3(\alpha)}\right|, 1\right) \quad \text{Eqn. 73}$$

$$h53(\alpha) := \text{if}\left(\left|\frac{anti5(\alpha)}{anti3(\alpha)+\delta}\right| \geq 1, \left|\frac{anti3(\alpha)}{anti5(\alpha)}\right|, 1\right) \quad \text{Eqn. 74}$$

$$mag\mathbf{35}(\alpha):=h\mathbf{35}(\alpha)\cdot anti\mathbf{3}(\alpha) \quad \text{Eqn. 75}$$

$$mag\mathbf{53}(\alpha):=h\mathbf{53}(\alpha)\cdot anti\mathbf{5}(\alpha) \quad \text{Eqn. 76}$$

Derivation of Principal Direction Output β5=360−β1*b*°

$$\beta\mathbf{4}:=270$$

$$\beta\mathbf{5}:=360-\beta\mathbf{1}b$$

$$\beta\mathbf{6}:=360$$

$$anti\mathbf{4}(\alpha):=Rt(\beta\mathbf{4})\cdot Lt(\alpha)-Lt(\beta\mathbf{4})\cdot Rt(\alpha) \quad \text{Eqn. 77}$$

$$anti\mathbf{6}(\alpha):=Rt(\beta\mathbf{6})\cdot Lt(\alpha)-Lt(\beta\mathbf{6})\cdot Rt(\alpha) \quad \text{Eqn. 78}$$

$$h46(\alpha) := \text{if}\left(\left|\frac{anti4(\alpha)}{anti6(\alpha)+\delta}\right| \geq 1, \left|\frac{anti6(\alpha)}{anti4(\alpha)}\right|, 1\right) \quad \text{Eqn. 79}$$

$$h64(\alpha) := \text{if}\left(\left|\frac{anti6(\alpha)}{anti4(\alpha)+\delta}\right| \geq 1, \left|\frac{anti4(\alpha)}{anti6(\alpha)}\right|, 1\right) \quad \text{Eqn. 80}$$

$$mag\mathbf{46}(\alpha):=h\mathbf{46}(\alpha)\cdot anti\mathbf{46}(\alpha) \quad \text{Eqn. 81}$$

$$mag\mathbf{64}(\alpha):=h\mathbf{64}(\alpha)\cdot anti\mathbf{6}(\alpha) \quad \text{Eqn. 82}$$

Derivation of Principal Direction Output β6=360°

$$\beta\mathbf{5}:=360-\beta\mathbf{1}b$$

$$\beta\mathbf{6}:=360$$

$$\beta\mathbf{1}:=\beta\mathbf{1}b$$

$$anti\mathbf{5}(\alpha):=Rt(\beta\mathbf{5})\cdot Lt(\alpha)-Lt(\beta\mathbf{5})\cdot Rt(\alpha) \quad \text{Eqn. 83}$$

$$anti\mathbf{1}(\alpha):=Rt(\beta\mathbf{1})\cdot Lt(\alpha)-Lt(\alpha)\cdot Rt(\alpha) \quad \text{Eqn. 84}$$

$$h51(\alpha) := \text{if}\left(\left|\frac{anti5(\alpha)}{anti1(\alpha)+\delta}\right| \geq 1, \left|\frac{anti1(\alpha)}{anti5(\alpha)}\right|, 1\right) \quad \text{Eqn. 85}$$

$$h15(\alpha) := \text{if}\left(\left|\frac{anti1(\alpha)}{anti5(\alpha)+\delta}\right| \geq 1, \left|\frac{anti5(\alpha)}{anti1(\alpha)}\right|, 1\right) \quad \text{Eqn. 86}$$

$$mag\mathbf{51}(\alpha):=h\mathbf{51}(\alpha)\cdot anti\mathbf{5}(\alpha) \quad \text{Eqn. 87}$$

$$mag\mathbf{15}(\alpha):=h\mathbf{15}(\alpha)\cdot anti\mathbf{1}(\alpha) \quad \text{Eqn. 88}$$

Derivation of Principal Direction Output β1=β1*b*

$$\beta\mathbf{6}:=360$$

$$\beta\mathbf{1}:=\beta\mathbf{1}b$$

$$\beta\mathbf{2}:=90$$

$$anti\mathbf{6}(\alpha):=Rt(\beta\mathbf{6})\cdot Lt(\alpha)-Lt(\beta\mathbf{6})\cdot Rt(\alpha) \quad \text{Eqn. 89}$$

$$anti\mathbf{2}a(\alpha):=(Rt(\beta\mathbf{2})\cdot Lt(\alpha)-Lt(\beta\mathbf{2})\cdot Rt(\alpha)) \quad \text{Eqn. 90}$$

Scale anti2*a* by factor k2 to deliver anti2, where anti2 and anti6 are equal in magnitude at β1.

$$k1 := \left|\frac{anti6(\beta 1)}{anti2a(\beta 1)}\right| \quad \text{Eqn. 91}$$

$$k\mathbf{2}=0.55$$

$$anti\mathbf{2}(\alpha):=k\mathbf{2}\cdot anti\mathbf{2}a(\alpha) \quad \text{Eqn. 92}$$

$$h62(\alpha) := \text{if}\left(\left|\frac{anti6(\alpha)}{anti2(\alpha)+\delta}\right| \geq 1, \left|\frac{anti2(\alpha)}{anti6(\alpha)}\right|, 1\right) \quad \text{Eqn. 93}$$

$$h26(\alpha) := \text{if}\left(\left|\frac{anti2(\alpha)}{anti6(\alpha)+\delta}\right| \geq 1, \left|\frac{anti6(\alpha)}{anti2(\alpha)}\right|, 1\right) \quad \text{Eqn. 94}$$

$$mag\mathbf{62}(\alpha):=h\mathbf{62}(\alpha)\cdot anti\mathbf{6}(\alpha) \quad \text{Eqn. 95}$$

$$mag\mathbf{26}(\alpha):=h\mathbf{26}(\alpha)\cdot anti\mathbf{2}(\alpha) \quad \text{Eqn. 96}$$

The six resultant outputs may be expressed in dB. In some, the equal-magnitude terms have the same polarity and in others the opposite, depending on the arbitrarily chosen polarity of the terms at adjacent principal points. The dB quantities may be normalized to the maximum, as below, so that each principal direction emerges at the same level:

left front $$out2_\alpha := mag31(\alpha) - mag13(\alpha) \quad \text{Eqn. 97}$$

$$\text{outdb2}_\alpha := 20 \cdot \log\left(\left|\frac{\text{out2}_\alpha}{\max(\text{out2})}\right| + \delta\right) \quad \text{Eqn. 98}$$

center front $$out3_\alpha := mag42(\alpha) - mag24(\alpha) \quad \text{Eqn. 99}$$

$$\text{outdb3}_\alpha := 20 \cdot \log\left(\left|\frac{\text{out3}_\alpha}{\max(\text{out3})}\right| + \delta\right) \quad \text{Eqn. 100}$$

right front $$out4_\alpha := mag53(\alpha) - mag35(\alpha) \quad \text{Eqn. 101}$$

$$\text{outdb4}_\alpha := 20 \cdot \log\left(\left|\frac{\text{out4}_\alpha}{\max(\text{out4})}\right| + \delta\right) \quad \text{Eqn. 102}$$

right back $$out5_\alpha := mag64(\alpha) - mag46(\alpha) \quad \text{Eqn. 103}$$

$$\text{outdb5}_\alpha := 20 \cdot \log\left(\left|\frac{\text{out5}_\alpha}{\max(\text{out5})}\right| + \delta\right) \quad \text{Eqn. 104}$$

center back $$out6_\alpha := mag51(\alpha) + mag15(\alpha) \quad \text{Eqn. 105}$$

$$\text{outdb6}_\alpha := 20 \cdot \log\left(\left|\frac{\text{out6}_\alpha}{\max(\text{out6})}\right| + \delta\right) \quad \text{Eqn. 106}$$

left back $$out1_\alpha := mag62(\alpha) + mag26(\alpha) \quad \text{Eqn. 107}$$

$$\text{outdb1}_\alpha := 20 \cdot \log\left(\left|\frac{\text{out1}_\alpha}{\max(\text{out1})}\right| + \delta\right) \quad \text{Eqn. 108}$$

Figure 29:
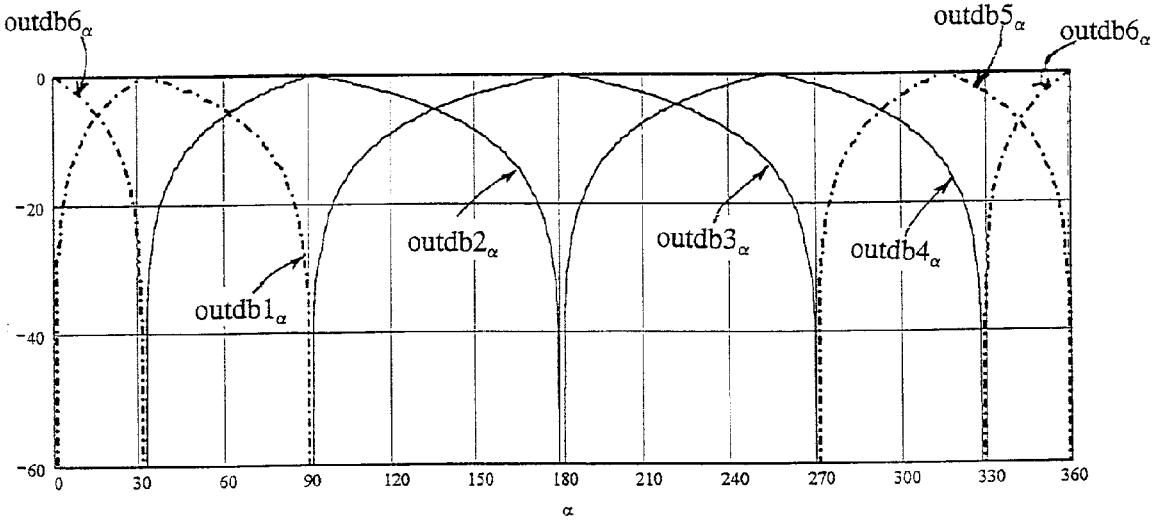

The outputs in dB are plotted versus encoded source signal angle α in FIG. 29. Note that the modified outputs have their maxima at β1 (31.298°) and β2 (90°), whereas the corresponding unmodified outputs β4 and β5 do not have their maxima where the adjacent outputs go to zero (e.g., the unmodified outdb4 peaks at about 245° instead of 270° where outdb5 goes to zero).

Scaling the Anti-Dominant Signals for a Desired Passive Matrix

Applying fixed scaling of one antidominant signal with respect to the other is useful to assure not only that the output peak occurs at the desired output angle when the angles between output directions are not uniform but also to alter the matrix characteristics when the active matrix decoder is in its quiescent or passive matrix condition (i.e., when there is no clear steering; when the servos "relax" such that the decoder functions essentially as a passive matrix). It should be noted, however, that the application of fixed relative scaling for direction peaking affects the passive matrix characteristics and vice-versa. Thus, the implementation of such scaling involves engineering design tradeoffs. In most cases, it is believed that the passive matrix characteristics are more audibly significant than achieving particularly precise direction peaking. Precise direction peaking is thought to be less important because in practical audio reproduction systems, loudspeakers are often not physically located at same direction angles of the decoder outputs from which they are fed.

Fixed scaling of one antidominant signal with respect to the other can be achieved by altering the input antidominant matrix (matrix 102 in FIGS. 19, 20 22 and 23 and matrices 102 and 102' in FIG. 21) with respect to at least one antidominant signal output or by altering the signal amplitude of at least antidominant signal before its application to a variable gain or attenuation function or element.

Turning then to scaling for the purpose of providing desired passive matrix characteristics, when the gains h of the controlled gain or attenuation functions or elements have values near unity (or equivalently, both g gains are small compared with unity), as happens in an unsteered condition, the output consists of the sum (or difference) of the scaled anti-dominant signals. Thus, by altering the scaling, in particular the relative scaling, one can alter the passive matrix—the passive matrix when the servos "relax" can be chosen by the scalings applied to the anti-dominant signals prior to controlling their magnitudes and urging them towards equality. Following is an example of such scaling for the left back output of a five-output decoder with principal outputs left back, left front, center, right front and right back.

Consider the left back output of the five-output matrix. The three output directions of interest are therefore β1*b* and the adjacent outputs. For consistency, call them β1, β2 and β3, where β1 corresponds to right back, β2 corresponds to left back and β3 to left front. Suppose that β1*b* is 31 degrees. Thus, $$\beta 1 = 360 - \beta 1b.$$

$$\beta 2 = \beta 1b, \text{ and}$$

$$\beta 3 = 90.$$

For the adjacent principal directions at β1 and β3, using scaling factors k1 and k3:

$$\text{antidominant}\,\beta 1(\alpha) = k1 \cdot \left(\sin\left(\frac{\beta 1 - 90}{2}\right) \cdot Lt(\alpha) - \cos\left(\frac{\beta 1 - 90}{2}\right) \cdot Rt(\alpha)\right) \quad \text{Eqn. 109}$$

$$\text{antidominant}\,\beta 3(\alpha) = k3 \cdot \left(\sin\left(\frac{\beta 3 - 90}{2}\right) \cdot Lt(\alpha) - \cos\left(\frac{\beta 3 - 90}{2}\right) \cdot Rt(\alpha)\right) \quad \text{Eqn. 110}$$

The passive matrix for the left back output is merely the sum of these when the equal-magnitude gains are equal and at or close to one:

$$LBpass(\alpha) = antidominant\beta 1(\alpha) + antidominant\beta 3(\alpha). \quad \text{Eqn. 111}$$

Substituting for the antidominant signals, this can be expressed as:

$$LBpass(\alpha) = A \cdot Lt(\alpha) + B \cdot Rt(\alpha), \quad \text{Eqn. 112}$$

where $$A = k1 \cdot \sin\left(\frac{\beta 1 - 90}{2}\right) + k2 \cdot \sin\left(\frac{\beta 3 - 90}{2}\right) \quad \text{Eqn. 113}$$

and $$B = -k1 \cdot \cos\left(\frac{\beta 1 - 90}{2}\right) - k2 \cdot \cos\left(\frac{\beta 3 - 90}{2}\right). \quad \text{Eqn. 114}$$

If the passive matrix is to give a difference corresponding to a ratio c (0.25 for 12 dB, 0.56 for 5 dB:

$$\frac{B}{A} = -c \quad \text{Eqn. 115}$$

The absolute values of k are arbitrary; however, their ratio is significant. Call the ratio k2/k1=k. For c=0.56:

$$k = \frac{-\left(\cos\left(\frac{\beta 1 - 90}{2}\right) - c \cdot \sin\left(\frac{\beta 1 - 90}{2}\right)\right)}{\cos\left(\frac{\beta 3 - 90}{2}\right) - c \cdot \sin\left(\left(\frac{\beta 3 - 90}{2}\right)\right)} \quad \text{Eqn. 116}$$

k=0.977.

Similarly, for c=0.25, k=0.707.

Thus without disturbing the steering, the scaling can be chosen for a desired passive matrix.

Three Input Channels

In order to better understand the invention and to aid in the understanding of another aspect of the present invention (i.e., an decoder having more than two input channels), consider another example in which six principal output directions, back (B), left back (LB), left (L), center (C), right (R), right back (RB), are obtained at uniform angular spacings (outputs are 60° from each other) from three input signals.

For a single source signal from angle α, the direction can be coded into three input signals Lt, Rt and Bt as follows:

$$Lt(\alpha) = \text{if}\left(0 < \alpha < 240, \sin\left(\frac{3}{4} \cdot \alpha\right), 0\right) \quad \text{Eqn. 117}$$

$$Rt(\alpha) = \text{if}\left[120 < \alpha < 360, \sin\left[\frac{3}{4} \cdot (\alpha - 120)\right], 0\right] \quad \text{Eqn. 118}$$

$$Bt(\alpha) = \text{if}\left[240 < \alpha < 360, \sin\left[\frac{3}{4} \cdot (\alpha - 240)\right], \text{if}\left(0 \le \alpha < 120, \cos\left(\frac{3}{4} \cdot \alpha\right), 0\right)\right] \quad \text{Eqn. 119}$$

Figure 30:
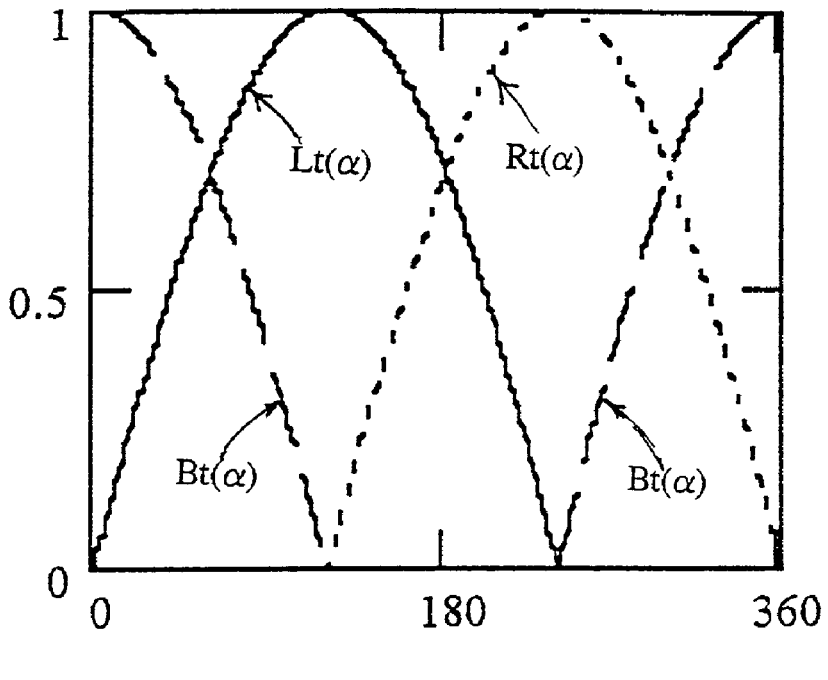
FIGS. 30–41 are idealized graphs useful in understanding another aspect of the present invention, namely an encoder having more than two input channels.

With the above definitions of the three input "total" signals, there are no polarity reversals as is apparent from a plot of the three signals versus the angle of the encoded source signal α, shown in FIG. 30.

Define the output principal directions at 60 degree increments, starting with back B at zero degrees. Consider LB. The adjacent principal directions are B and L, at 0 and 120 degrees respectively. Thus, what is required are combinations of the input total signals that go to zero at when the encoded direction of a single source signal is the same angle as output B and output L. Note from the FIG. 30 that Rt is zero throughout the range 0 to 120 degrees, so one would expect the derivation of LB to involve only Lt and Bt. As for the two input channel case, one might expect the appropriate combinations to consist of the x·Lt minus y·Bt, where x and y are coefficients adopted for Bt and Lt, respectively, at the directions where zeros are required. Thus, $$antiLB1(\alpha) = Bt(0) \cdot Lt(\alpha) - Lt(0) \cdot Bt(\alpha), \text{ and} \quad \text{Eqn. 120}$$

$$antiLB2(\alpha) = Bt(120) \cdot Lt(\alpha) - Lt(120) \cdot Bt(\alpha). \quad \text{Eqn. 121}$$

Figure 31:
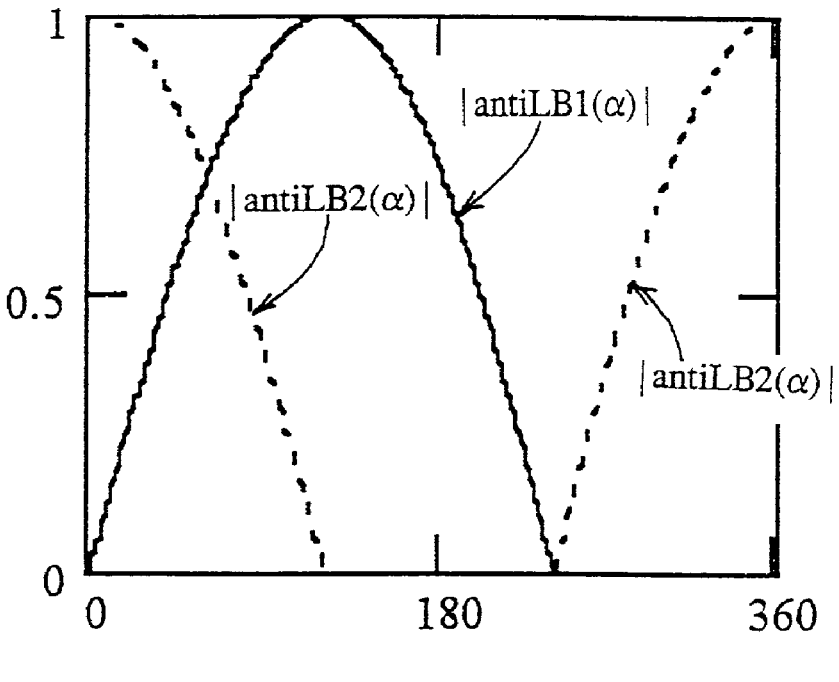

The absolute values of antiLB1(α) and antiLB2(α) versus the angle of the encoded source signal a are shown in FIG. 31. One needs to operate on these antidominant signals using controlled gain or attenuation functions or elements to yield two signals of equal magnitudes, as described above. This may be accomplished by generating gains to force the magnitudes toward equality:

$$glb1(\alpha) := \text{if}\left(\left|\frac{antiLB1(\alpha)}{antiLB2(\alpha) + \delta}\right| > 1, \left|\frac{antiLB2(\alpha)}{antiLB1(\alpha)}\right|, 1\right) \quad \text{Eqn. 122}$$

$$glb2(\alpha) := \text{if}\left(\left|\frac{antiLB2(\alpha)}{antiLB1(\alpha) + \delta}\right| > 1, \left|\frac{antiLB1(\alpha)}{antiLB2(\alpha)}\right|, 1\right) \quad \text{Eqn. 123}$$

Thus, the two terms with equal magnitudes are:

$$LB1(\alpha) := \frac{glb1(\alpha) \cdot antiLB1(\alpha)}{\sqrt{2}} \quad \text{Eqn. 124}$$

$$LB2(\alpha) := \frac{glb2(\alpha) \cdot antiLB2(\alpha)}{\sqrt{2}} \quad \text{Eqn. 125}$$

Figure 32:
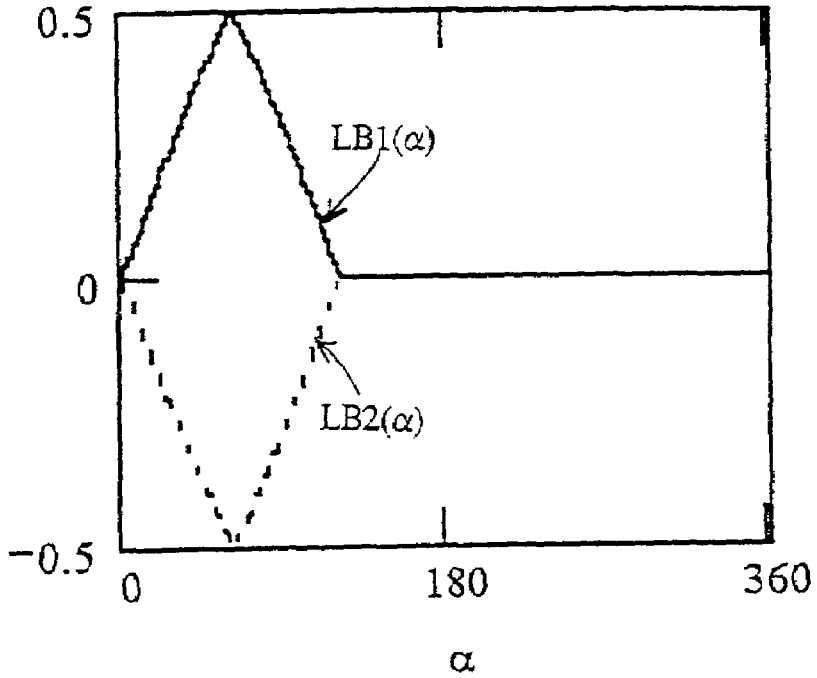
Figure 33:
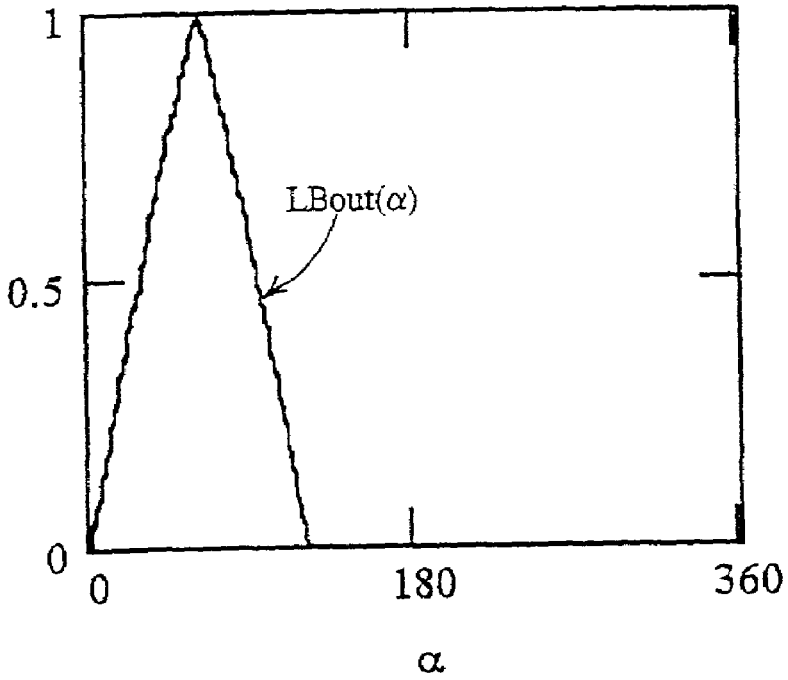

A plot of LB1(α) and LB2(α) versus the angle of the encoded source signal a are shown in FIG. 32. The square root of 2 divider is merely to make the final maximum unity. The LB output, $$LBout(\alpha) = LB1(\alpha) - LB2(\alpha), \quad \text{Eqn. 126}$$

is plotted versus the angle of the encoded source signal α in FIG. 33.

Now consider the L (120 degree) output. The outputs adjacent to L are LB (60°) and C (180°). L is contained in all three input signals. However, one adjacent direction output LB is contained only in Lt and Bt, whereas the other adjacent output direction C is contained only in Lt and Rt. Thus, in order to have something to cancel, it is necessary to use combinations of all three input signals, Lt, Rt and Bt. As an example (there are probably other coefficients satisfying the requirements):

$$antiL1(\alpha) := \frac{Lt(\alpha) - Bt(\alpha) + Rt(\alpha)}{2}, \text{ and} \quad \text{Eqn. 127}$$

$$antiL2(\alpha) := \frac{Lt(\alpha) - Rt(\alpha) + Bt(\alpha)}{2}. \quad \text{Eqn. 128}$$

Figure 34:
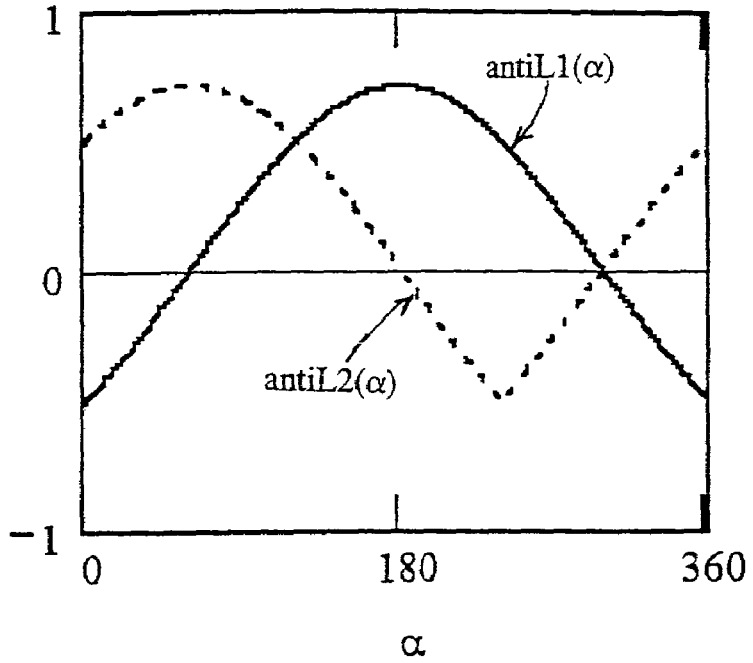

Plots of antiL1(α) and antiL2(α), the two antidominant signals required for deriving the L output, versus the angle of the encoded source signal α, are shown in FIG. 34.

The required gains to force equal magnitudes are:

$$g11(\alpha) := \text{if}\left(\left|\frac{antiL1(\alpha)}{antiL2(\alpha)+\delta}\right| > 1, \left|\frac{antiL2(\alpha)}{antiL1(\alpha)}\right|, 1\right), \text{ and} \quad \text{Eqn. 129}$$

$$g12(\alpha) := \text{if}\left(\left|\frac{antiL2(\alpha)}{antiL1(\alpha)+\delta}\right| > 1, \left|\frac{antiL1(\alpha)}{antiL2(\alpha)}\right|, 1\right). \quad \text{Eqn. 130}$$

The equal terms are:

$$L1(\alpha)=gl1(\alpha)\cdot antiL1(\alpha), \text{ and} \quad \text{Eqn. 131}$$

$$L2(\alpha)=gl2(\alpha)\cdot antiL2(\alpha). \quad \text{Eqn. 132}$$

and the combination giving the left output is $$Lout(\alpha)=L1(\alpha)+L2(\alpha). \quad \text{Eqn. 133}$$

Figure 35:
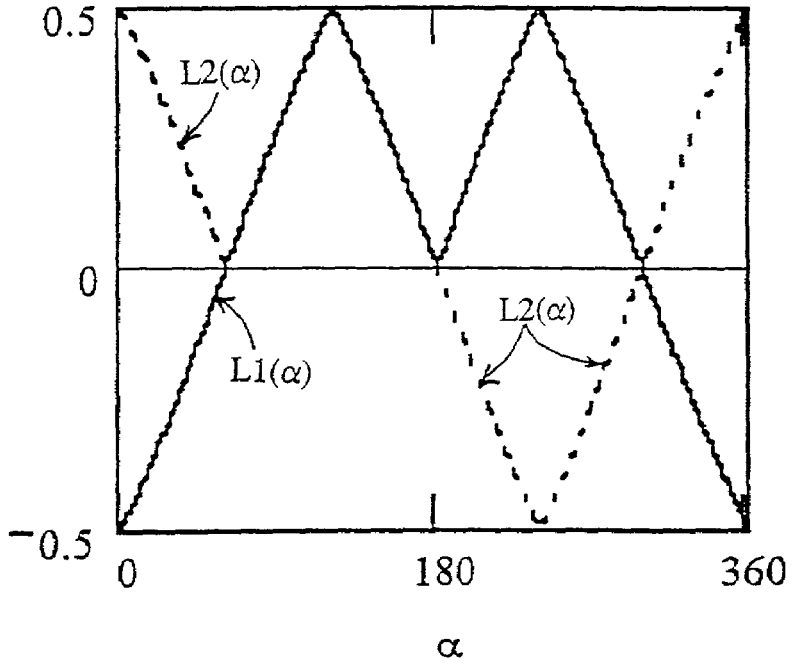
Figure 36:
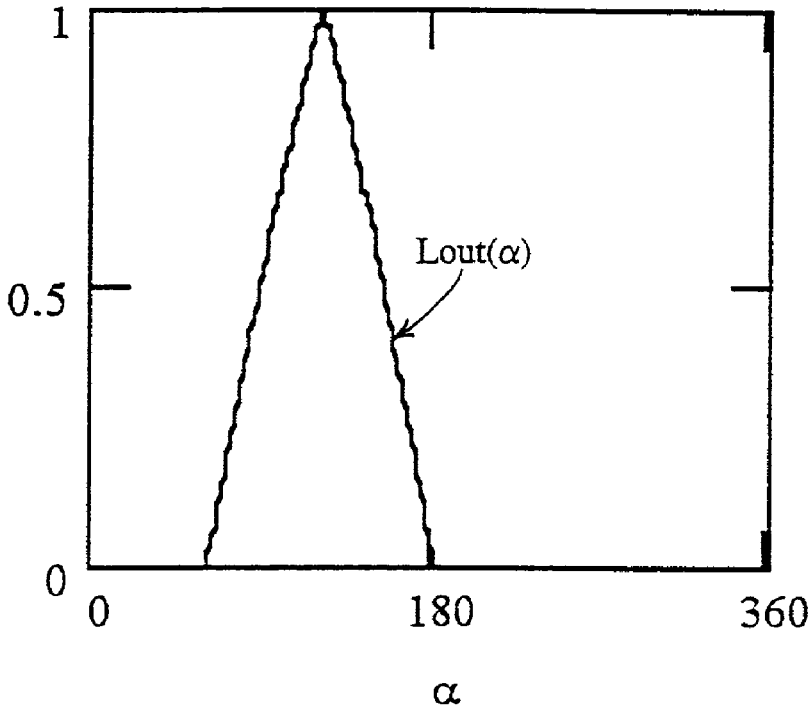

A plot of L1(α) and L2(α) versus the angle of the encoded source signal α is shown in FIG. 35. A plot of Lout(α) versus the angle of the encoded source signal α is shown in FIG. 36.

Similarly for the B output:

$$antiB1(\alpha) := \frac{Bt(\alpha) - Rt(\alpha) + Lt(\alpha)}{2} \quad \text{Eqn. 134}$$

$$antiB2(\alpha) := \frac{Bt(\alpha) + Rt(\alpha) - Lt(\alpha)}{2} \quad \text{Eqn. 135}$$

$$gb1(\alpha) := \text{if}\left(\left|\frac{antiB1(\alpha)}{antiB2(\alpha)+\delta}\right| > 1, \left|\frac{antiB2(\alpha)}{antiB1(\alpha)}\right|, 1\right) \quad \text{Eqn. 136}$$

$$gb2(\alpha) := \text{if}\left(\left|\frac{antiB2(\alpha)}{antiB1(\alpha)+\delta}\right| > 1, \left|\frac{antiB1(\alpha)}{antiB2(\alpha)}\right|, 1\right) \quad \text{Eqn. 137}$$

$$B1(\alpha):=gb1(\alpha)\cdot antiB1(\alpha) \quad \text{Eqn. 138}$$

$$B2(\alpha):=gb2(\alpha)\cdot antiB2(\alpha) \quad \text{Eqn. 139}$$

$$Bout(\alpha):=B1(\alpha)+B2(\alpha) \quad \text{Eqn. 140}$$

Figure 37:
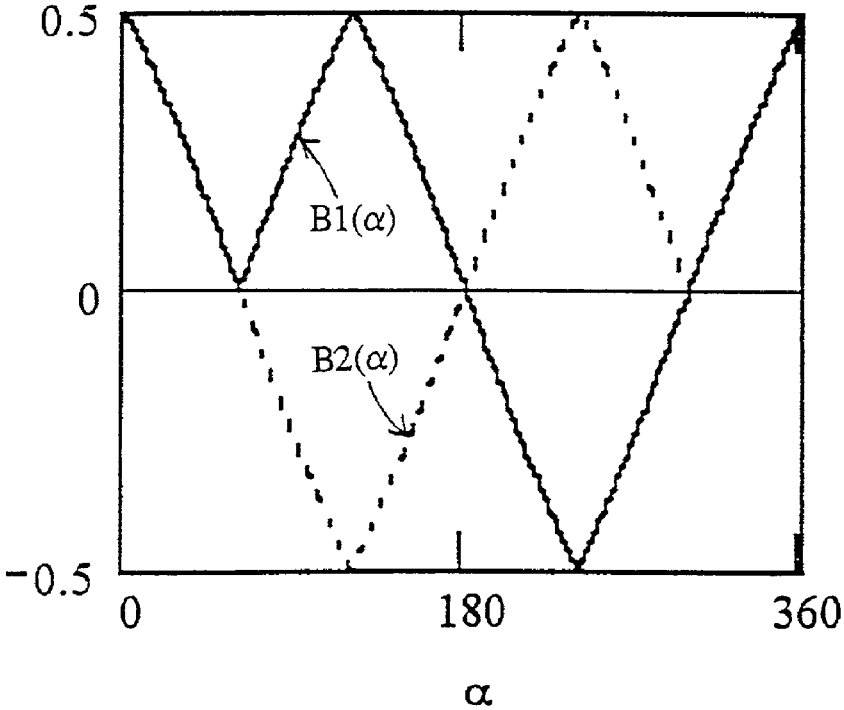
Figure 38:
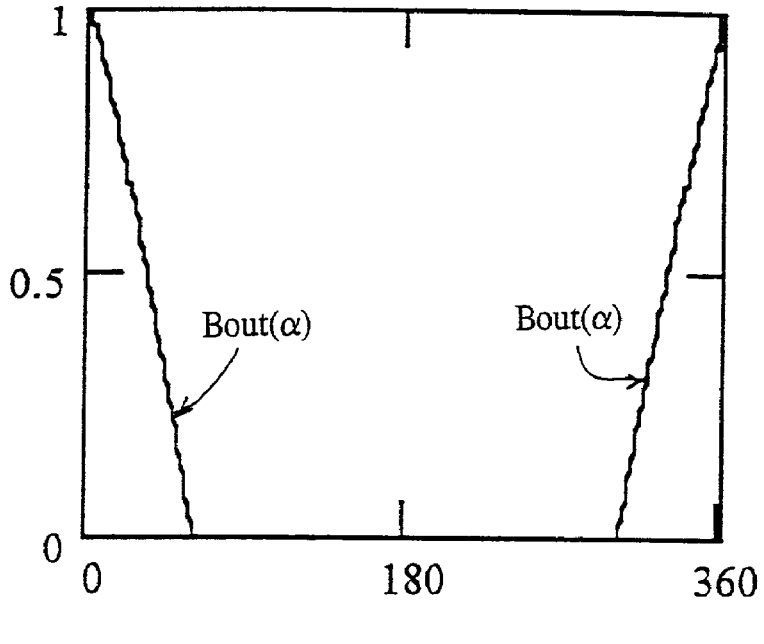

A plot of B1(α) and B2(α) versus the angle of the encoded source signal α is shown in FIG. 37. A plot of Bout(α) versus the angle of the encoded source signal a is shown in FIG. 38.

Similarly for the C output:

$$antiC1(\alpha) := \frac{Rt(240)\cdot Lt(\alpha) - Lt(240)\cdot Rt(\alpha)}{\sqrt{2}} \quad \text{Eqn. 141}$$

$$antiC2(\alpha) := \frac{Rt(240)\cdot Lt(\alpha) - Lt(240)\cdot Rt(\alpha)}{\sqrt{2}} \quad \text{Eqn. 142}$$

$$gc1(\alpha) := \text{if}\left(\left|\frac{antiC1(\alpha)}{antiC2(\alpha)+\delta}\right| > 1, \left|\frac{antiC2(\alpha)}{antiC1(\alpha)}\right|, 1\right) \quad \text{Eqn. 143}$$

$$gc2(\alpha) := \text{if}\left(\left|\frac{antiC2(\alpha)}{antiC1(\alpha)+\delta}\right| > 1, \left|\frac{antiC1(\alpha)}{antiC2(\alpha)}\right|, 1\right) \quad \text{Eqn. 144}$$

$$C1(\alpha):=gc1(\alpha)\cdot antiC1(\alpha) \quad \text{Eqn. 145}$$

$$C2(\alpha):=gc2(\alpha)\cdot antiC2(\alpha) \quad \text{Eqn. 146}$$

$$Cout(\alpha):=C2(\alpha)-C1(\alpha) \quad \text{Eqn. 147}$$

Figure 39:
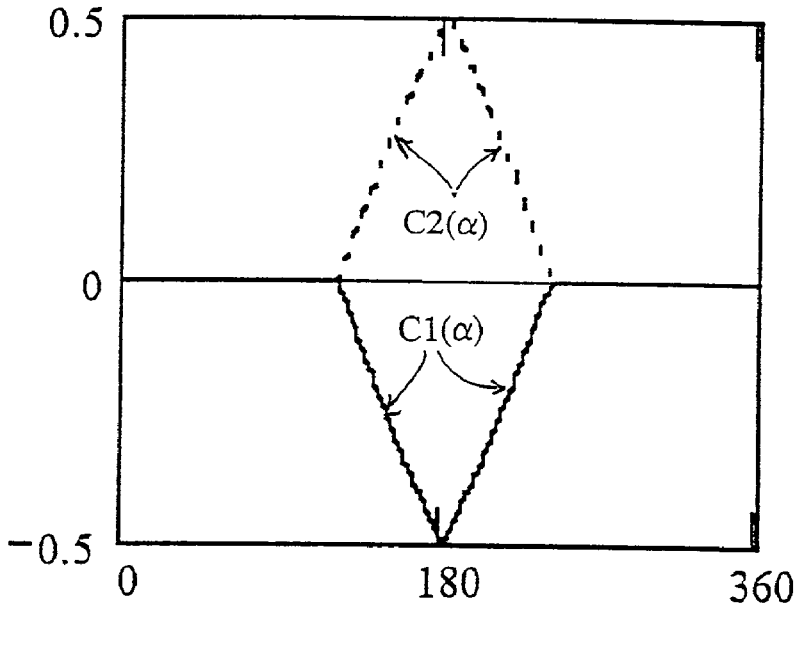
Figure 40:
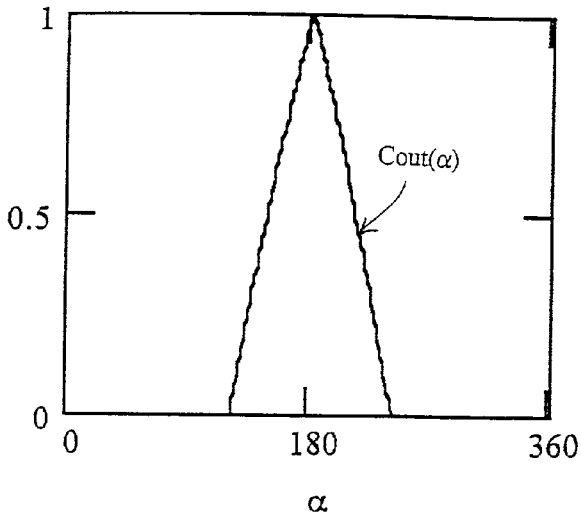

A plot of C1(α) and C2(α) versus the angle of the encoded source signal α is shown in FIG. 39. A plot of Cout(α) versus the angle of the encoded source signal α is shown in FIG. 40.

Figure 41:
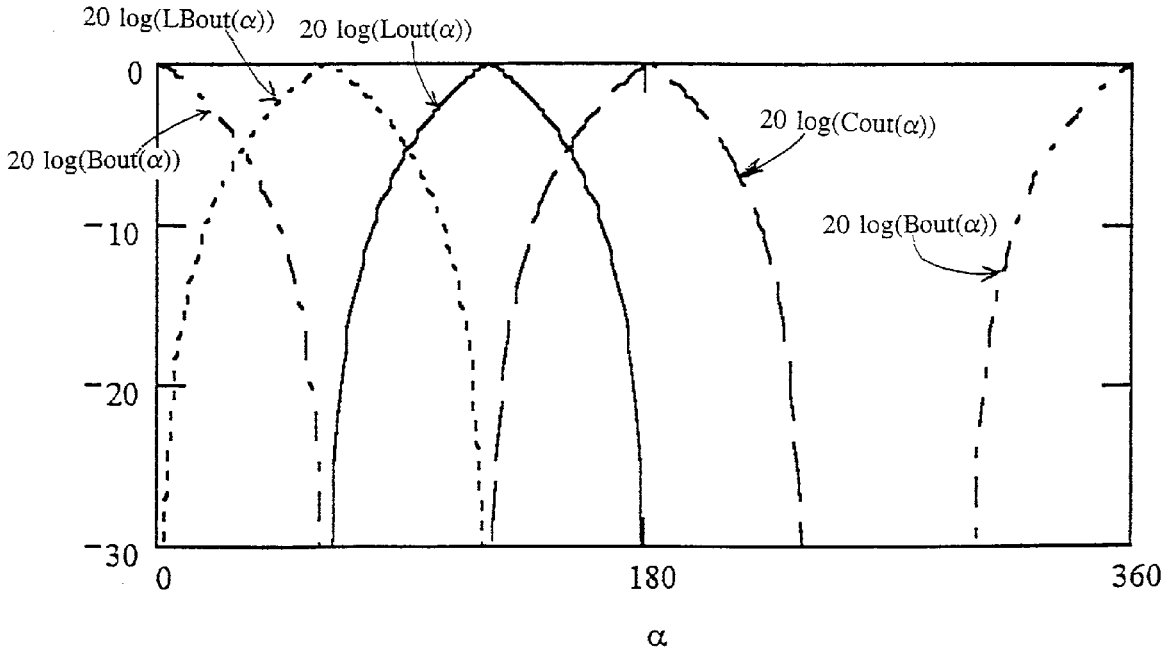

Similar calculations may be made for the remaining two outputs (R and RB). After conversion to dB, the four outputs calculated above are shown plotted versus the angle of the encoded source signal α in FIG. 41.

Calculating the Coefficients for the Antidominant Signals Existence and Number of Zeros in Antidominant Signals If one expresses the audio signal source direction as the angle α, the normalized functions coding direction in the input signals to the decoder will be cyclic. For example, 30° and 300°+360° represent the same direction.

Figure 1:
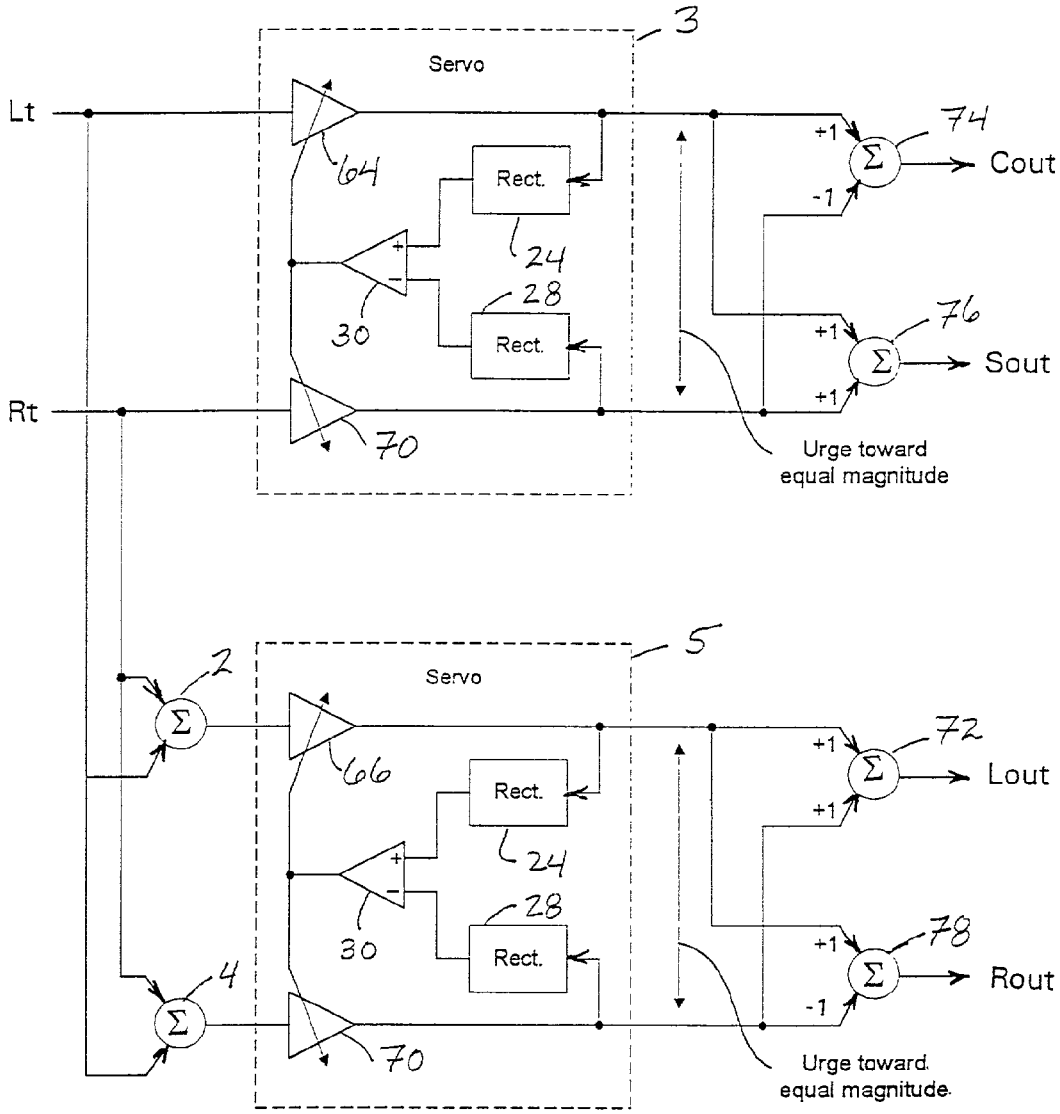
FIG. 1 is a functional and schematic diagram of an active audio matrix decoder useful in understanding the present invention.
Figure 2:
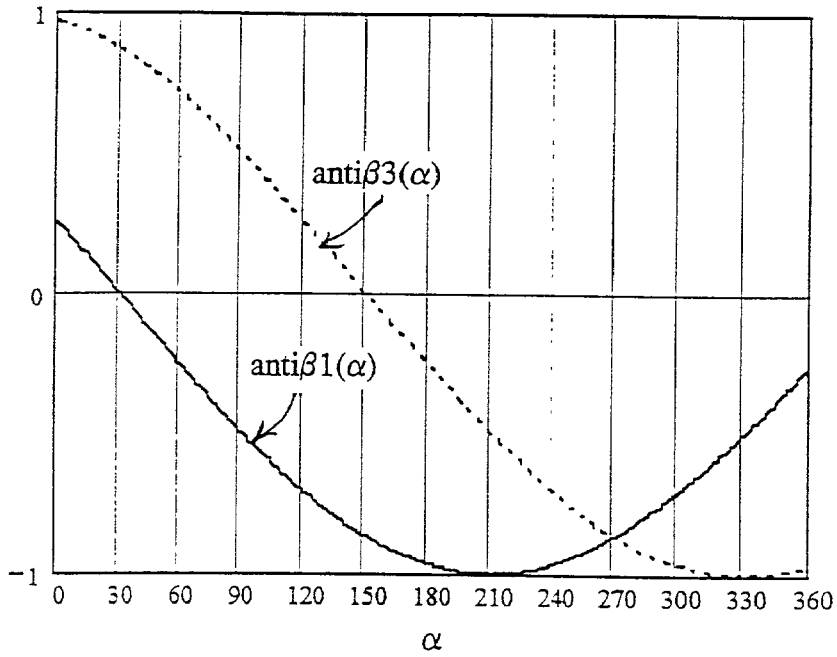
FIGS. 2–5 are idealized graphs for the case when a single source audio signal having a unity amplitude encoded into two signals is applied to a decoder according to the present invention.

Consider the case of two input signals, where direction is conveyed by the relative amplitudes and polarities of normalized functions. Only one direction requires one function to have a finite non-zero value when the other is zero (e.g. left front, where Lt=1 and Rt=0), and at that point the polarity of the finite function is irrelevant to the direction (e.g. again for left front, it makes no difference whether Lt=+1 or −1). It is apparent that all possible directions can be conveyed by half a cycle of the functions; the other half will merely repeat all directional coding with both functions adopting opposite polarities but therefore the same relative polarity. Expressed differently, for two input signals, the functions will be of α/2; Equations 1 and 2 illustrate one common choice. Since a full cycle must pass through zero twice, the half-cycle of each function will pass through zero only once as a source direction is panned through a whole circle. Linear combinations of the input signals, such as antidominant signals, will therefore also pass through zero only once, as illustrated in FIG. 2.

When there are more than two input signals, the directional functions may show more zeros. For instance, for the case of three input signals in the symmetrical case shown in equations 117–119, the half-cycle of each function occupies not the full circle of possible direction but only two-thirds of it. In other words, the functions will be of 3/2.α/2 or 3α/4, and a half-cycle may have no more than two zeros. Cyclic antidominant signals derived by linear combinations of the cyclic input signals will also therefore have no more than two zeros.

In general, if N input signals express direction using cyclic functions chosen so that there is no ambiguity (so that a particular set of relative magnitudes and polarities convey only one direction), antidominant signals formed from them will be cyclic in Nα/4 and will have no more than P zeros, where P is N/2 rounded up to an integer when N is odd.

Zeros in the Signals Urged Towards Equal Magnitudes

Figure 7:
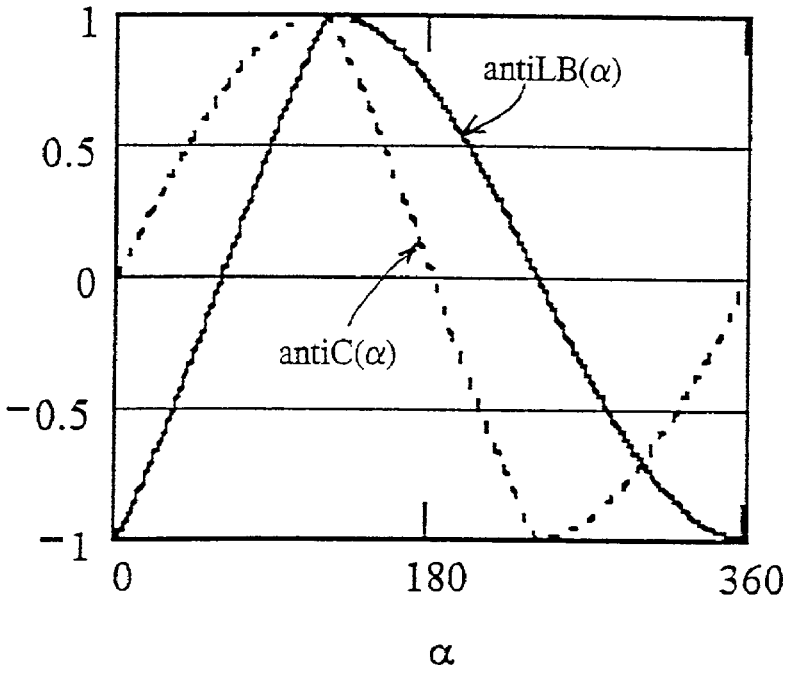
FIGS. 7–12 are idealized graphs for the case when a single source audio signal having a unity amplitude encoded into three signals is applied to a decoder according to the present invention.
Figure 10:
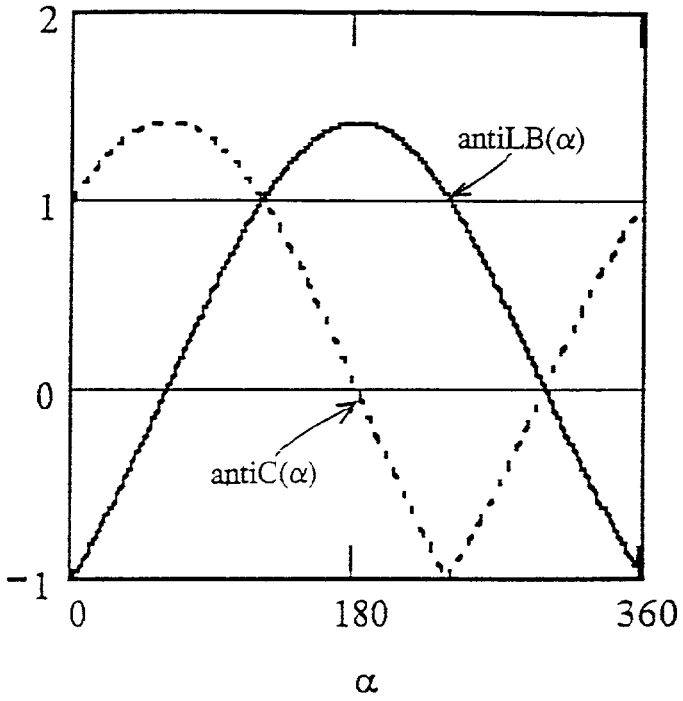

Each output of a servo is one of the inputs multiplied by a positive number, generally lying between zero and one. Hence a zero value at the output can arise from two causes.

a) The servo input, i.e. an antidominant signal, may itself be zero. In general, when an antidominant signal passes through zero, it changes polarity (see FIGS. 2, 7 and 10). In this case, since the servo output must have the same polarity as its input, the output will also change polarity as it passes through zero. See, for example, FIG. 4. At 30°, magβ1 passes through zero and changes from positive to negative. Similarly at 150°, magβ3 passes through zero and changes from positive to negative. Call this a Type I zero.

b) Alternatively, the servo output may go to zero (or close to it) because the servo gain (VCA, multiplier etc.) goes to zero (or close to it). In this case, the corresponding servo input is not zero, and so there is no change in polarity in the input or the output. Again, in FIG. 4, at 30°, mag$\beta$3 goes to zero but is always positive (it does not cross the horizontal axis), and at 150°, mag$\beta$1 goes to zero but remains negative. Call this a Type II zero.

Zeros in the Antidominant Signals

As explained elsewhere, if the combination (addition or subtraction) of two signals urged towards equal magnitudes is to yield a finite output over one segment of direction, and substantially nothing over the remainder of the circle, they must have one relative polarity over the desired segment and the opposite relative polarity outside it. As illustrated in FIG. 4, for a system with two input signals, there are two zeros in each signal, one resulting from a zero in the corresponding antidominant signal (as in a) above) and the other from a zero in the other antidominant signal (giving a zero multiplier as in b) above)). Hence, there can only be two changes in relative polarity in a pan around the whole circle, or expressed differently, the circle consists of two segments, one with one relative polarity and the other with the other. After combination, there can then only be one segment with a finite output, the other giving substantially no output.

However, for more than two input signals, the pair of signals combined for an output may have more than one zero of each sort, and potentially there may then be more than one segment where the combination is non-zero.

Figure 8:
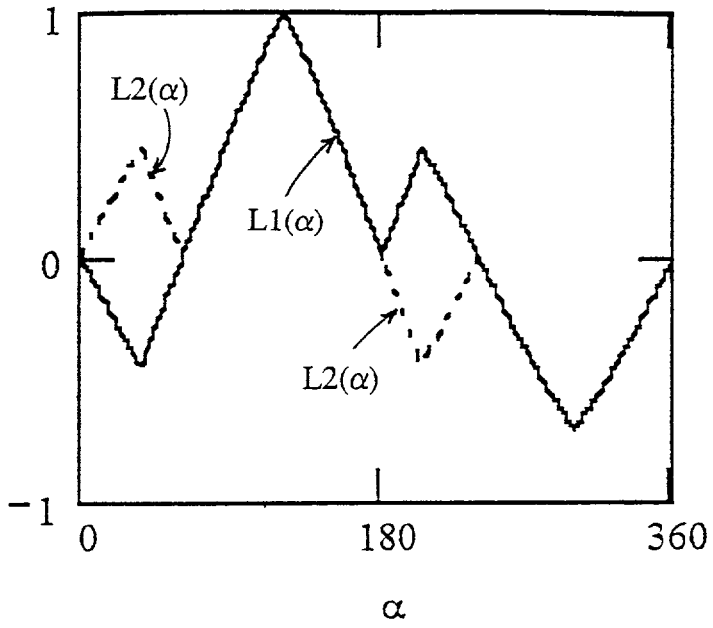
Figure 9:
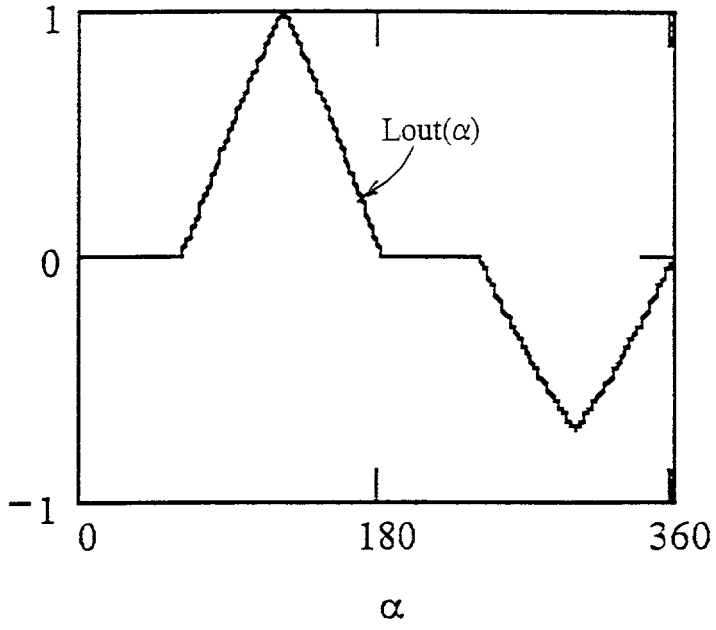
Figure 11:
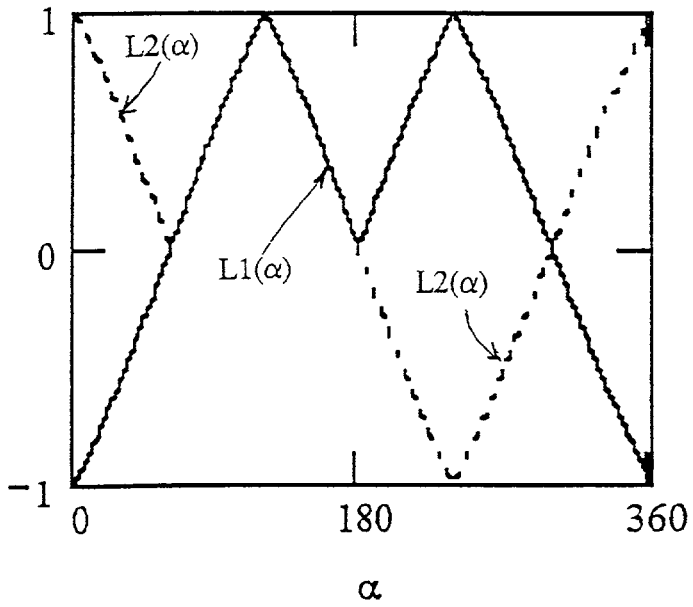
Figure 12:
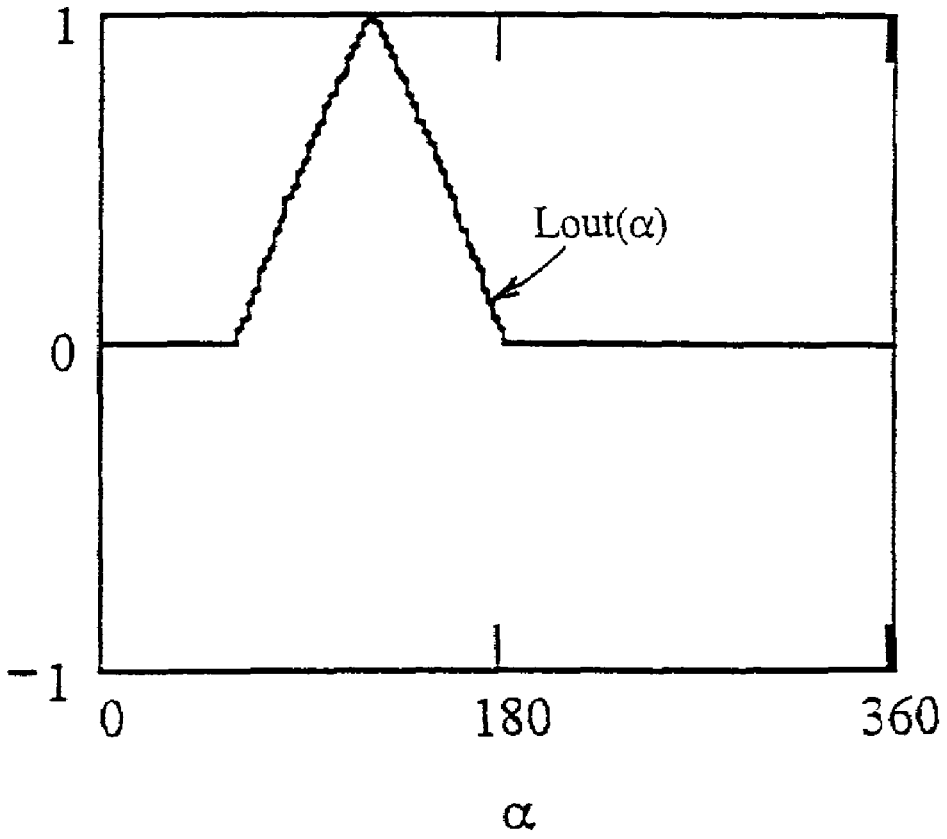

Comparing FIGS. 8 and 11, it is apparent that the requirement for only one segment with non-zero output means that each of the signals to be combined must have only one direction at which it approaches zero but does not cross the axis as in the Type II case above.

In FIG. 8, L2 goes to zero but does not cross the axis twice, at 60 and 240°, and L1 goes to zero but does not cross the axis twice, at 0 (or 360) and 180°. Hence addition yields finite output between 60 and 180 (as desired) and also between 240 and 360°. (Subtraction would similarly yield finite outputs between 0 and 60 and between 180 and 240°).

Contrast this with FIG. 11. L1 and L2 each have one angle and one only where the function approaches zero but does not cross the axis and change polarity. At all other angles where L1 and L2 approach zero, they do so at the same angle and both change polarity, so that their relative polarities do not change. Hence addition in the case of opposite polarities, or subtraction in the case of the same polarities, yields substantially no output except in the one segment between the angles where L1 and L2 do not cross the axis.

At the boundaries of a segment delivering finite output, one of the signals being combined approaches zero but does not change polarity, and the other passes through zero and therefore does change polarity; their relative polarities change, so on one side of the boundary they substantially cancel (little or no output) and on the other they combine to deliver the desired finite output. In other words, at the boundaries, one signal must have a Type I zero and the other a Type II. All other zeros must be Type I and coincide so that the relative polarity does not change and the cancellation continues.

Since all Type I zeros in a servo output coincide with zeros of the corresponding antidominant signal, for one finite segment all the zeros of the antidominant signals must coincide except those at the boundary angles (the adjacent directions, where one output will have a Type I zero and the other Type II zero).

Expressing this differently, each antidominant signal (servo input) will pass through zero and change polarity at several places. One place will be at a boundary (an adjacent direction), but at the other boundary the antidominant signal must not be zero (the servo output will have a Type II zero). All other zeros must coincide with zeros of the other antidominant signal of the pair.

Expressed in yet another way, if there is only one segment that delivers an output, the antidominant signals will have one relative polarity within that segment and the opposite relative polarity outside it.

Coefficients of Antidominant Signals

An antidominant signal formed from N input signals S1($\alpha$), S2($\alpha$) . . . SN($\alpha$) by using coefficients A1, A2 . . . AN can be expressed:

$$Anti(\alpha) = \sum_{n=1}^{N} An \cdot Sn(\alpha) \qquad \text{Eqn. 148}$$

As shown above, an antidominant signal must go to zero for particular values of $\alpha$. If the sum or difference of a pair of antidominant signals is to be finite over a desired segment and zero everywhere else, each antidominant must in fact go to zero at one edge of that segment plus at all other points where the other antidominant of the pair goes to zero except the other edge. There will be no more than P angles where an antidominant is required to go to zero. Call these angles $\gamma\mathbf{1}, \gamma\mathbf{2}, \ldots \gamma P.$ Then, at each of these, the antidominant signal is zero, that is $Anti(\lambda\mathbf{1})=0,\ Anti(\gamma\mathbf{2})=0,$ etc.

Thus, one can form P simultaneous equations:

$$\sum_{n=1}^{N} An \cdot Sn(\lambda 1) = 0, \qquad \text{Eqn. 149}$$

$$\sum_{n=1}^{N} An \cdot Sn(\lambda 2) = 0, \qquad \text{Eqn. 150}$$

up to $$\sum_{n=1}^{N} An \cdot Sn(\lambda P) = 0. \qquad \text{Eqn. 151}$$

If one already knows the values of the $\gamma$ angles (for instance, if they can be deduced by symmetry), these P equations contain N unknowns, the coefficients A. Since the absolute values of these are arbitrary (one only cares about their relative values), it is possible to set one to an arbitrary value, so there are only N−1 independent coefficients.

It will be apparent that only for N=2 and N=3 is the number of equations adequate to solve for the coefficients, if no other information is available. However, in practice real systems have symmetry (for instance, about the front/back axis), so by inspection some of the coefficients have the same values, and the number of variables can therefore be reduced and the equations solved.

If one does not know the values of y, one can write the equivalent equations for all antidominant signals of interest, inserting those "variables" that one does know (for each antidominant one obviously knows the y for that actual direction) and any equivalent angles y and coefficients again deduced by symmetry, and hence reduce the number of unknowns.

CONCLUSION

It should be understood that implementation of other variations and modifications of the invention and its various aspects will be apparent to those skilled in the art, and that the invention is not limited by these specific embodiments described. It is therefore contemplated to cover by the present invention any and all modifications, variations, or equivalents that fall within the true spirit and scope of the basic underlying principles disclosed and claimed herein.

Those of ordinary skill in the art will recognize the general equivalence of hardware and software implementations and of analog and digital implementations. Thus, the present invention may be implemented using analog hardware, digital hardware, hybrid analog/digital hardware and/or digital signal processing. Hardware elements may be performed as functions in software and/or firmware. Thus, all of the various elements and functions (e.g., matrices, rectifiers, comparators, combiner, variable amplifiers or attenuators, etc.) of the disclosed embodiments may be implemented in hardware or software in either the analog or digital domains.

We claim:

1. A method of deriving one of a plurality of output audio signals from two input audio signals S1(α) and S2(α), the output audio signal associated with a principal direction β2, the input audio signals encoded with an audio source signal having a direction α, comprising generating two antidominant audio signals of the form:

$$antidominant\beta 1(\alpha)=AS1\beta 1\cdot S1(\alpha)+AS2\beta 1\cdot S2(\alpha)$$

and $$antidominant\beta 3(\alpha)=AS1\beta 3\cdot S1(\alpha)+AS2\beta 3\cdot S2(\beta),$$

wherein in one antidominant signal the angle β1 is the angle of one of the two principal directions adjacent to the principal direction β2 of the output audio signal and in the other antidominant signal the angle β3 is the angle of the other of the two principal directions adjacent to the principal direction β2 of the output audio signal, and wherein the coefficients AS1β1 and AS2β1 are selected so that the one antidominant signal is substantially zero when α is β1 and the coefficients AS1β3 and AS2β3 are selected so that the other antidominant signal is substantially zero when α is β3, applying amplitude control to the two antidominant signals to deliver a pair of signals having substantially equal magnitudes, and additively or subtractively combining the amplitude controlled antidominant audio signals to provide the output audio signal.

2. A method of deriving one of a plurality of output audio signals from two or more input audio signals (S1(α), . . . Sn(α)), the output audio signal associated with a principal direction β2, the input audio signals encoded with an audio source signal having a direction α, comprising generating two antidominant audio signals of the form:

$$anti\beta 1(\alpha)=\sum_{n=1}^{N} ASn\beta 1\cdot Sn(\alpha)$$

and $$anti\beta 3(\alpha)=\sum_{n=1}^{N} ASn\beta 3\cdot Sn(\alpha)$$

wherein N is the number of input audio signals, β1 is the angle of one of the two principal directions adjacent to the principal direction β2 of the output audio signal, β3 is the angle of the other of the two principal directions adjacent to the principal direction β2 of the output audio signal, and the coefficients ASnβ1 and ASnβ3 are selected so that the antidominant signals have one relative polarity when a lies between β1 and β3 and the other relative polarity for all other values of α, controlling the relative amplitudes of the two antidominant audio signals so that their amplitudes are urged toward equality, and additively or subtractively combining the amplitude controlled antidominant audio signals to provide the output audio signal.

3. A method of deriving one of a plurality of output audio signals from two input audio signals S1(α) and S2(α), the output audio signal associated with a principal direction β2, the input audio signals encoded with an audio source signal having a direction α, comprising generating two antidominant audio signals of the form:

$$antidominant\beta 1(\alpha)=AS1\beta 1\cdot S1(\alpha)+AS2\beta 1\cdot S2(\alpha)$$

and $$antidominant\beta 3(\alpha)=AS1\beta 3\cdot S1(\alpha)+AS2\beta 3\cdot S2(\alpha),$$

wherein in one antidominant signal the angle β1 is the angle of one of the two principal directions adjacent to the principal direction β2 of the output audio signal and in the other antidominant signal the angle β3 is the angle of the other of the two principal directions adjacent to the principal direction β2 of the output audio signal, and wherein the coefficients AS1β1 and AS2β1 are selected so that the one antidominant signal is substantially zero when α is β1 and the coefficients AS1β3 and AS2β3 are selected so that the other antidominant signal is substantially zero when α is β3, applying amplitude control to the two antidominant signals to deliver a first pair of signals having substantially equal magnitudes, the pair of signals having the form $$antidominant\beta(\alpha)\cdot(1-g),$$

where g is the gain or attenuation of an amplitude control element or function, and a second pair of signals having the form $$antidominant\beta(\alpha)\cdot g,$$

generating the passive matrix component for the principal direction β2, and additively or subtractively combining the second pair of signals with the passive matrix component for the principal output direction β2 to provide the output audio signal.

4. A method of deriving one of a plurality of output audio signals from two or more input audio signals (S1(α), . . .

Sn(α)), the output audio signal associated with a principal direction β2, the input audio signals encoded with an audio source signal having a direction α, comprising generating two antidominant audio signals of the form:

$$anti\beta 1(\alpha) = \sum_{n=1}^{N} ASn\beta 1 \cdot Sn(\alpha)$$

and $$anti\beta 3(\alpha) = \sum_{n=1}^{N} ASn\beta 3 \cdot Sn(\alpha)$$

wherein N is the number of input audio signals, β1 is the angle of one of the two principal directions adjacent to the principal direction β2 of the output audio signal, β3 is the angle of the other of the two principal directions adjacent to the principal direction β2 of the output audio signal, and the coefficients ASnβ1 and ASnβ3 are selected so that the antidominant signals have one relative polarity when α lies between β1 and β3 and the other relative polarity for all other values of α, applying amplitude control to the two antidominant signals to deliver a first pair of signals having substantially equal magnitudes, the pair of signals having the form antidominantβ(α)·(1−g), where g is the gain or attenuation of an amplitude control element or function, and a second pair of signals having the form antidominantβ(α)·g, generating the passive matrix component for the principal direction β2, and additively or subtractively combining the second pair of signals with the passive matrix component for the principal output direction β2 to provide the output audio signal.

5. A method according To any one of claims 1 through 4 further comprising scaling the relative amplitude of the first antidominant signal with respect to the second antidominant signal by a substantially fixed constant.

6. A method according to any one of claims 1 through 4 further comprising variably scaling the first and second antidominant signals with respect to the direction α of an audio source signal encoded into the input audio signals.

7. A method according to claim 1 or claim 2 wherein the sense in which the amplitude controlled antidominant signals are combined is the polarity that places the output signal direction within the smaller of the two arcs between the adjacent principal directions β1 and β2.

8. A method according to claim 3 or claim 4 wherein the sense in which the second pair of signals is combined with the passive matrix component is the polarity that places the output signal direction within the smaller of the two arcs between the adjacent principal directions β1 and β2.

9. Apparatus for deriving one of a plurality of output audio signals from two input audio signals S1(α) and S2(α), the output audio signal associated with a principal direction β2, the input audio signals encoded with an audio source signal having a direction α, comprising an antidominant matrix receiving said two input audio signals, the matrix generating two antidominant audio signals of the form:

$$antidominant\beta 1(\alpha)=AS1\beta 1 \cdot S1(\alpha)+AS2\beta 1 \cdot S2(\alpha)$$

and $$antidominant\beta 3(\alpha)=AS1\beta 3 \cdot S1(\alpha)+AS2\beta 3 \cdot S2(\alpha),$$

wherein in one antidominant signal the angle β1 is the angle of one of the two principal directions adjacent to the principal direction β2 of the output audio signal and in the other antidominant signal the angle β3 is the angle of the other of the two principal directions adjacent to the principal direction β2 of the output audio signal, and wherein the coefficients AS1β1 and AS2β1 are selected so that the one antidominant signal is substantially zero when α is β1 and the coefficients AS1β3 and AS2β3 are selected so that the other antidominant signal is substantially zero when α is β3, a servo including a pair of variable amplifiers or attenuators receiving the two antidominant signals and delivering a pair of signals having substantially equal magnitudes, and a combiner combining additively or subtractively the amplitude controlled antidominant audio signals to provide the output audio signal.

10. Apparatus for deriving one of a plurality of output audio signals from two or more input audio signals (S1(α), . . . Sn(α)), the output audio signal associated with a principal direction β2, the input audio signals encoded with an audio source signal having a direction α, comprising an antidominant matrix receiving said two input signals, the matrix generating two antidominant audio signals of the form:

$$anti\beta 1(\alpha) = \sum_{n=1}^{N} ASn\beta 1 \cdot Sn(\alpha)$$

and $$anti\beta 3(\alpha) = \sum_{n=1}^{N} ASn\beta 3 \cdot Sn(\alpha)$$

wherein N is the number of input audio signals, β1 is the angle of one of the two principal directions adjacent to the principal direction β2 of the output audio signal, β3 is the angle of the other of the two principal directions adjacent to the principal direction β2 of the output audio signal, and the coefficients ASnβ1 and ASnβ3 are selected so that the antidominant signals have one relative polarity when a lies between β1 and β3 and the other relative polarity for all other values of α, a servo including a pair of variable amplifiers or attenuators receiving the two antidominant signals and delivering a pair of signals having substantially equal magnitudes, and a combiner combining additively or subtractively the amplitude controlled antidominant audio signals to provide the output audio signal.

11. Apparatus for deriving one of a plurality of output audio signals from two input audio signals S1(α) and S2(α), the output audio signal associated with a principal direction α2, the input audio signals encoded with an audio source signal having a direction α, comprising an antidominant matrix receiving said two input signals, the matrix generating two antidominant audio signals of the form:

$$antidominant\beta 1(\alpha)=AS1\beta 1\cdot S1(\alpha)+AS2\beta 1\cdot S2(\alpha)$$

and $$antidominant\beta 3(\alpha)=AS1\beta 3\cdot S1(\alpha)+AS2\beta 3\cdot S2(\alpha),$$

wherein in one antidominant signal the angle β1 is the angle of one of the two principal directions adjacent to the principal direction β2 of the output audio signal and in the other antidominant signal the angle β3 is the angle of the other of the two principal directions adjacent to the principal direction β2 of the output audio signal, and wherein the coefficients AS1β1 and AS2β1 are selected so that the one antidominant signal is substantially zero when α is β1 and the coefficients AS1β3 and AS2β3 are selected so that the other antidominant signal is substantially zero when α is β3, a servo including a pair of variable amplifiers or attenuators receiving the two antidominant signals and delivering a first pair of signals having substantially equal magnitudes having the form $$antidominant\beta(\alpha)\cdot(1-g),$$

where g is the gain or attenuation of an amplitude control element or function, and a second pair of signals having the form $$antidominant\beta(\alpha)\cdot g,$$

and, a passive matrix receiving said two input audio signals, the matrix generating the passive matrix component for the principal direction β2, and a combiner combining additively or subtractively the second pair of signals with the passive matrix component for the principal output direction β2 to provide the output audio signal.

12. Apparatus for deriving one of a plurality of output audio signals from two or more input audio signals (S1(α), . . . Sn(α)), the output audio signal associated with a principal direction β2, the input audio signals encoded with an audio source signal having a direction α, comprising an antidominant matrix receiving said two input signals, the matrix generating two antidominant audio signals of the form:

$$\text{anti } \beta 1(\alpha)=\sum_{n=1}^{N} ASn\beta 1\cdot Sn(\alpha)$$

and $$\text{anti } \beta 3(\alpha)=\sum_{n=1}^{N} ASn\beta 3\cdot Sn(\alpha)$$

wherein N is the number of input audio signals, β1 is the angle of one of the two principal directions adjacent to the principal direction β2 of the output audio signal, β3 is the angle of the other of the two principal directions adjacent to the principal direction β2 of the output audio signal, and the coefficients ASnβ1 and ASnβ3 are selected so that the antidominant signals have one relative polarity when a lies between β1 and β3 and the other relative polarity for all other values of α, a servo including a pair of variable amplifiers or attenuators receiving the two antidominant signals and delivering a first pair of signals having substantially equal magnitudes having the form $$antidominant\beta(\alpha)\cdot(1-g),$$

where g is the gain or attenuation of an amplitude control element or function, and a second pair of signals having the form $$antidominant\beta(\alpha)\cdot g,$$

and, a passive matrix receiving said two input audio signals, the matrix generating the passive matrix component for the principal direction β2, and a combiner combining additively or subtractively the second pair of signals with the passive matrix component for the principal output direction β2 to provide the output audio signal.

13. Apparatus according to any one of claims 9 through 12 further comprising an amplifier or attenuator receiving the first and/or second antidominant signal for scaling the relative amplitude of the first antidominant signal with respect to the second antidominant signal by a substantially fixed constant.

14. Apparatus according to any one of claims 9 through 12 further comprising a variable amplifier or attenuator receiving the first and second antidominant signals for scaling the first and second antidominant signals with respect to the direction α of an audio source signal encoded into the input audio signals.

15. Apparatus according to claim 9 or claim 10 wherein said combiner combines the amplitude controlled antidominant signals in the polarity that places the output signal direction within the smaller of the two arcs between the adjacent principal directions β1 and β2.

16. Apparatus according to claim 11 or claim 12 wherein said combiner combines the second pair of signals with the passive matrix component in the polarity that places the output signal direction within the smaller of the two arcs between the adjacent principal directions β1 and β2.

* * * * *